US010909843B2

(12) United States Patent
Chambers et al.

(10) Patent No.: US 10,909,843 B2
(45) Date of Patent: Feb. 2, 2021

(54) TRAFFIC CIRCLE IDENTIFICATION SYSTEM AND METHOD

(71) Applicant: Nissan North America, Inc., Franklin, TN (US)

(72) Inventors: Jeremy Chambers, Casco, MI (US); Roy Goudy, Farmington Hills, MI (US); Neal Probert, Farmington Hills, MI (US)

(73) Assignee: Nissan North America, Inc., Franklin, TN (US)

( * ) Notice: Subject to any disclaimer, the term of this patent is extended or adjusted under 35 U.S.C. 154(b) by 83 days.

(21) Appl. No.: 15/477,827

(22) Filed: Apr. 3, 2017

(65) Prior Publication Data

US 2018/0284264 A1 Oct. 4, 2018

(51) Int. Cl.

| | |
|---|---|
| ***G08G 1/01*** | (2006.01) |
| ***G08G 1/16*** | (2006.01) |
| ***G08G 1/056*** | (2006.01) |
| ***G08G 1/0967*** | (2006.01) |

(52) U.S. Cl.

CPC ..... *G08G 1/0112* (2013.01); *G08G 1/056* (2013.01); *G08G 1/096716* (2013.01); *G08G 1/096791* (2013.01); *G08G 1/163* (2013.01)

(58) Field of Classification Search

CPC ..... G01S 13/931

See application file for complete search history.

(56) References Cited

U.S. PATENT DOCUMENTS

| | | | | |
|---|---|---|---|---|
| 7,821,421 | B2 * | 10/2010 | Tamir | G06Q 30/0283 340/901 |
| 8,229,663 | B2 * | 7/2012 | Zeng | B60W 40/02 180/168 |
| 8,294,594 | B2 * | 10/2012 | Goudy | G08G 1/164 340/905 |
| 8,452,771 | B2 * | 5/2013 | Kurciska | G08G 1/0112 707/737 |
| 9,541,408 | B2 * | 1/2017 | Stahlin | G01C 21/32 |
| 9,672,759 | B2 * | 6/2017 | Hofmann | G09B 29/003 |
| 10,037,611 | B2 * | 7/2018 | van 't Woud | G06T 17/05 |
| 2005/0285756 | A1 * | 12/2005 | Shwak | G08G 1/096716 340/903 |
| 2016/0374236 | A1 * | 12/2016 | Eder | H02K 3/30 |

* cited by examiner

*Primary Examiner* — Michael A Berns

(74) *Attorney, Agent, or Firm* — Global IP Counselors, LLP

(57) ABSTRACT

A traffic circle identification system and method employ a receiver and a controller. The receiver is disposed onboard a host vehicle and configured to receive remote vehicle information representing a travel condition of at least one remote vehicle. The controller is configured to determine whether a traffic circle exists along a current travel path of the host vehicle based on the remote vehicle information.

16 Claims, 43 Drawing Sheets

TRAFFIC CIRCLE IDENTIFICATION SYSTEM AND METHOD

BACKGROUND OF THE INVENTION

Field of the Invention

The present invention generally relates to a traffic circle identification system and method. More specifically, the present invention relates to an on-board vehicle system and method for determining whether a traffic circle exists along a current travel path of the host vehicle based on remote vehicle information received from at least one remote vehicle.

Background Information

Vehicles having a navigation system typically acquire and store road map data that the navigation system uses to generate a map display. A map display typically includes images representing the roads within a designated area of the vehicle, as well as other images such as landmarks, fueling station locations, restaurants, weather data, traffic information and so on.

Traffic circles are becoming more common, especially to avoid the use of traffic signals in highly traveled areas. As drivers understand, traffic circles are different to navigate than typical intersections. Therefore, it can be beneficial for a driver to be informed of the presence of an upcoming traffic circle in advance. Map data is currently the most common way of detecting the presence of a traffic circle in a vehicle's path.

SUMMARY OF THE INVENTION

Although map data can be used to identify traffic circles, it is possible that a vehicle may be unable to acquire accurate map data in certain locations. For example, map data may not take into account recently constructed traffic circles if the map data is out of date. Therefore, a need exists for an improved traffic circle identification system for identifying a traffic circle, especially along a current travel path of a host vehicle.

In accordance with one aspect of the present invention, a traffic circle identification system and method are provided which employ a receiver and a controller. The receiver is disposed onboard a host vehicle and configured to receive remote vehicle information representing a travel condition of at least one remote vehicle. The controller is configured to determine whether a traffic circle exists along a current travel path of the host vehicle based on the remote vehicle information.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
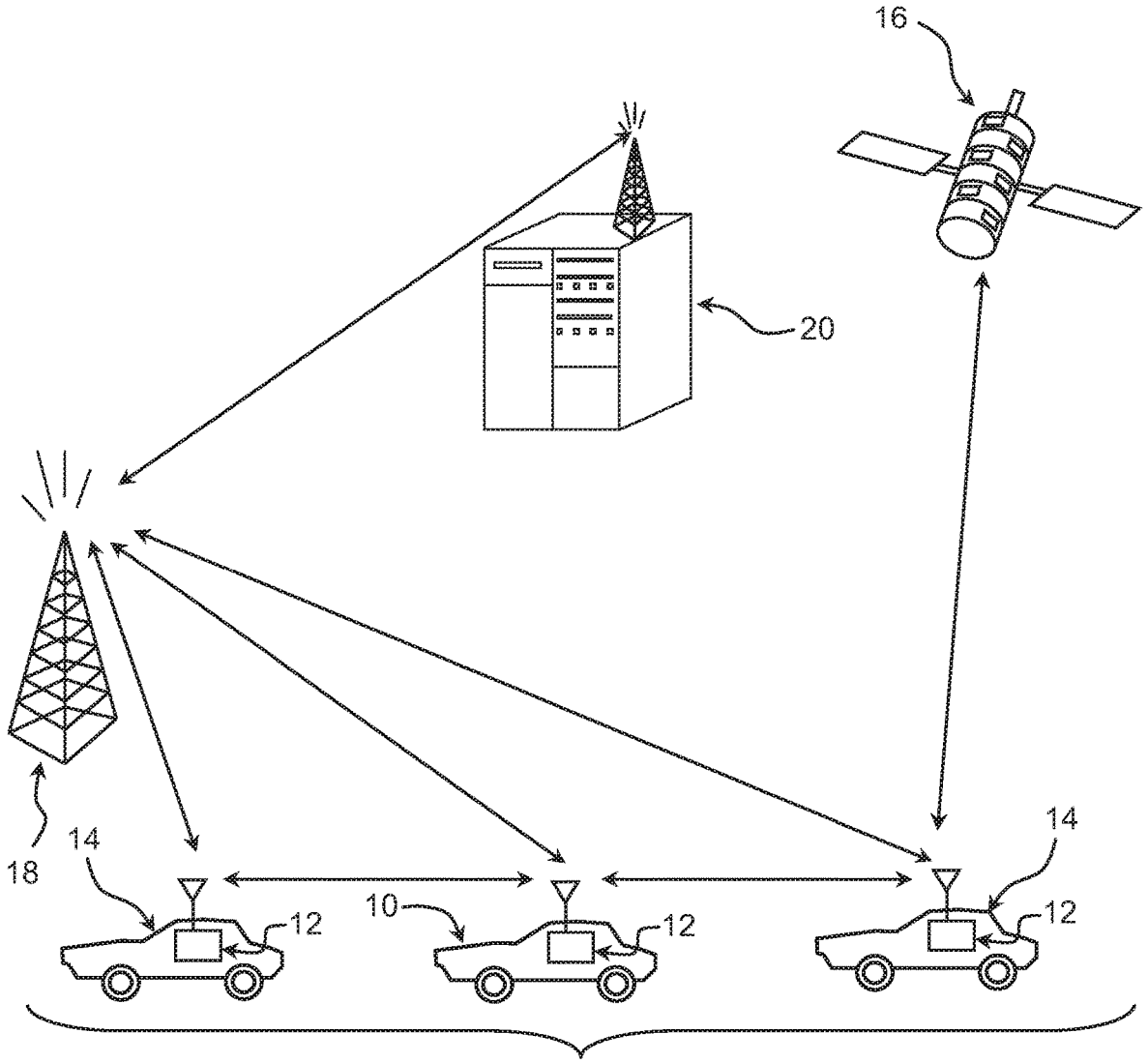
FIG. 1 is a schematic diagram illustrating an example of a host vehicle equipped with a traffic circle identification system according to embodiments disclosed herein, in relation to remote vehicles and components of a global positioning system (GPS) and a communication system.

Referring initially to FIG. 1, a two-way wireless communications network is illustrated that includes vehicle to vehicle communication and vehicle to base station communication. In FIG. 1, a host vehicle (HV) 10 is illustrated that is equipped with an traffic circle identification system 12 according to a disclosed embodiment, and two remote vehicles (RV) 14 that also includes the traffic circle identification system 12. As discussed herein, the host vehicle 10 can also be referred to as a subject vehicle (SV). The remote vehicle 14 can also be referred to as a target or threat vehicle (TV). While the host vehicle (HV) 10 and the remote vehicles 14 are illustrated as having the same traffic circle identification system 12, it will be apparent from this disclosure that each of the remote vehicles 14 can include another type of two-way communication system that is capable of communicating remote vehicle information representing a travel condition of the remote vehicle 14 to the host vehicle 10. The remote vehicle information can include, for example, information representing the location (e.g., GPS location), speed, acceleration and heading of the remote vehicle 14 at each of a plurality of locations of the remote vehicle 14, information representing a respective turning radius of the remote vehicle 14 at each of the plurality of locations of the remote vehicle 14, turn signal activation at the remote vehicle 14 at each of the plurality of locations, and any other type of information suitable for representing a travel path of the remote vehicle 14. Likewise, the host vehicle 10 can also exchange host vehicle information with each of the remote vehicles 14. This host vehicle information can include, for example, information representing the location (e.g., GPS location), speed, acceleration and heading of the host vehicle 10 at each of a plurality of locations of the host vehicle 10, information representing a respective turning radius of the host vehicle 10 at each of the plurality of locations of the host vehicle 10, turn signal activation at the host vehicle 10 at each of the plurality of locations, and any other type of information suitable for representing a travel path of the host vehicle 10. The host vehicle 10 and the remote vehicles 14 can exchange this type of host vehicle information and remote vehicle information with each other several times per second, or at any suitable time intervals.

The traffic circle identification system 12 of the host vehicle 10 and the remote vehicle 14 communicates with the two-way wireless communications network. As seen in FIG. 1, for example, the two-way wireless communications network can include one or more global positioning satellites 16 (only one shown), and one or more roadside (terrestrial) units 18 (only one shown), and a base station or external server 20. The global positioning satellites 16 and the roadside units 18 send and receive signals to and from the traffic circle identification system 12 of the host vehicle 10 and the remote vehicles 14. The base station 20 sends and receives signals to and from the traffic circle identification system 12 of the host vehicle 10 and the remote vehicles 14 via a network of the roadside units 18, or any other suitable two-way wireless communications network.

Figure 2:
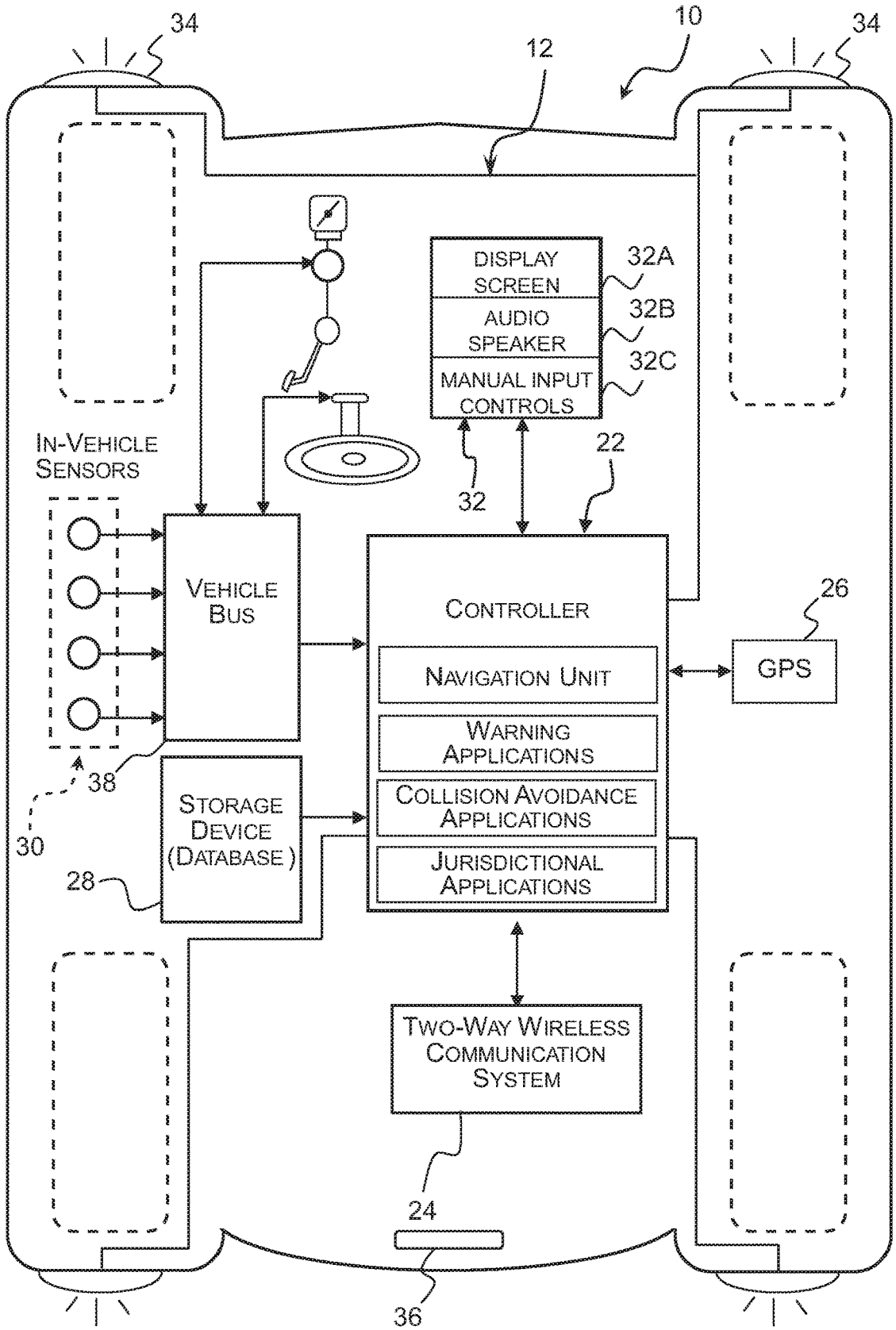
FIG. 2 is a block diagram of exemplary components of the host vehicle equipped with a traffic circle identification system according to embodiments disclosed herein.

As shown in more detail in FIG. 2, the traffic circle identification system 12 includes an application controller 22 that can be referred to simply as a controller 22. The controller 22 preferably includes a microcomputer with a control program that controls the components of the traffic circle identification system 12 as discussed below. The controller 22 includes other conventional components such as an input interface circuit, an output interface circuit, and storage devices such as a ROM (Read Only Memory) device and a RAM (Random Access Memory) device. The microcomputer of the controller 22 is at least programmed to control the traffic circle identification system 12 in accordance with the flow chart of FIG. 8 as discussed below. It will be apparent to those skilled in the art from this disclosure that the precise structure and algorithms for the controller 22 can be any combination of hardware and software that will carry out the functions of the present invention. Furthermore, the controller 22 can communicate with the other components of the traffic circle identification system 12 discussed herein via, for example a controller area network (CAN) bus or in any other suitable manner as understood in the art.

As shown in more detail in FIG. 2, the traffic circle identification system 12 can further include a wireless communication system 24, a global positioning system (GPS) 26, a storage device 28, a plurality of in-vehicle sensors 30 and a human-machine interface unit 32. The wireless communication system 24 can include, for example, a transmitter, a receiver, a transceiver, and any other suitable type of equipment as understood in the art. The human-machine interface unit 32 includes a screen display 32A, an audio speaker 32B and various manual input controls 32C that are operatively coupled to the controller 22. The screen display 32A and the audio speaker 32B are examples of interior warning devices of a warning system that are used to alert a driver. Of course, it will be apparent to those skilled in the art from this disclosure that interior warning devices include anyone of or a combination of visual, audio and/or tactile warnings as understood in the art that can be perceived inside the host vehicle 10. The host vehicle 10 also includes a pair of front headlights 34 and rear brake lights 36, which constitutes examples of exterior warning devices of the traffic circle identification system 12. These components can communicate with each other and, in particular, with the controller 22 in any suitable manner, such as wirelessly or via a vehicle bus 38.

The wireless communications system 24 can include an omni-directional antenna and a multi-directional antenna, as well as communication interface circuitry that connects and exchanges information with a plurality of the remote vehicles 14 that are similarly equipped, as well as with the roadside units 20 through at least a portion of the wireless communications network within the broadcast range of the host vehicle 10. For example, the wireless communications system 24 can be configured and arranged to conduct direct two way communications between the host and remote vehicles 10 and 14 (vehicle-to-vehicle communications) and the roadside units 18 (roadside-to-vehicle communications). Moreover, the wireless communications system 24 can be configured to periodically broadcast a signal in the broadcast area. The wireless communication system 24 can be any suitable type of two-way communication device that is capable of communicating with the remote vehicles 14 and the two-way wireless communications network. In this example, the wireless communication system 24 can include or be coupled to a dedicated short range communications (DSRC) antenna to receive, for example, 5.9 GHz DSRC signals from the two-way wireless communications network. These DSRC signals can include basic safety messages (BSM) defined by current industry recognized standards that include information which, under certain circumstances, can be analyzed to warn drivers of a potential problem situation or threat in time for the driver of the host vehicle 10 to take appropriate action to avoid the situation. For instance, the DSRC signals can also include information pertaining to weather conditions, adverse driving conditions and so on. In the disclosed embodiments, a BSM includes information in accordance with SAE Standard J2735 as can be appreciated by one skilled in the art. Also, the wireless communication system 24 and the GPS 26 can be configured as a dual frequency DSRC and GPS devices as understood in the art.

The GPS 26 can be a conventional global positioning system that is configured and arranged to receive global positioning information of the host vehicle 10 in a conventional manner. Basically, the global positioning system 26 receives GPS signals from the global positioning satellite 16 at regular intervals (e.g. one second) to detect the present position of the host vehicle 10. The GPS 26 has an accuracy in accordance with industry standards and thus, can indicate the actual vehicle position of the host vehicle 10 within a few meters or less (e.g., 10 meters less). The data representing the present position of the host vehicle 10 is provided to the controller 22 for processing as discussed herein. For example, the controller 22 can include or be coupled to navigation system components that are configured and arranged to process the GPS information in a conventional manner as understood in the art.

The storage device 28 can store the remote vehicle information as discussed above. The storage device 28 can also store road map data, as well as other data that can be associated with the road map data such as various landmark data, fueling station locations, restaurants, weather data, traffic information and so on. Furthermore, the storage device 28 can store other types of data, such as data pertaining to vehicle-related parameters and vehicle conditions. For example, the vehicle-related parameters can include predetermined data indicating relationships between vehicle speed, vehicle acceleration, yaw, steering angle, etc. when a vehicle is preparing to make a turn. In this event, the storage device 28 can further store data pertaining to vehicle conditions, which can represent a determined vehicle condition of a vehicle of interest, such as the host vehicle 10, a remote vehicle 14, or both. This determined vehicle condition can represent, for example, a vehicle speed and acceleration that is determined for the vehicle of interest at a moment in time. Accordingly, the embodiments disclosed herein can evaluate whether the vehicle condition lies within the area of interest, as represented by the vehicle-related parameters, to determine, for example, whether the vehicle of interest is preparing to make a turn. The storage device 28 can include, for example, a large-capacity storage medium such as a CD-ROM (Compact Disk-Read Only Memory) or IC (Integrated Circuit) card. The storage device 28 permits a read-out operation of reading out data held in the large-capacity storage medium in response to an instruction from the controller 22 to, for example, acquire the map information and/or the vehicle condition information as needed or desired for use in representing the location of the host vehicle 10, the remote vehicle 14 and other location information and/or vehicle condition information as discussed herein for route guiding, map display, turning indication, and so on as understood in the art. For instance, the map information can include at least road links indicating connecting states of nodes, locations of branch points (road nodes), names of roads branching from the branch points, place names of the branch destinations, and so on. The information in the storage device 28 can also be updated by the controller 22 or in any suitable manner as discussed herein and as understood in the art.

The in-vehicle sensors 30 are configured to monitor various devices, mechanisms and systems within the host vehicle 10 and provide information relating to the status of those devices, mechanisms and systems to the controller 22. For example, the in-vehicle sensors 30 can be connected to a traction control system, a windshield wiper motor or wiper motor controller, a headlight controller, a steering system, a speedometer, a braking system and so on as understood in the art.

Examples of operations performed by the traffic circle identification system 12 will now be discussed with reference to FIGS. 3 to 43. As can be appreciated from the following description, because the host vehicle 10 and the remote vehicles 14 are equipped with vehicle to vehicle communication technology as discussed above, the host vehicle 10 can use the remote vehicle information received from other similarly equipped remote vehicles 14 to determine the presence and size of a traffic circle without need for map data, which can provide a significant cost savings. Also, in view of pending NHTSA regulations that would require vehicle to vehicle communication technology in new vehicles in the future, the traffic circle identification system 12 according to the disclosed embodiments can significantly enhance the functionality of crash warning systems that leverage information received via vehicle to vehicle communication from other vehicles to either suppress warnings that are not necessary, or issue warnings under circumstances that other sensor-based systems could not detect. For instance, by using GPS position and heading information received from remote vehicles 14, the traffic circle identification system 12 according to the disclosed embodiments provides an accurate identification of the presence and size of an approaching traffic circle. This information can be used to suppress unnecessary warnings that could otherwise be a nuisance. The traffic circle identification system 12 also provides a very rapid detection of wrong-way driving of a remote vehicle 14, as well as the host vehicle 10, that may be travelling in the wrong direction around the traffic circle.

Figure 3:
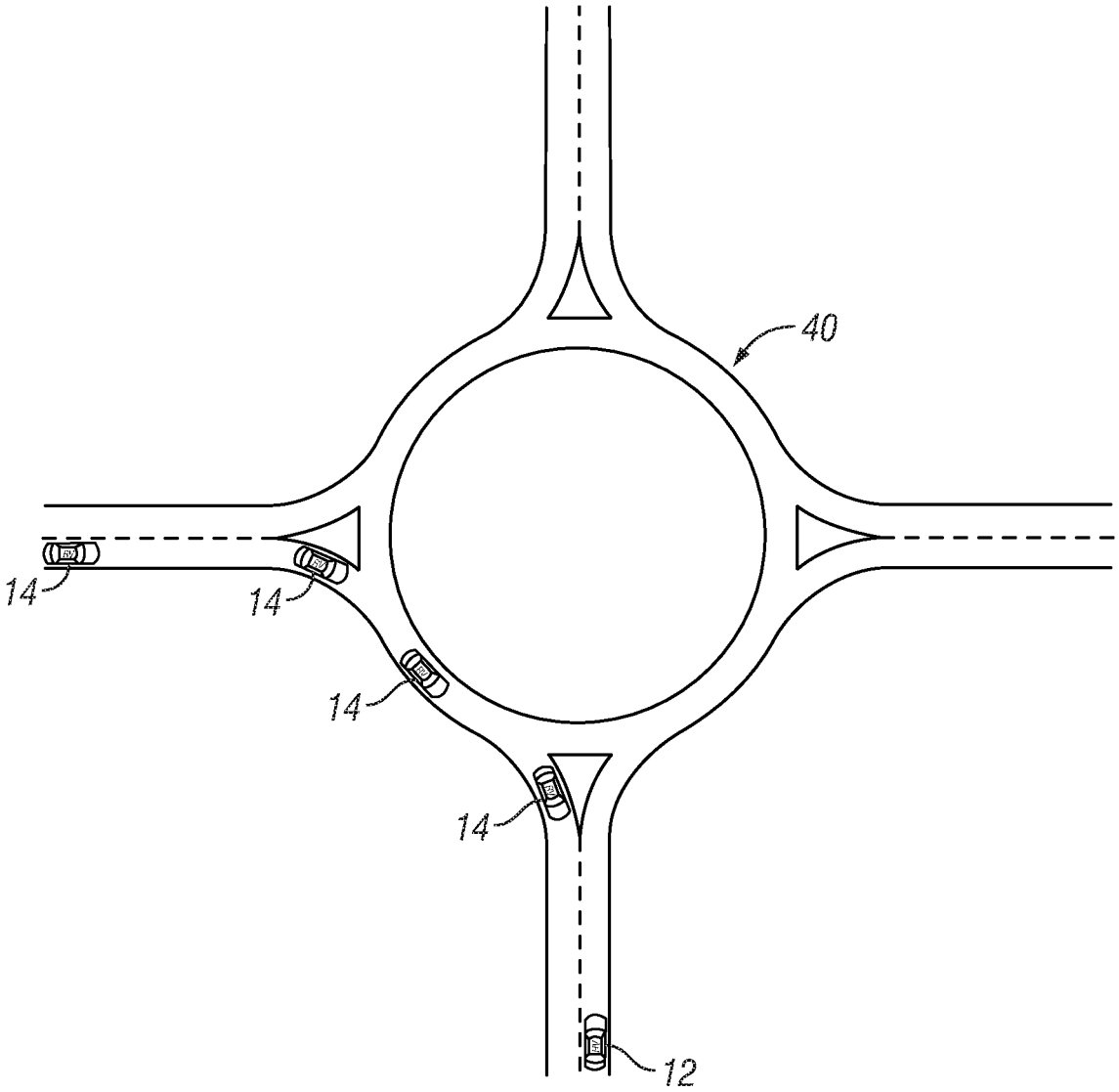
FIG. 3 is a diagrammatic view illustrating an example of a condition in which a remote vehicle is approaching a traffic circle from the left of the host vehicle and makes a right turn.
Figure 4:
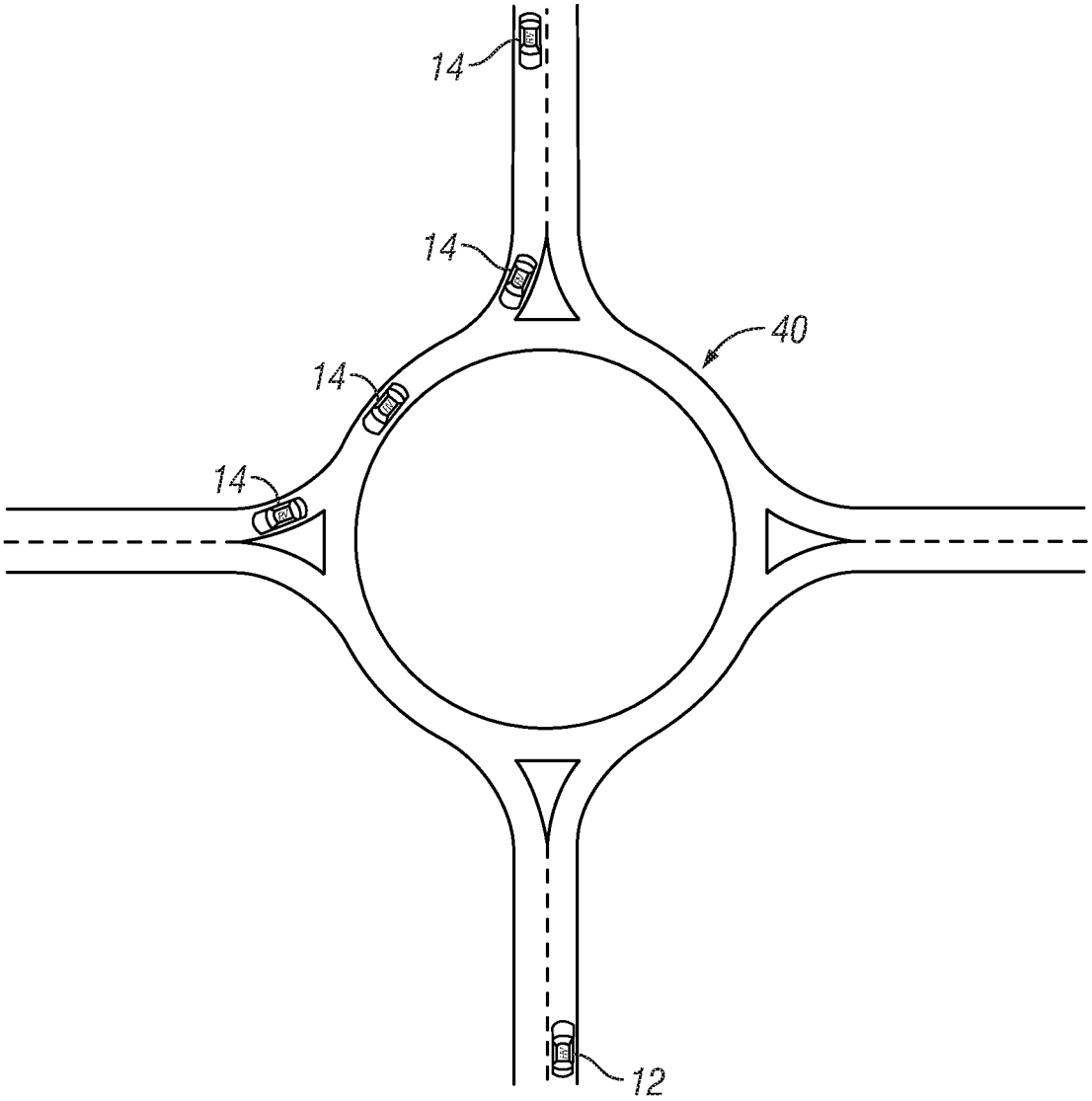
FIG. 4 is a diagrammatic view illustrating an example of a condition in which a remote vehicle is approaching the traffic circle from the opposite direction of the host vehicle and is making a right turn.
Figure 5:
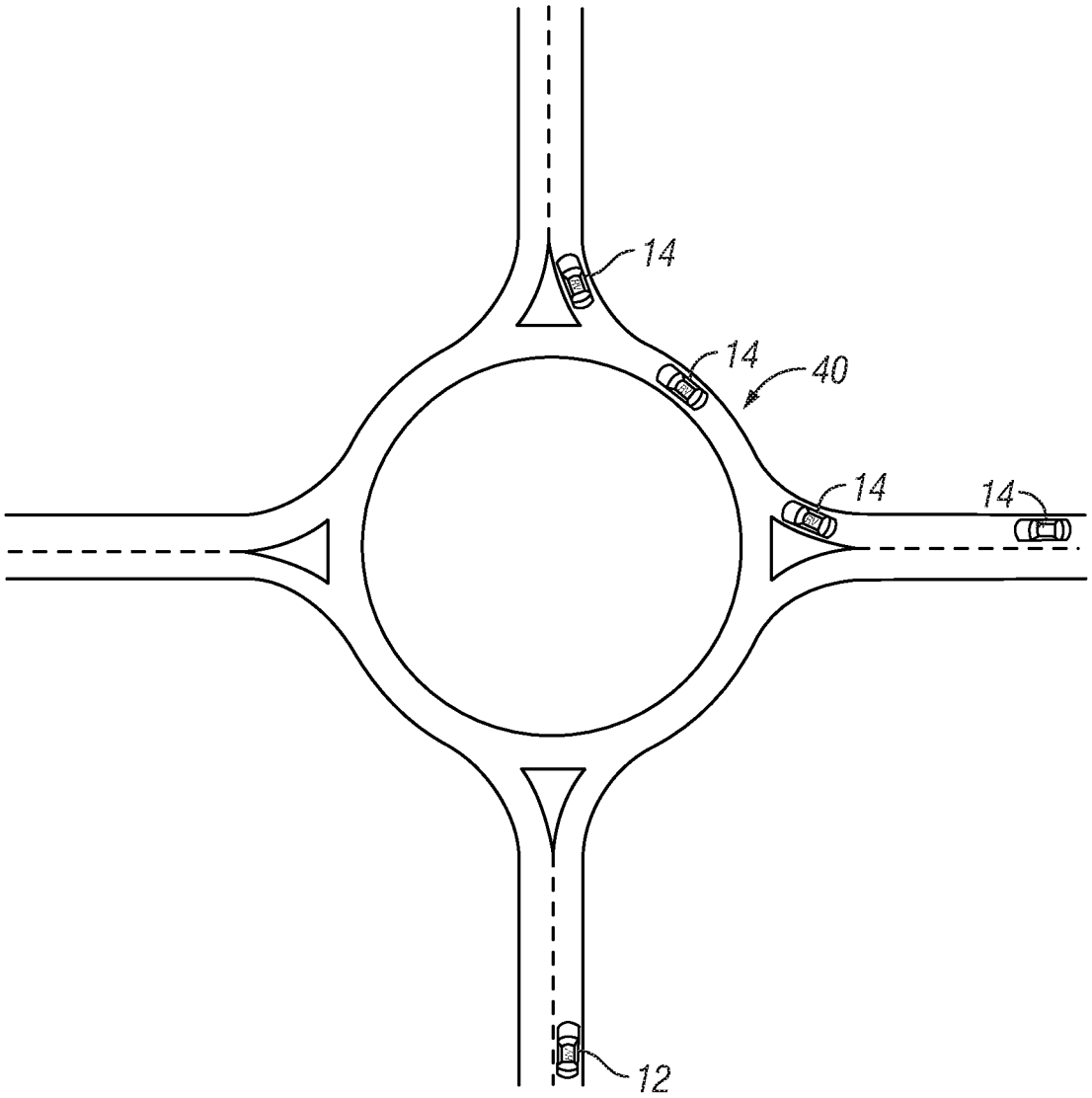
FIG. 5 is a diagrammatic view illustrating a condition in which a remote vehicle is approaching the traffic circle from the right of the host vehicle and is making a right turn.

FIG. 3 illustrates a condition in which a remote vehicle 14 is approaching a traffic circle 40 from the left of the host vehicle 10 and makes a right turn. FIG. 4 illustrates a condition in which a remote vehicle 14 is approaching the traffic circle 40 from the opposite direction of the host vehicle 10 and is making a right turn. FIG. 5 illustrates a condition in which a remote vehicle 14 is approaching the traffic circle 40 from the right of the host vehicle 10 and is making a right turn. In these situations, it is possible that the traffic circle identification system 12 may be unable to collect sufficient information simply from a single remote vehicle 14 to determine the existence and geometry of the traffic circle 40, especially if the driver of the remote vehicle 14 does not signal their intention to make a right turn. The remote vehicle 14 travels 90 degrees around the traffic circle and this path may not allow the traffic circle identification system 12 to confirm the traffic circle exists.

Figure 6:
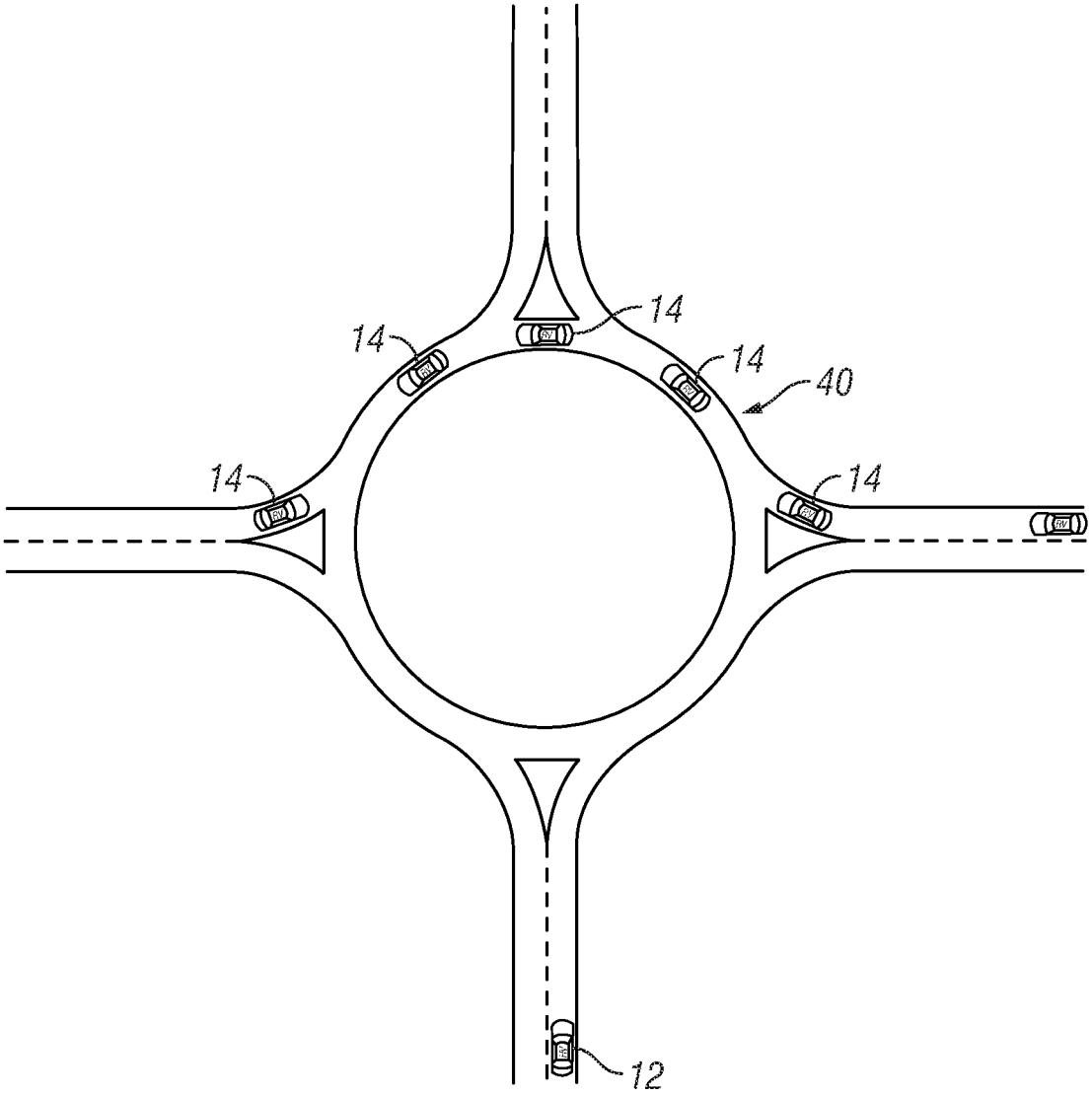
FIG. 6 is a diagrammatic view illustrating a condition in which a remote vehicle is approaching the traffic circle from the right of the host vehicle and passes through the traffic circle.
Figure 7:
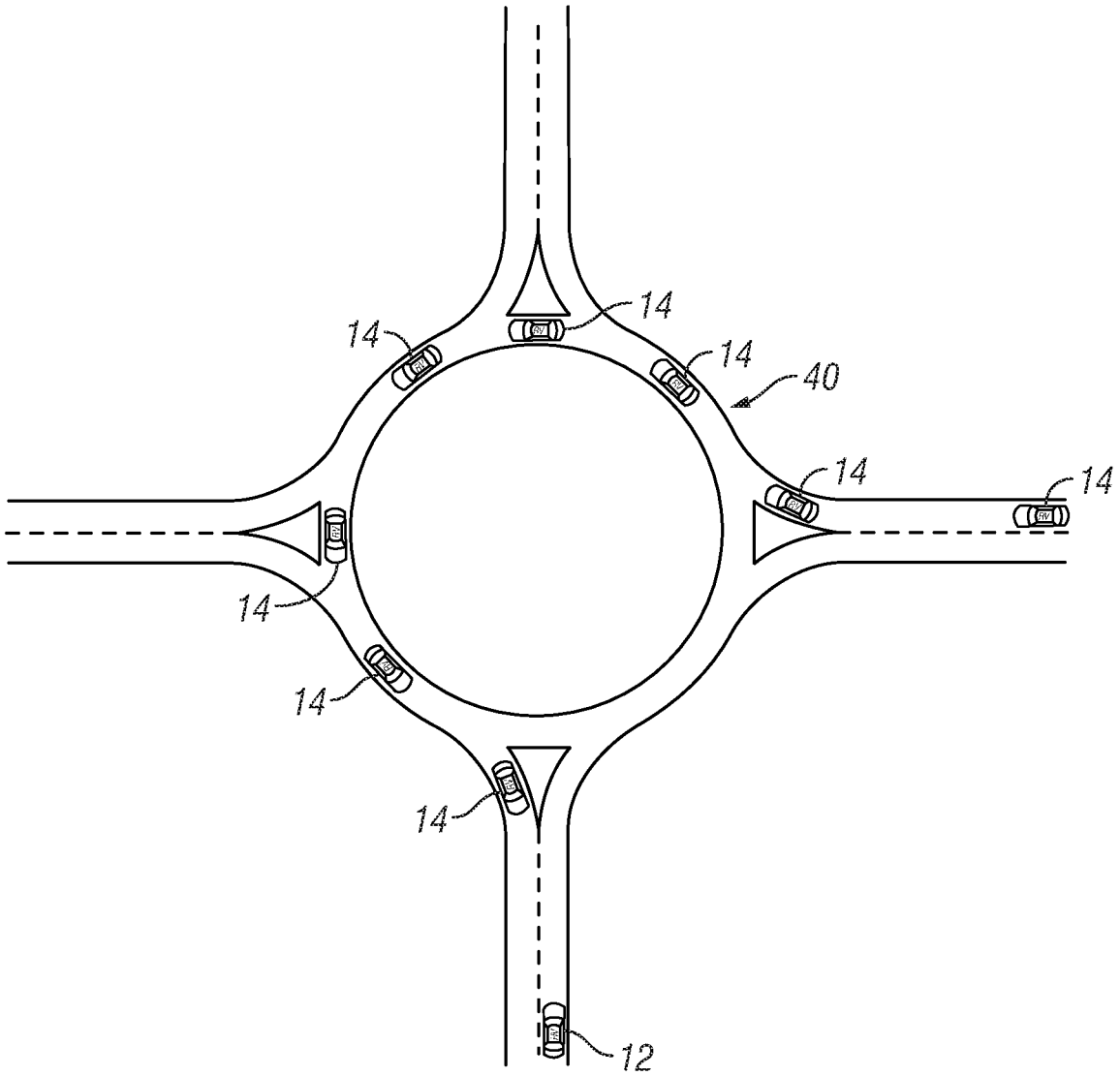
FIG. 7 is a diagrammatic view illustrating a condition in which a remote vehicle is approaching the traffic circle from the right of the host vehicle and turns left within the traffic circle.

However, when a single remote vehicle 14 either passes through the traffic circle 40 or makes a left turn as shown, for example, in FIGS. 6 and 7, the traffic circle identification system 12 onboard the host vehicle 10 can collect data sufficient to determine that the traffic circle 40 exits, and also the diameter of the traffic circle 40. FIG. 6 illustrates a condition in which a remote vehicle 14 is approaching the traffic circle 40 from the right of the host vehicle 10 and passes through the traffic circle 40. That is, the remote vehicle 14 travels 180 degrees around the traffic circle 40 and this path will allow the traffic circle identification system 12 to confirm the traffic circle exists. Thus, any remote vehicle path larger than 90 degrees around the traffic circle will allow the traffic circle identification system 12 to confirm the traffic circle exists. FIG. 7 illustrates a condition in which a remote vehicle 14 is approaching the traffic circle 40 from the right of the host vehicle 10 and turns left within the traffic circle 40. That is, the remote vehicle goes 270 degrees around the traffic circle 40.

Figure 8:
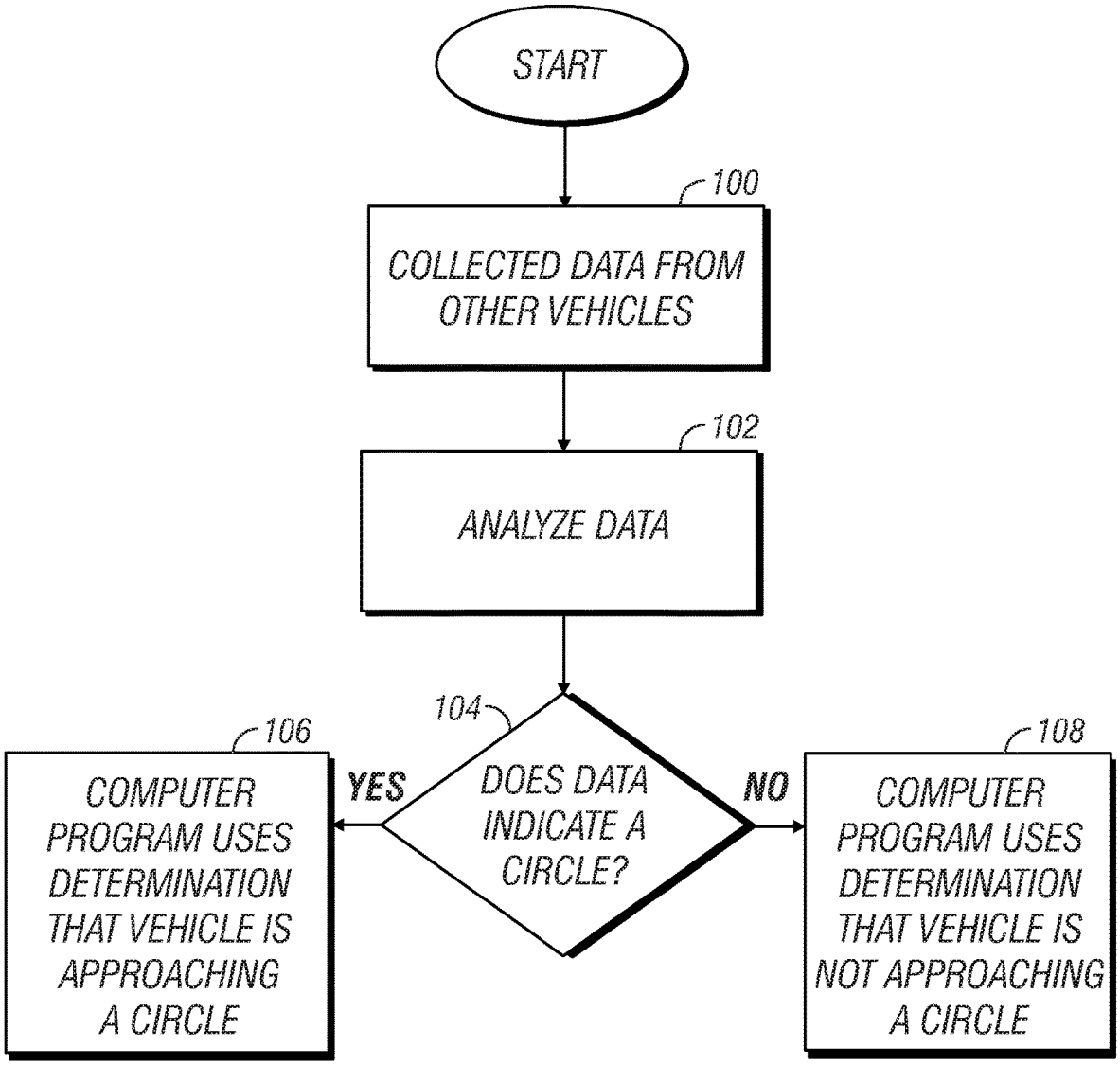
FIG. 8 is a flowchart illustrating an example of operations performed by the traffic circle identification system to identify the existence and diameter of the traffic circle according to disclosed embodiments.

FIG. 8 is a flowchart illustrating an example of operations performed by the traffic circle identification system 12 to identify the existence and diameter of the traffic circle 40. In Step 100, the traffic circle identification system 12 receives remote vehicle information from at least one remote vehicle 14. As discussed above, the remote vehicle information can include, for example, information representing the location (e.g., GPS location), speed, acceleration and heading of the remote vehicle 14 at each of a plurality of locations of the remote vehicle 14, information representing a respective turning radius of the remote vehicle 14 at each of the plurality of locations of the remote vehicle 14, turn signal activation at the remote vehicle 14 at each of the plurality of locations, and any other type of information suitable for representing a travel path of the remote vehicle 14. As also discussed above, the host vehicle 10 can exchange host vehicle information with the remote vehicle 14. This host vehicle information can include, for example, information representing the location (e.g., GPS location), speed, acceleration and heading of the host vehicle 10 at each of a plurality of locations of the host vehicle 10, information representing a respective turning radius of the host vehicle 10 at each of the plurality of locations of the host vehicle 10, turn signal activation at the host vehicle 10 at each of the plurality of locations, and any other type of information suitable for representing a travel path of the host vehicle 10. The host vehicle 10 and the remote vehicles 14 can exchange this type of host vehicle information and remote vehicle information with each other several times per second, or at any suitable time intervals.

In Step 102, the traffic circle identification system 12 can analyze the remote vehicle information to determine whether the circle 40 exists, and the diameter of the circle 40, without using or relying upon map data. For example, the traffic circle identification system 12 onboard the host vehicle 10 stores GPS position heading and speed information in the remote vehicle information received from the remote vehicle 14 at time "a" and at time "b," that is, at two time intervals represented as "a" and "b." Furthermore, as discussed herein, storing of the remote vehicle information can be used by the traffic circle identification system 12 to constantly adjust the calculated radius of the traffic circle 40. If such additional remote vehicle information is stored, the previous data becomes data collected for time "a" and the subsequent data collected becomes data for time "b." The software being run by the controller 22 can include, for example, a software application onboard the host vehicle 12 to use this remote vehicle information to calculate the radius of curvature for the path of the remote vehicle 14 according to the following exemplary process.

It is assumed that the remote vehicle 14, represented by "RV" in the following equations and tables, travels around the traffic circle 40 of constant radius, R. The host vehicle 10, represented by "HV" in the following equations and tables, receives the remote vehicle information messages from the remote vehicle 14. The remote vehicle information transmitted by the remote vehicle 14 contains the heading angle, $\delta_{RV}$ of the remote vehicle 14 and have values as defined in Table 1 below.

TABLE 1

| Range of values for $\delta_{RVi}$ |
|---|
| $\delta_{RV}$ |
| $0 \le \delta_{RVi} < \pi/2$ |
| $\pi/2 \le \delta_{RVi} < \pi$ |
| $\pi \le \delta_{RVi} < 3\pi/2$ |
| $3\pi/2 \le \delta_{RVi} < 2\pi$ |

Based on these definitions, a total of 16 possible heading angle combinations for the remote vehicle 14 are defined and illustrated below in FIGS. 9 through 24 for a counter-clockwise turn, and FIGS. 25 through 40 for a clockwise turn, and illustrate how expressions for angles $\alpha_1$ and $\alpha_2$ are developed.

Figure 9:
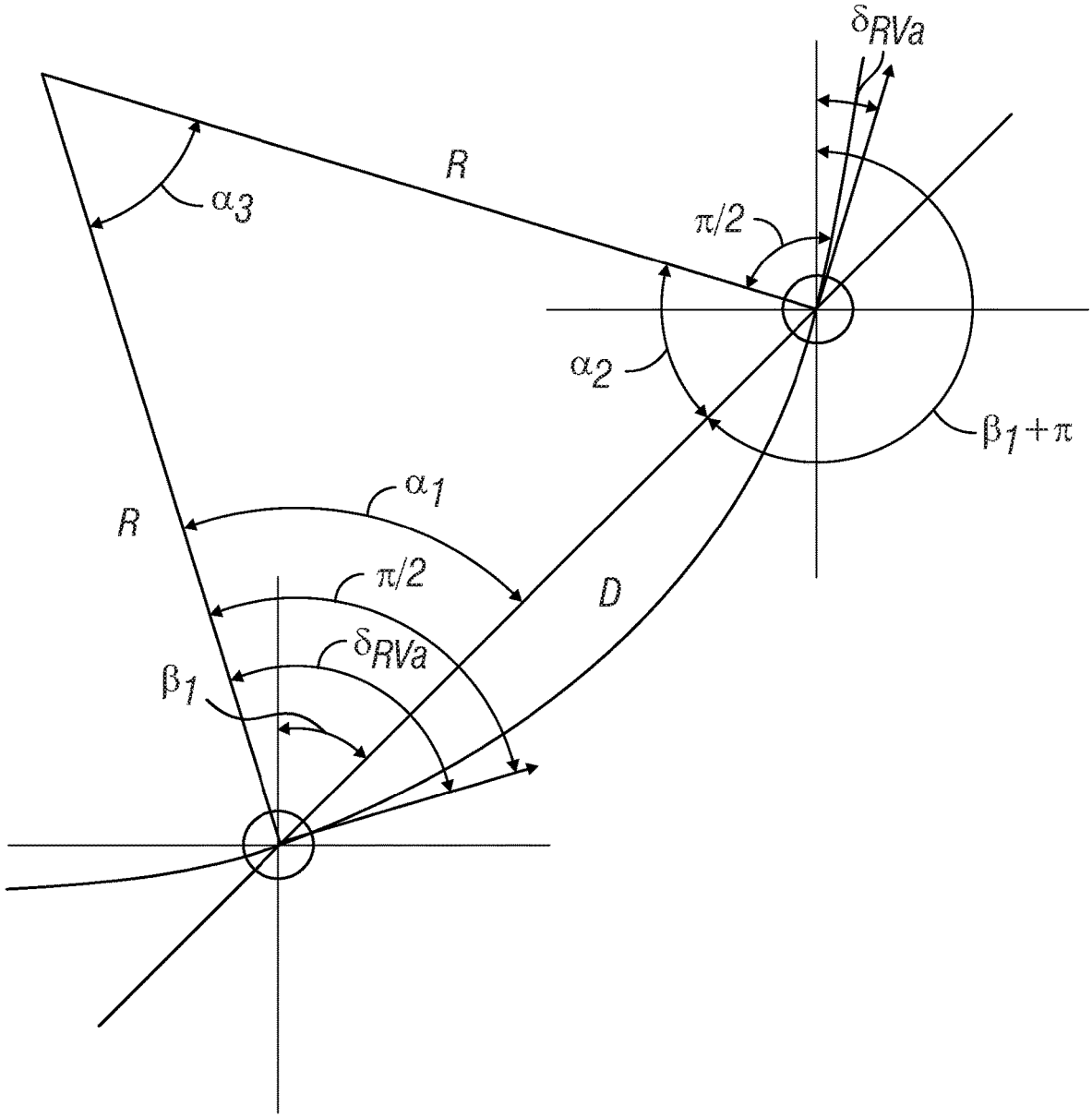
FIGS. 9-40 are graphical representations of a location of the host vehicle with respect to a remote vehicle as used in calculations performed by the traffic circle identification system during the operation of the flowchart of FIG. 8.

With reference to FIG. 9, for a counter-clockwise turn, the initial conditions are:

$$0 \le \delta_{RVa} < \pi/2$$

$$0 \le \delta_{RVb} < \pi/2$$

and the solutions are:

$$\pi/2 - \delta_{RVa} = \alpha_1 - \beta_1$$

$$\alpha_1 = \pi/2 - \delta_{RVa} + \beta_1$$

$$\beta_1 + \pi + \alpha_2 + \pi/2 - \delta_{RVb} = 2\pi$$

$$\alpha_2 = \pi/2 + \delta_{RVb} - \beta_1$$

Figure 10:
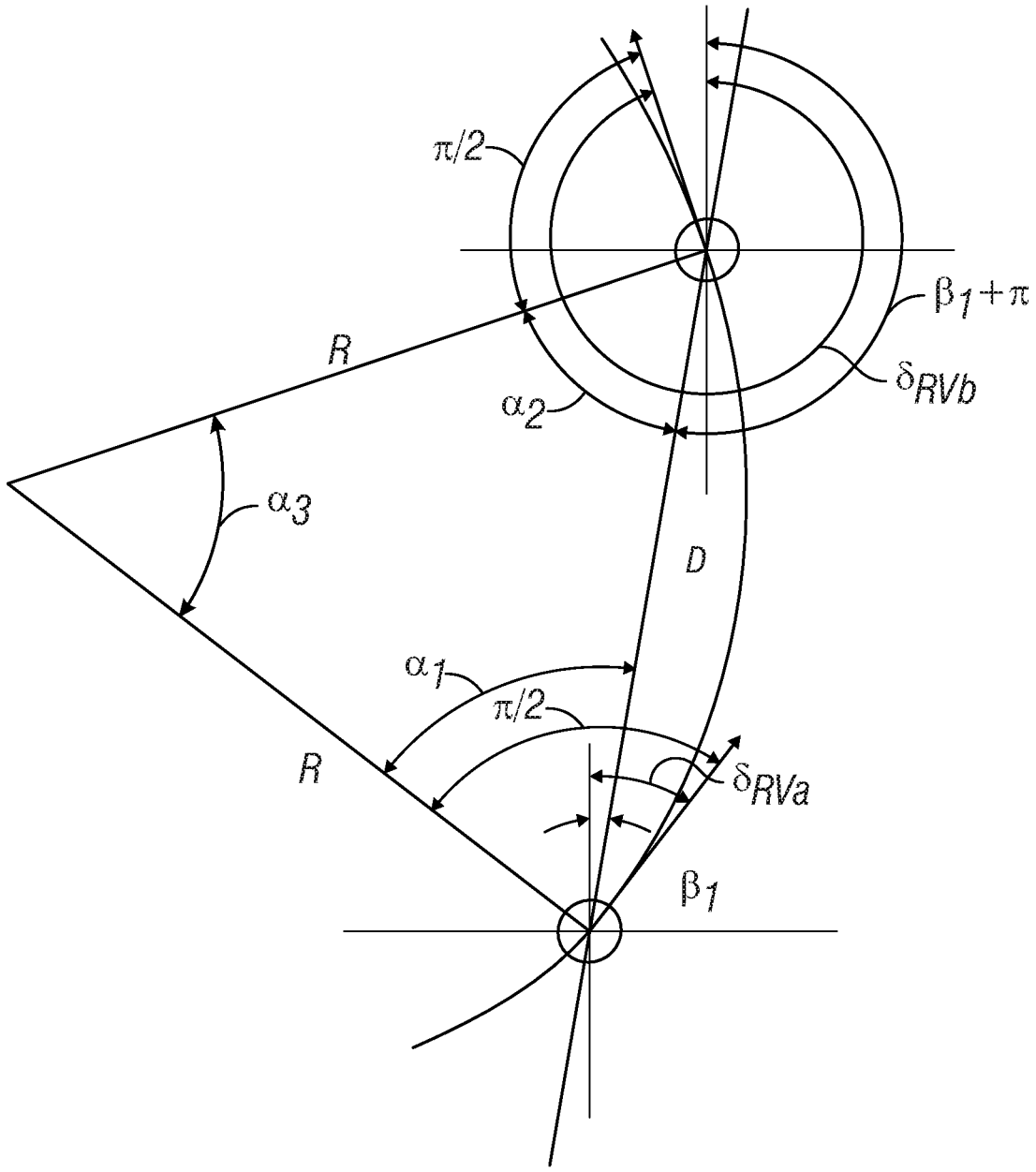

With reference to FIG. 10, for a counter-clockwise turn, the initial conditions are:

$$0 \le \delta_{RVa} < \pi/2$$

$$3\pi/2 \le \delta_{RVb} < \pi/2$$

and the solutions are:

$$\pi/2 - \delta_{RVa} = \alpha_1 - \beta_1$$

$$\alpha_1 = \pi/2 - \delta_{RVa} + \beta_1$$

$$\beta_1 + \pi +_2 + \pi/2 = \delta_{RVb}$$

$$\alpha_2 = -(3\pi/2 - \delta_{RVb} + \beta_1)$$

Figure 11:
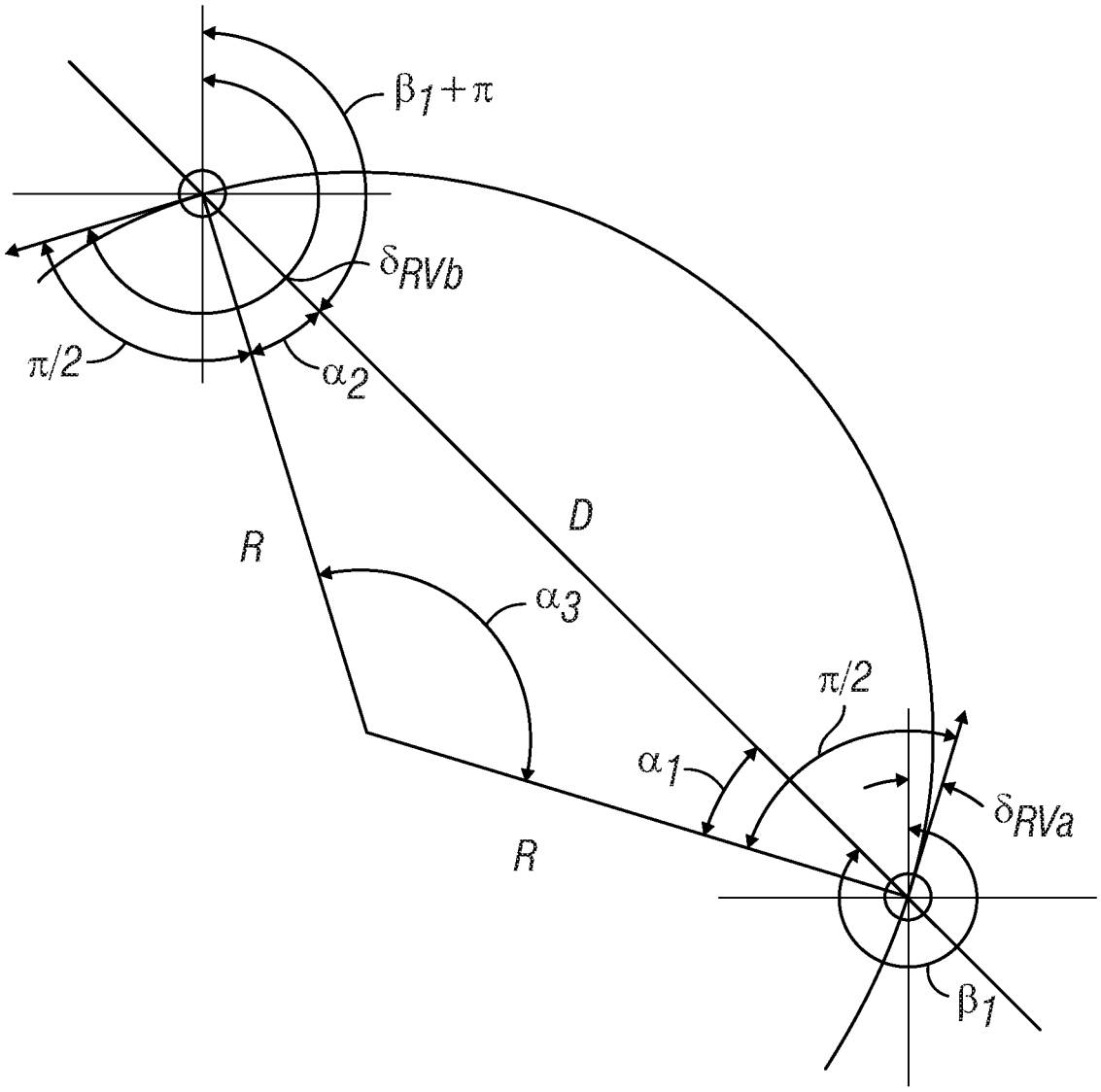

With reference to FIG. 11, for a counter-clockwise turn, the initial conditions are:

$$0 \le \delta_{RVa} = \pi/2$$

$$\pi \le \delta_{RVb} < 3\pi/2$$

and the solutions are:

$$\beta_1 - \alpha_1 + \pi/2 - \delta_{RVa} = 2\pi$$

$$\alpha_1 = -(3\pi/2 + \delta_{RVa} - \beta_1)$$

$$\beta_1 - \pi + \alpha_2 + \pi/2 = \delta_{RVb}$$

$$\alpha_2 = \pi/2 + \delta_{RVb} - \beta_1$$

Figure 12:
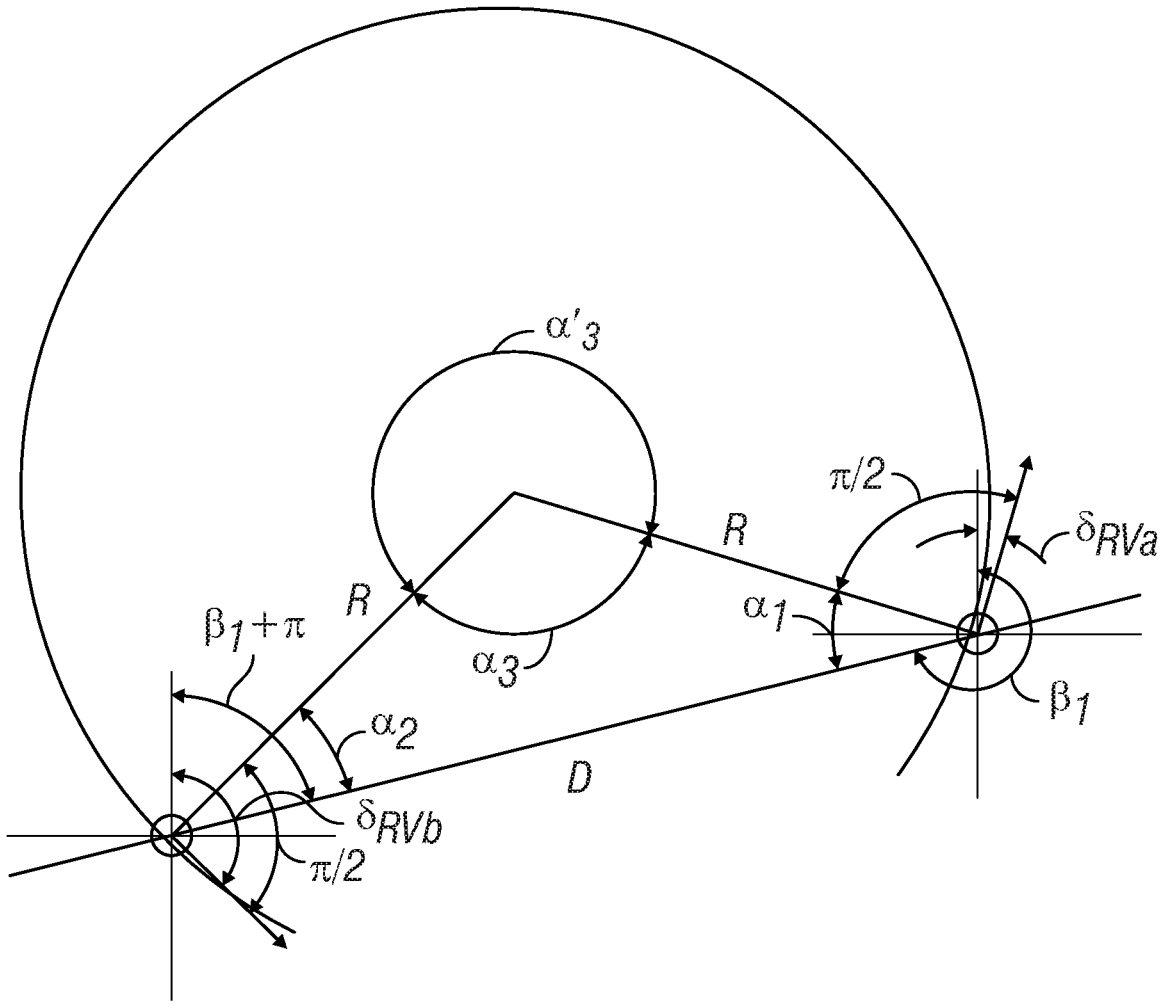

With reference to FIG. 12, for a counter-clockwise turn, the initial conditions are:

$$0 \le \delta_{RVa} = \pi/2$$

$$\pi/2 \le \delta_{RVb} < \pi$$

and the solutions are:

$$\beta_1 + \alpha_1 + \pi/2 - \delta_{RVa} = 2\pi$$

$$\alpha_1 = -3\pi/2 + \delta_{RVa} - \beta_1$$

$$\beta_1 - \pi - \alpha_2 = \delta_{RVb} - \pi/2$$

$$\alpha_2 = -(\pi/2 + \delta_{RVb} - \beta_1)$$

Figure 13:
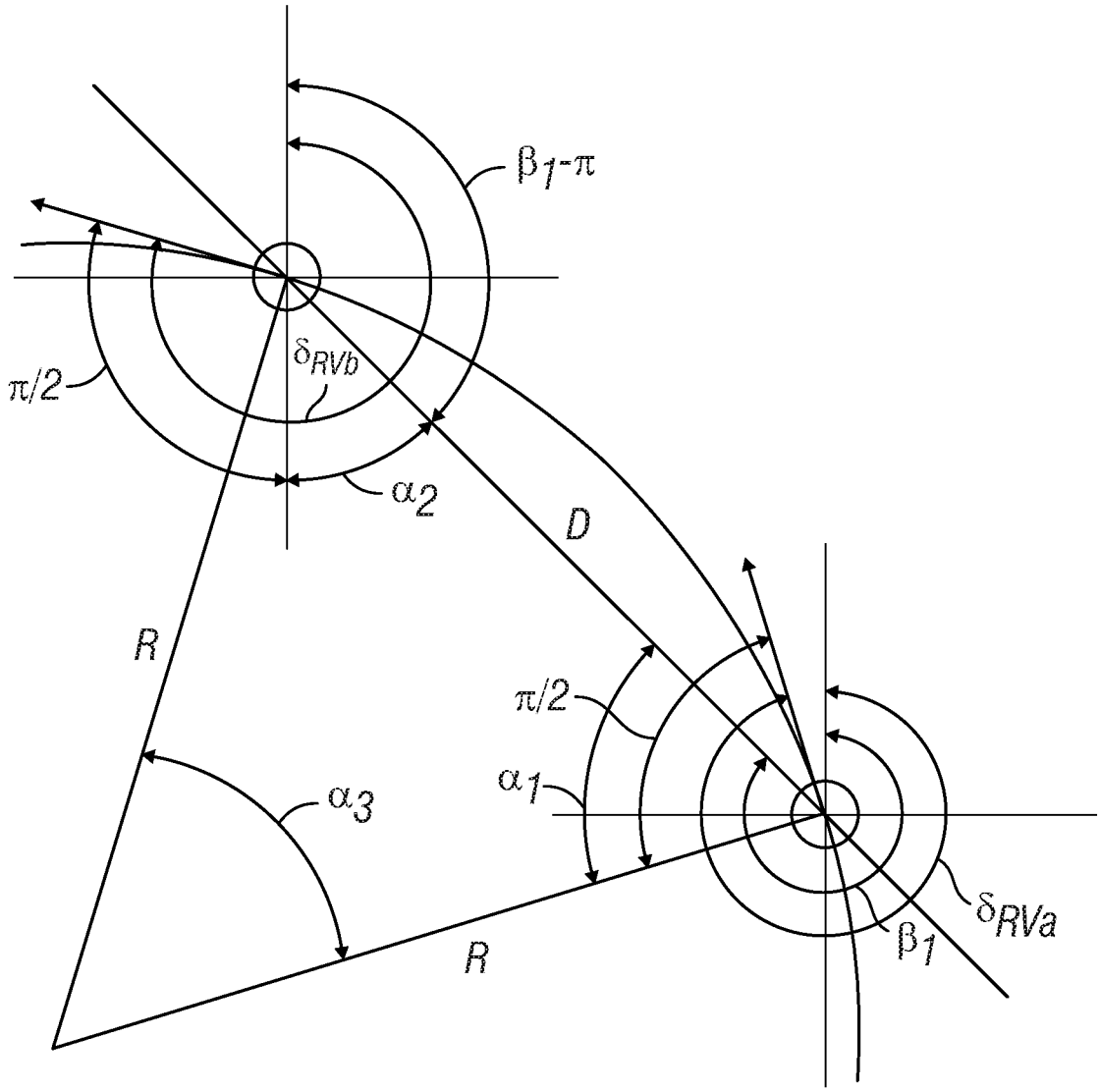

With reference to FIG. 13, for a counter-clockwise turn, the initial conditions are:

$$3\pi/2 \le \delta_{RVa} < 2\pi$$

$$3\pi/2 \le \delta_{RVb} < 2\pi$$

and the solutions are:

$$\delta_{RVa} - \beta_1 = \pi/2 - \alpha_1$$

$$\alpha_1 = \pi/2 - \delta_R + \beta_1$$

$$\beta_1 - \pi + \alpha_2 + \pi/2 = \delta_{RVb}$$

$$\alpha_2 = \pi/2 + \delta_{RVb} - \beta_1$$

Figure 14:
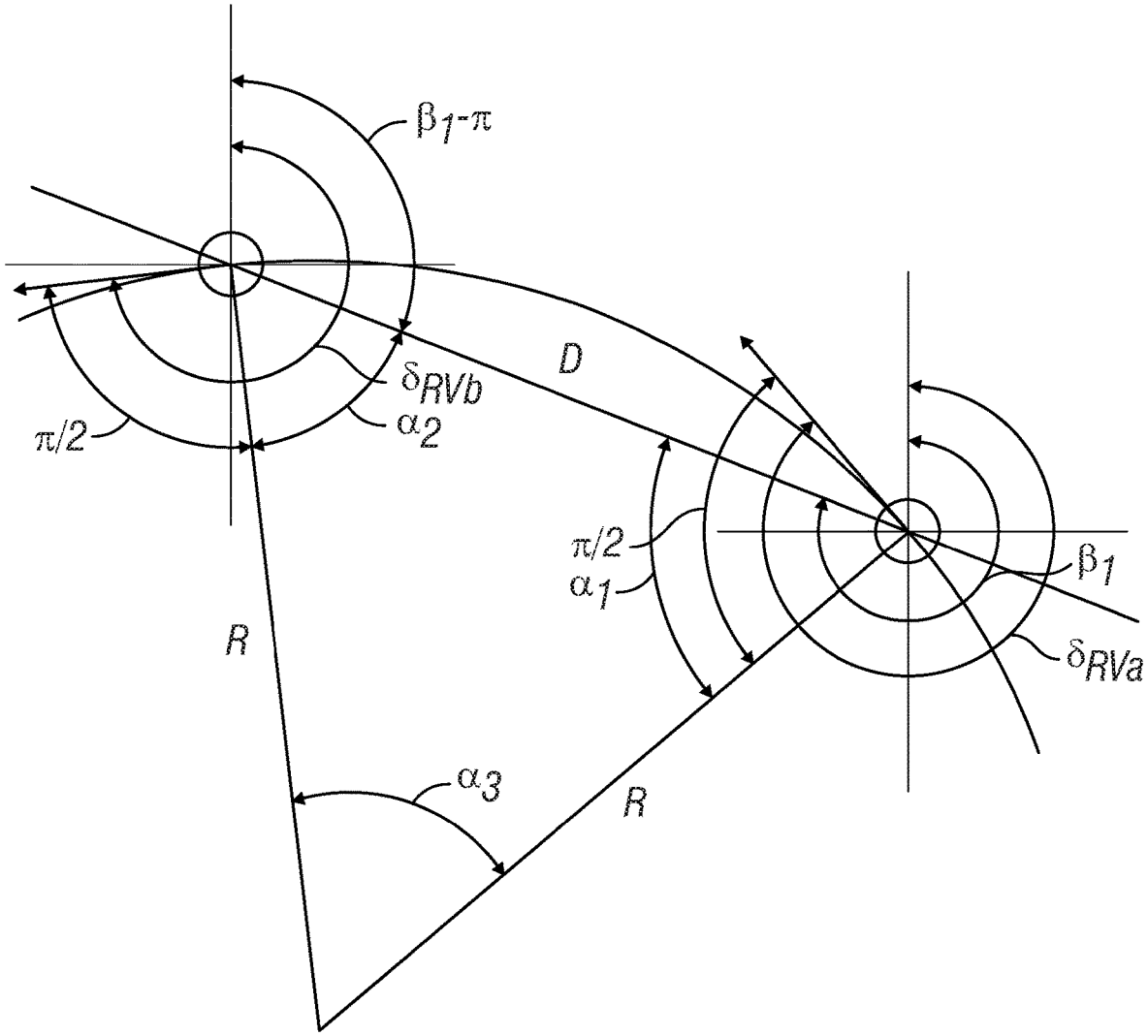
Figure 15:
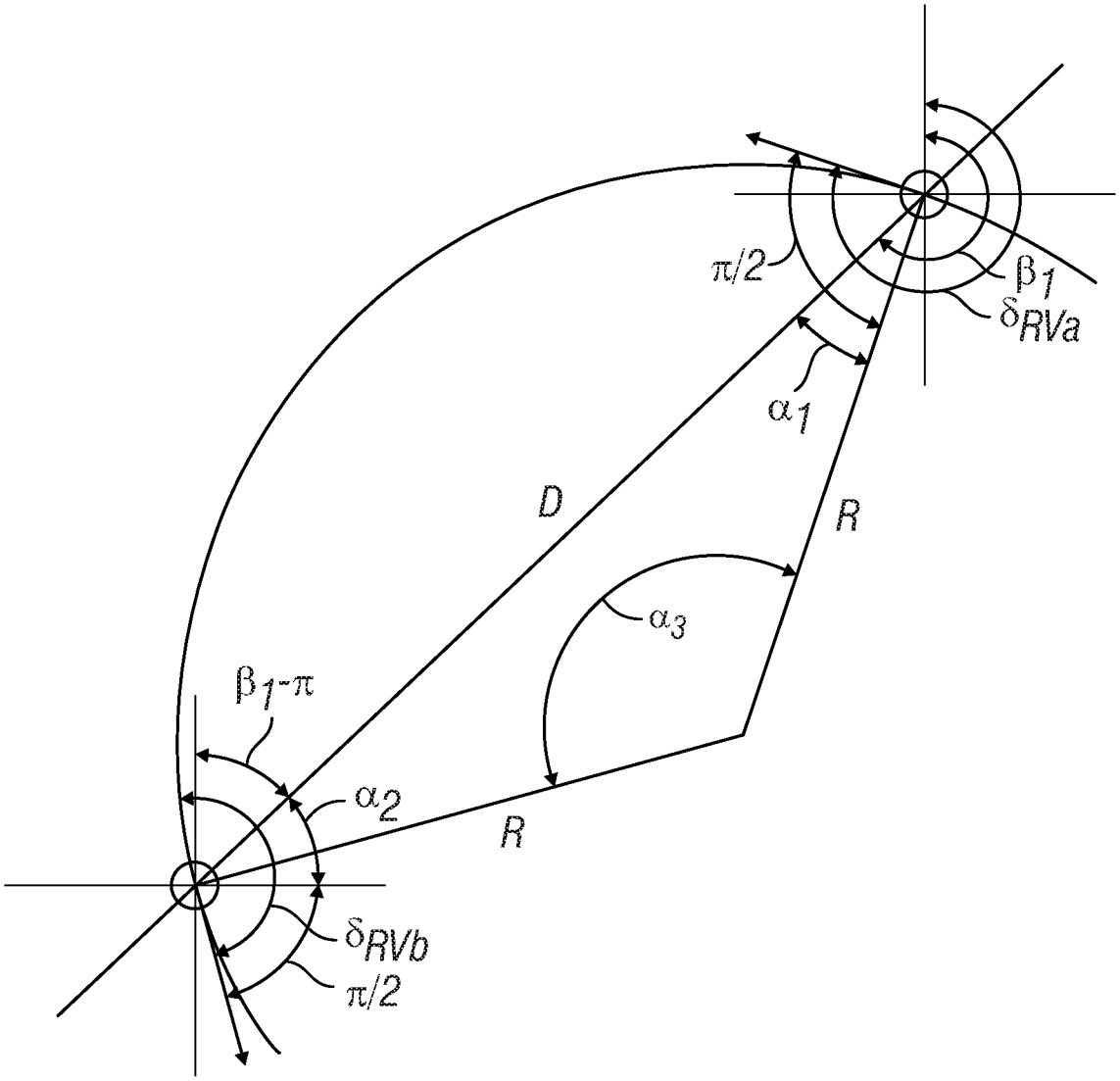
Figure 16:
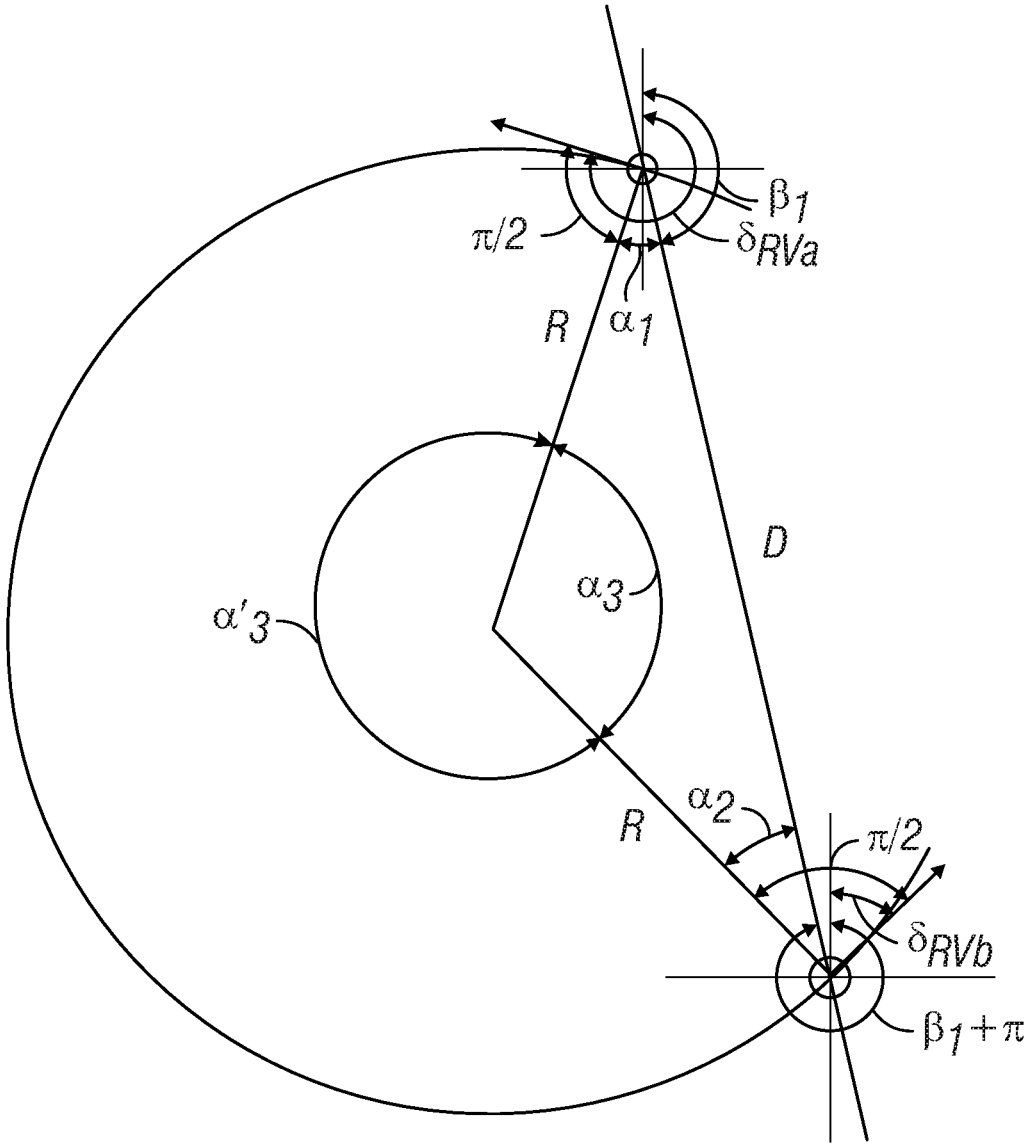
Figure 17:
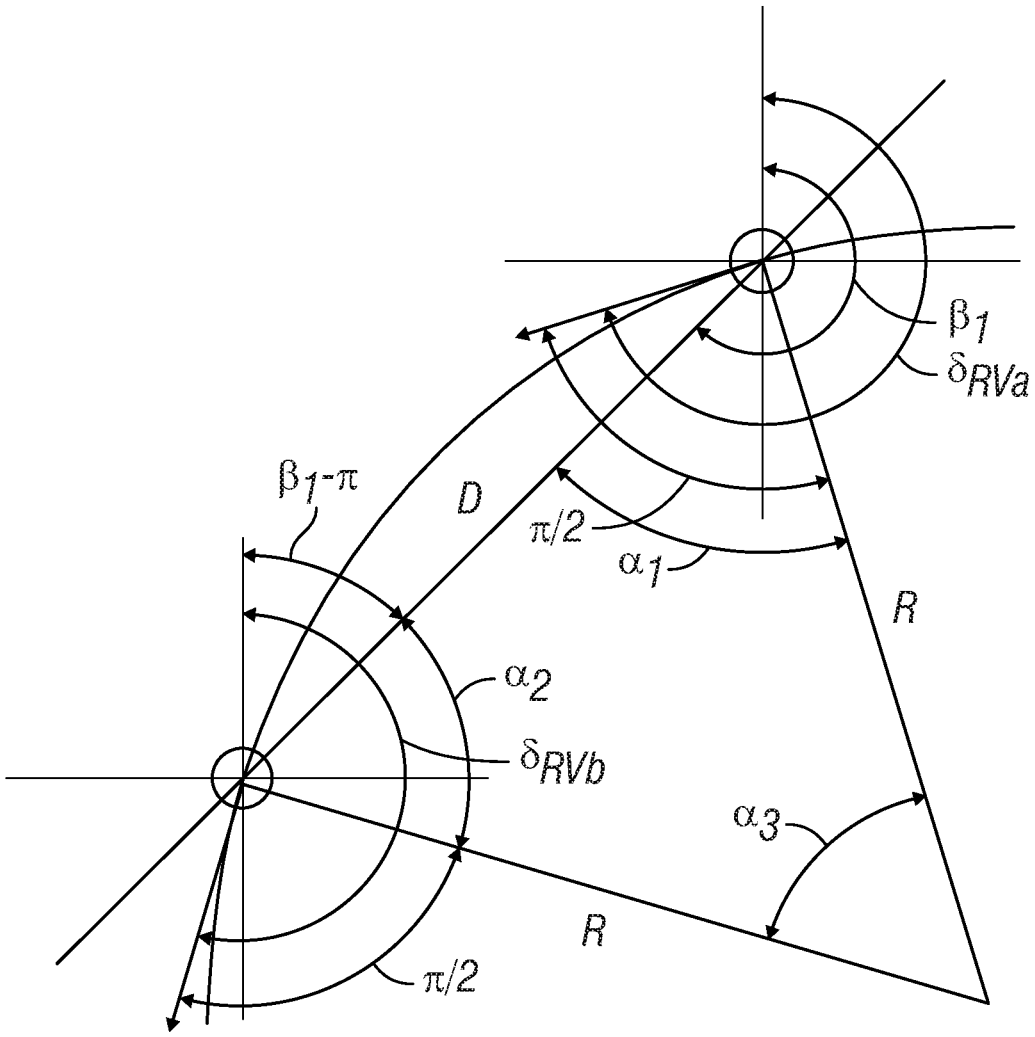
Figure 18:
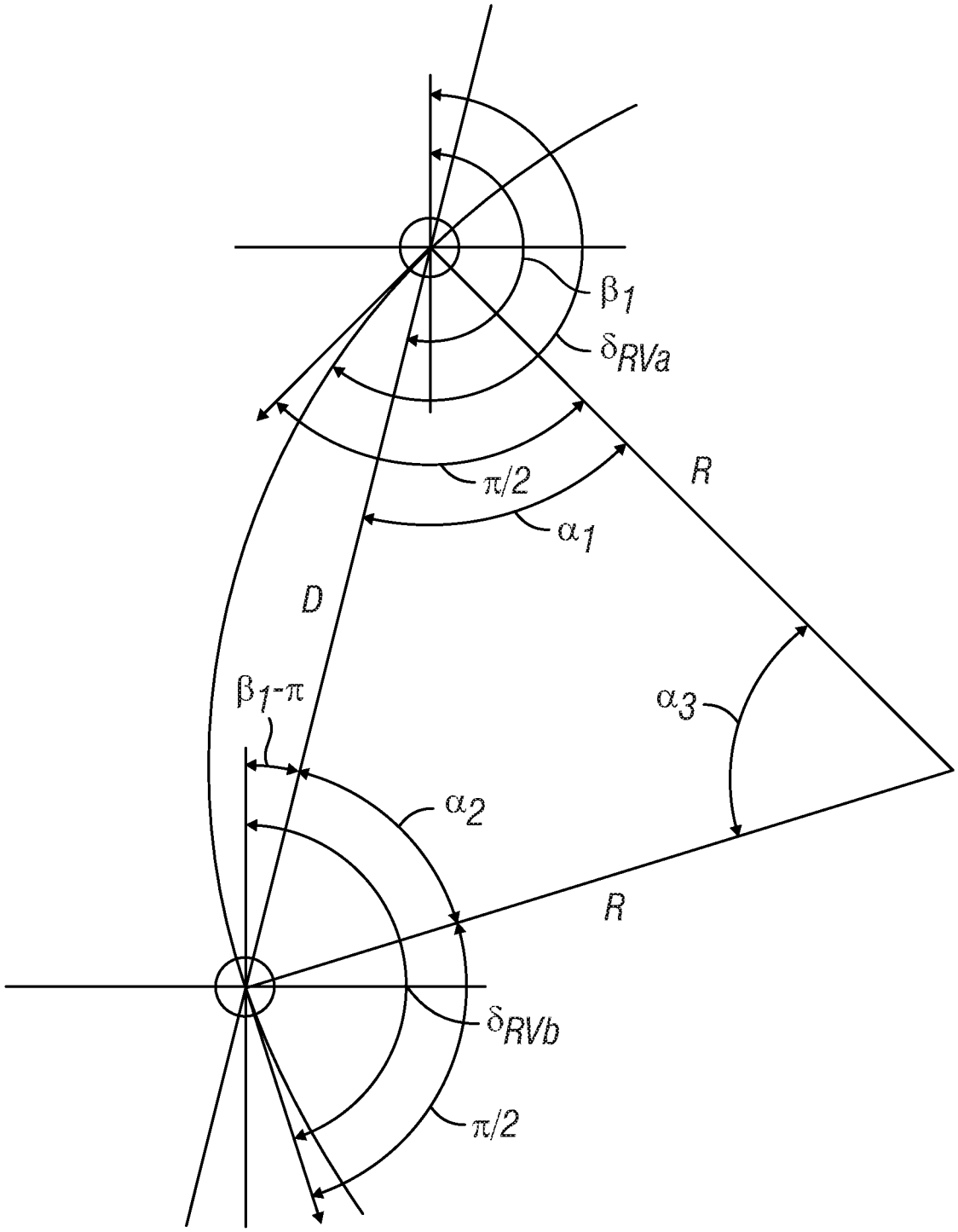
Figure 19:
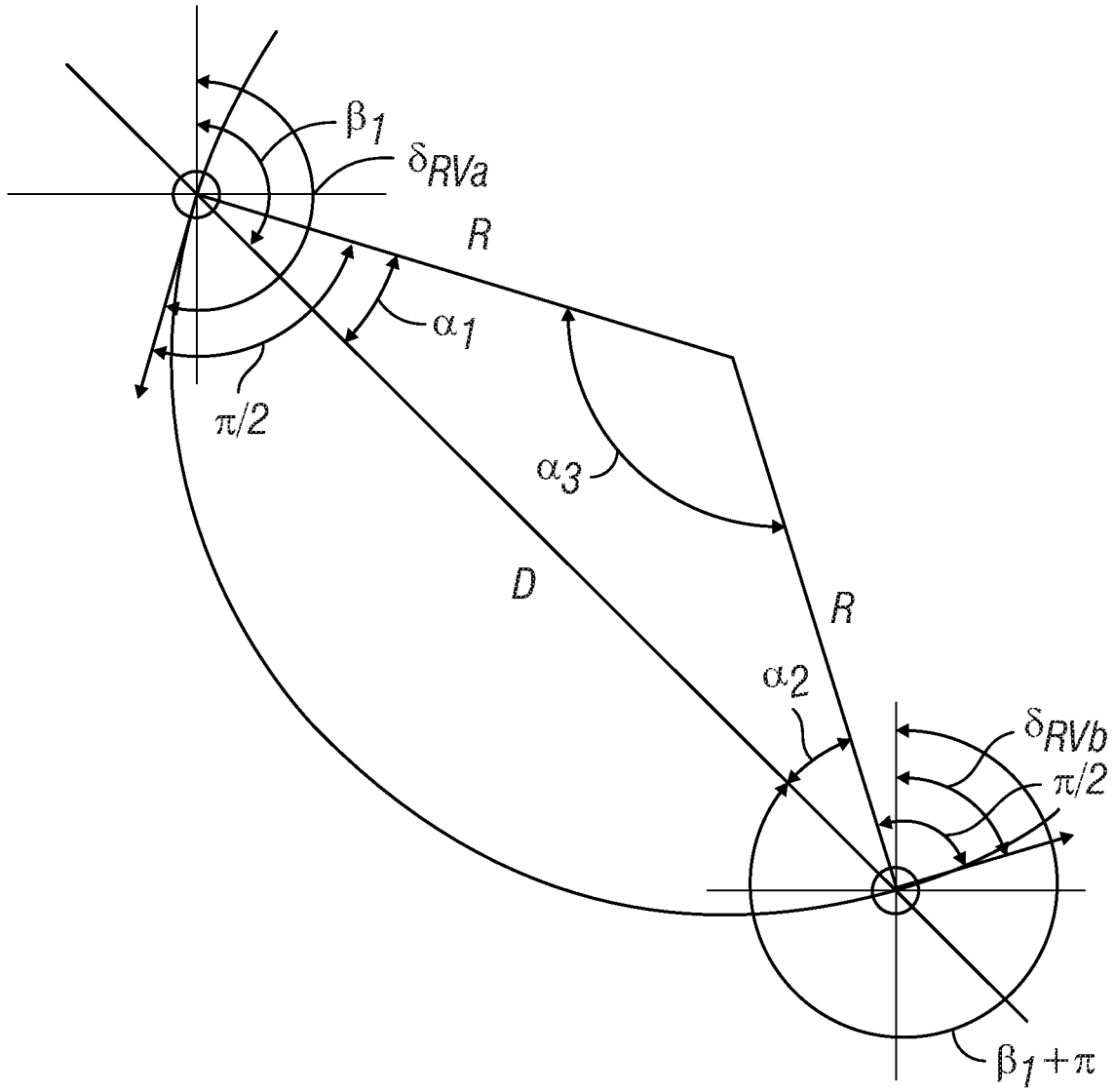
Figure 20:
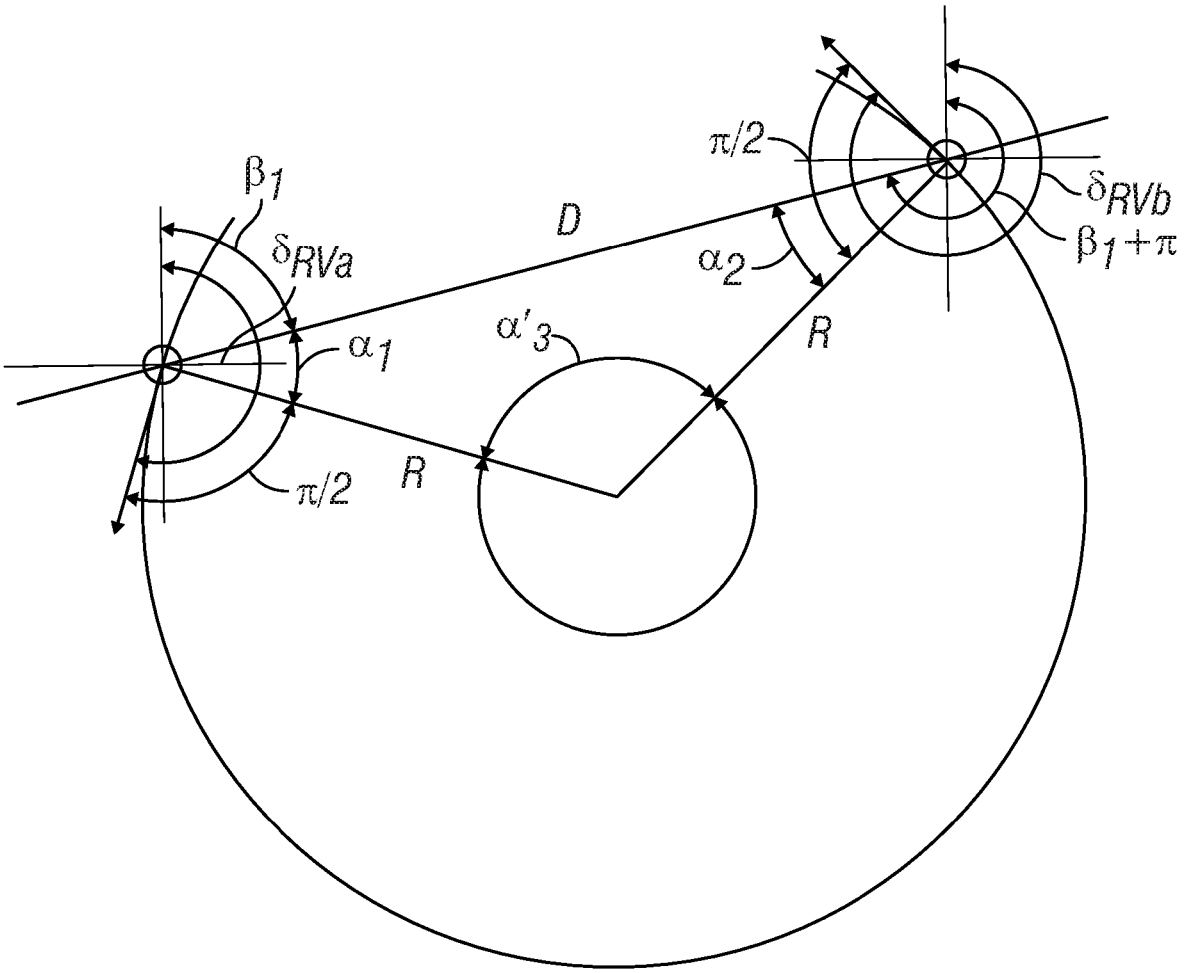
Figure 21:
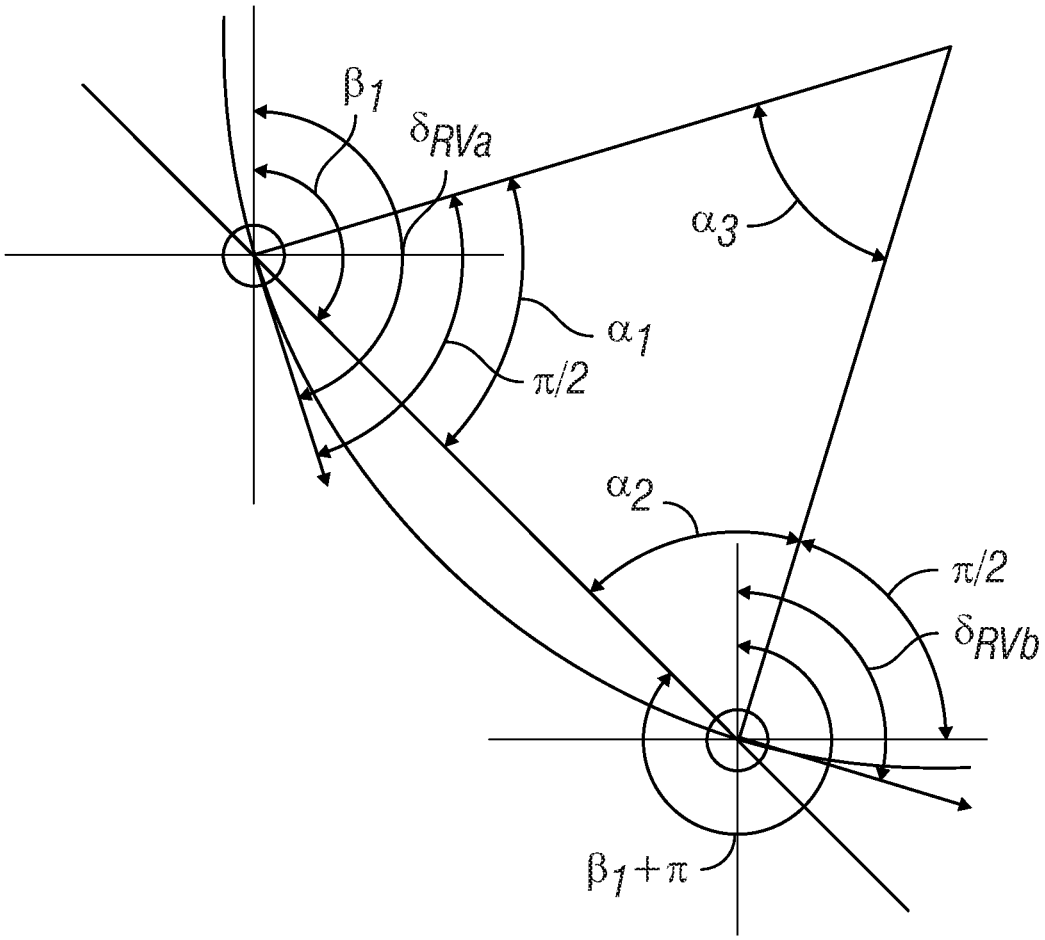
Figure 22:
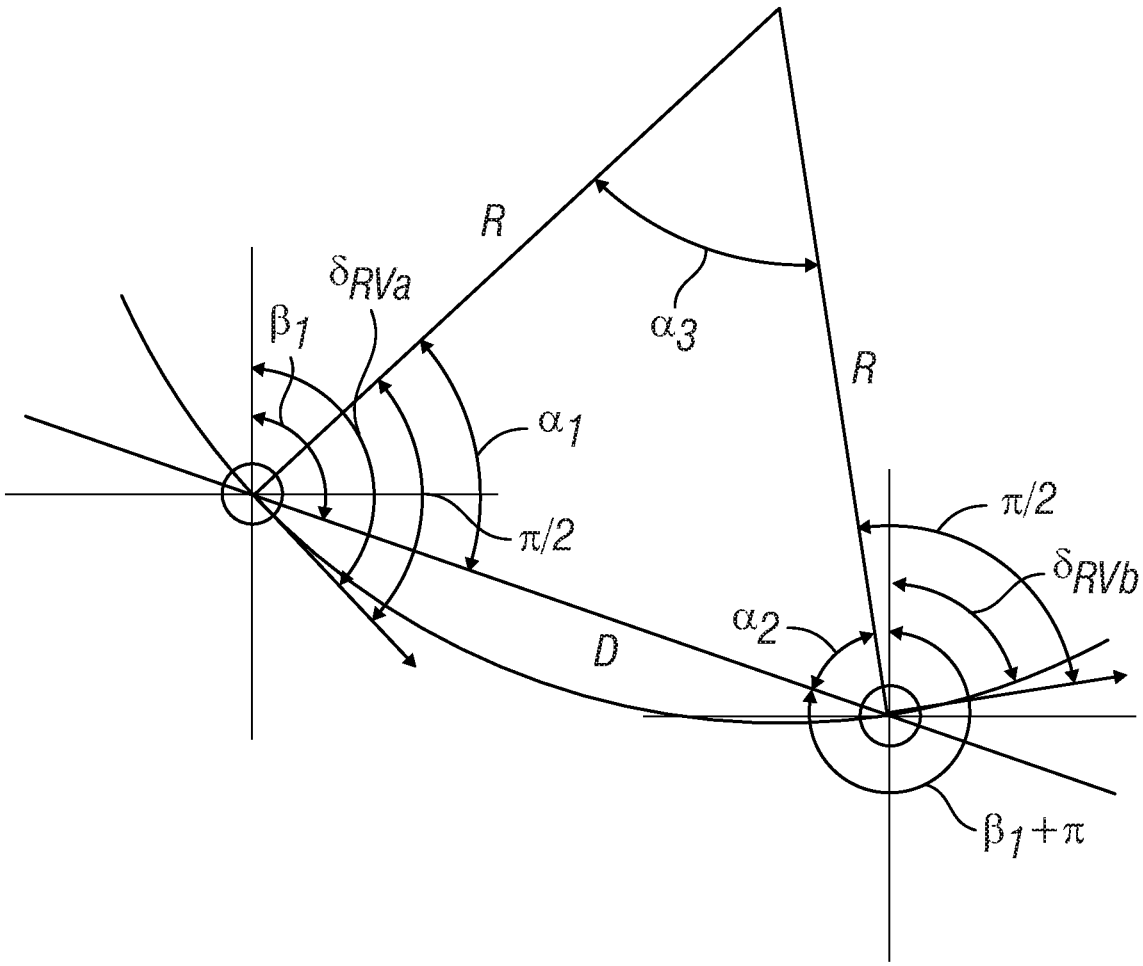
Figure 23:
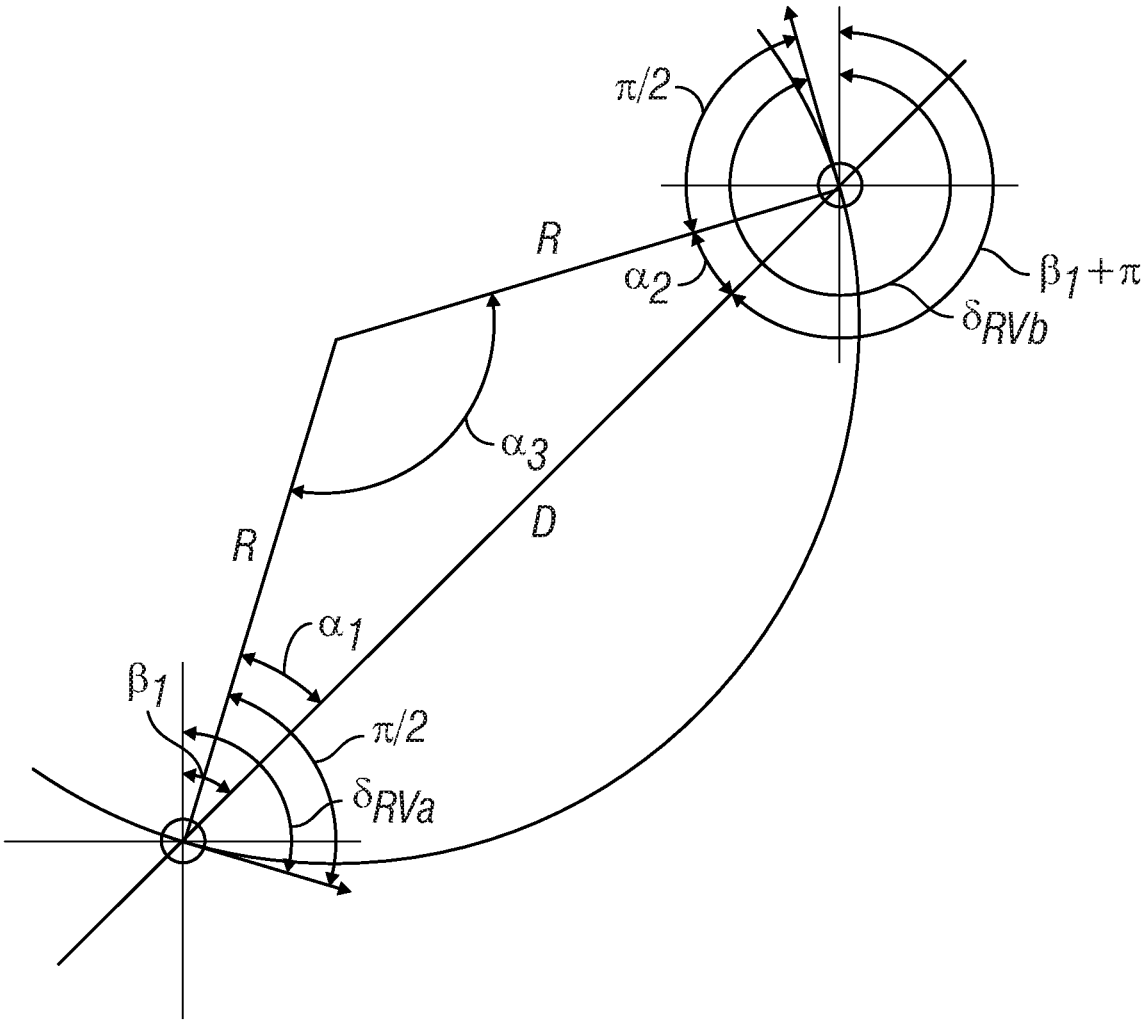
Figure 24:
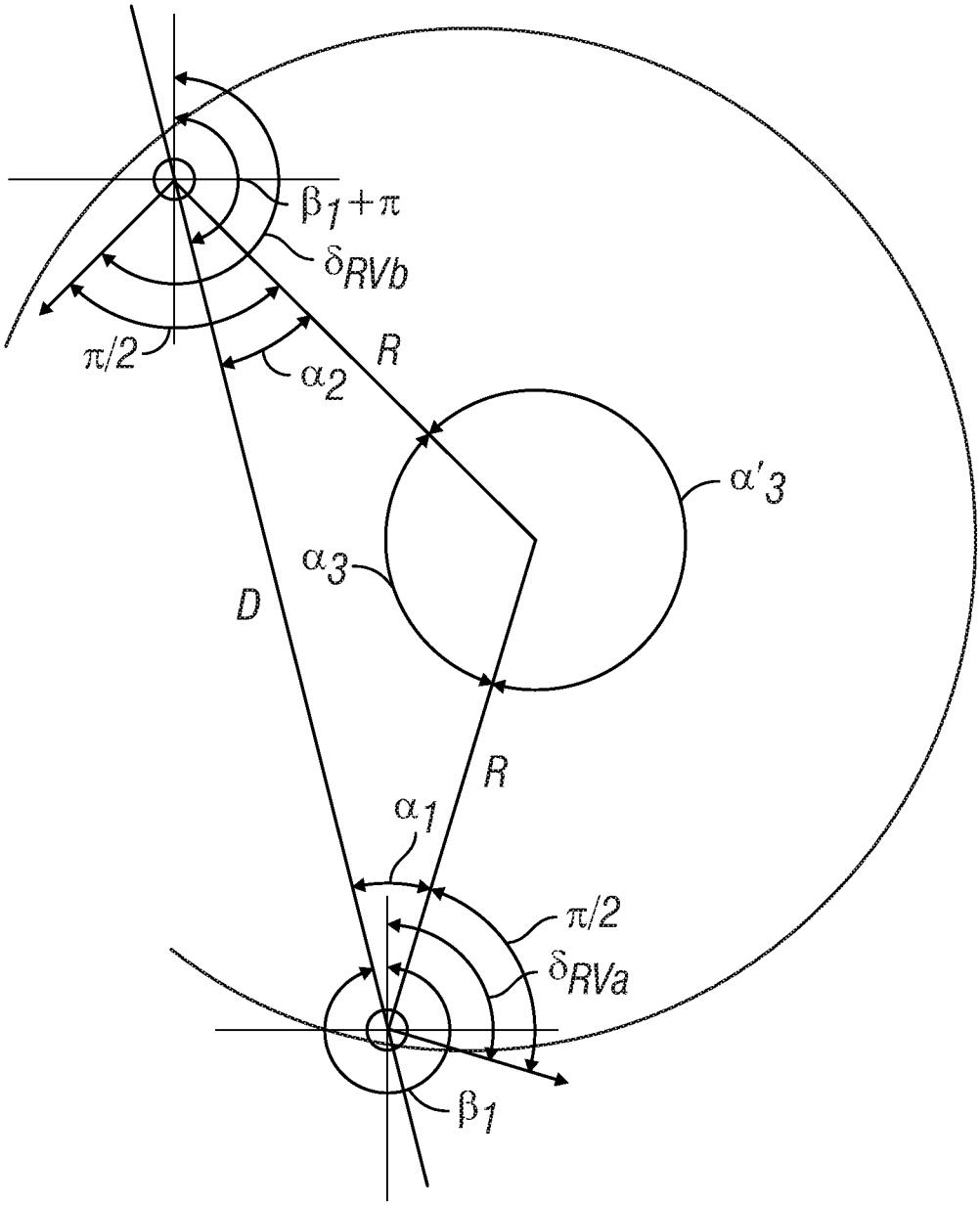

With reference to FIG. 14, for a counter-clockwise turn, the initial conditions are:

$3\pi/2 \leq \delta_{RVa} < 2\pi$ $\pi \leq \delta_{RVb} < 3\pi/2$ and the solutions are:

$\delta_{RVa} - \beta_1 = \pi/2 - \alpha_1$ $\alpha_1 = \pi/2 - \delta_{RVa} + \beta_1$ $\beta_1 - \pi + \alpha_2 + \pi/2 = \delta_{RVb}$ $\alpha_2 = \pi/2 + \delta_{RVb} - \beta_1$ With reference to FIG. 15, for a counter-clockwise turn, the initial conditions are:

$3\pi/2 \leq \delta_{RVa} < 2\pi$ $\pi/2 \leq \delta_{RVb} < \pi$ and the solutions are:

$\delta_{RVa} - \beta_1 = \pi/2 - \alpha_1$ $\alpha_1 = \pi/2 - \delta_{RVa} + \beta_1$ $\beta_1 - \pi + \alpha_2 + \pi/2 = \delta_{RVb}$ $\alpha_2 = \pi/2 + \delta_{RVb} - \beta_1$ With reference to FIG. 16, for a counter-clockwise turn, the initial conditions are:

$3\pi/2 \leq \delta_{RVa} < 2\pi$ $0 \leq \delta_{RVb} < \pi/2$ and the solutions are:

$\delta_{RVa} = \beta_1 + \alpha_1 + \pi/2$ $\alpha_1 = -(\pi/2 - \delta_{RVa} + \beta_1)$ $\beta_1 + \pi - \alpha_2 \pi/2 - \delta_{RVb} = 2\pi$ $\alpha_2 = -(\pi/2 + \delta_{RVb} - \beta_1)$ With reference to FIG. 17, for a counter-clockwise turn, the initial conditions are:

$\pi \leq \delta_{RVa} < 3\pi/2$ $\pi \leq \delta_{RVb} < 3\pi/2$ and the solutions are:

$\delta_{RVa} - \beta_1 = \pi/2 - \alpha_1$ $\alpha_1 = \pi/2 - \delta_{RVa} + \beta_1$ $\beta_1 - \pi + \alpha_2 + \pi/2 = \delta_{RVb}$ $\alpha_2 = \pi/2 + \delta_{RVb} - \beta_1$ With reference to FIG. 18, for a counter-clockwise turn, the initial conditions are:

$\pi \leq \delta_{RVa} < 3\pi/2$ $\pi/2 \leq \delta_{RVb} < \pi$ and the solutions are:

$\delta_{RVa} - \beta_1 = \pi/2 - \alpha_1$ $\alpha_1 = \pi/2 - \delta_{RVa} + \beta_1$ $\beta_1 + \pi + \alpha_2 + \pi/2 = \delta_{RVb}$ $\alpha_2 = \pi/2 + \delta_{RVb} - \beta_1$ With reference to FIG. 19, for a counter-clockwise turn, the initial conditions are:

$\pi \leq \delta_{RVa} < 3\pi/2$ $0 \leq \delta_{RVb} < \pi/2$ and the solutions are:

$\delta_{RVa} - \beta_1 = \pi/2 - \alpha_1$ $\alpha_1 = \pi/2 - \delta_{RVa} + \beta_1$ $\beta_1 + \pi + \alpha_2 + \pi/2 - \delta_{RVb} = 2\pi$ $\alpha_2 = \pi/2 + \delta_{RVb} - \beta_1$ With reference to FIG. 20, for a counter-clockwise turn, the initial conditions are:

$\pi \leq \delta_{RVa} < 3\pi/2$ $3\pi/2 \leq \delta_{RVb} < 2\pi$ and the solutions are:

$\beta_1 + \alpha_1 + \pi/2 = \delta_{RVa}$ $\alpha_1 = -(\pi/2 - \delta_{RVa} + \beta_1)$ $\beta_1 + \pi - \alpha_2 = \delta_{RVb} - \pi/2$ $\alpha_2 = 3\pi/2 - \delta_{RVb} + \beta_1$ With reference to FIG. 21, for a counter-clockwise turn, the initial conditions are:

$\pi/2 \leq \delta_{RVa} < \pi$ $\pi/2 \leq \delta_{RVb} < \pi$ and the solutions are:

$\delta_{RVa} - \beta_1 = \pi/2 - \alpha_1$ $\alpha_1 = \pi/2 - \delta_{RVa} + \beta_1$ $\beta_1 + \pi + \alpha_2 + \pi/2 - \beta_{RVb} = 2\pi$ $\alpha_2 = \pi/2 + \delta_{RVb} - \beta_1$ With reference to FIG. 22, for a counter-clockwise turn, the initial conditions are:

$\pi/2 \leq \delta_{RVa} < \pi$ $0 \leq \delta_{RVb} < \pi/2$ and the solutions are:

$\delta_{RVa} - \beta_1 = \pi/2 - \alpha_1$ $\alpha_1 = \pi/2 - \delta_{RVa} + \beta_1$ $\beta_1 + \pi + \alpha_2 + \pi/2 - \beta_{RVb} = 2\pi$ $\alpha_2 = \pi/2 + \delta_{RVb} - \beta_1$ With reference to FIG. 23, for a counter-clockwise turn, the initial conditions are:

$\pi/2 \leq \delta_{RVa} < \pi$ $3\pi/2 \leq \delta_{RVb} < 2\pi$ and the solutions are:

$\delta_{RVa} - \beta_1 = \pi/2 - \alpha_1$ $\alpha_1 = \pi/2 - \delta_{RVa} + \beta_1$ $\beta_1 + \pi + \alpha_2 + \pi/2 = \beta_{RVb}$ $\alpha_2 = -(3\pi/2 - \delta_{RVb} + \beta_1)$ With reference to FIG. 24, for a counter-clockwise turn, the initial conditions are:

$\pi/2 \leq \delta_{RVa} < \pi$ $\pi \leq \delta_{RVb} < 3\pi/2$ and the solutions are:

$\beta_1 + \alpha_1 + \pi/2 - \delta_{RVa} = 2\pi$ $\alpha_1 = 3\pi/2 + \delta_{RVa} - \beta_1$ $\delta_{RVb} - (\beta_1 - \pi) = \pi/2 - \alpha_2$ $\alpha_2 = -(\pi/2 + \delta_{RVb} - \beta_1)$ Table 2 below represents the conditions shown in FIGS. 9 through 24 as discussed above:

TABLE 2

| Counter-Clockwise Turn Cross-Reference: | | | | |
|---|---|---|---|---|
| | $0 \leq \delta_{RVb} < \pi/2$ | $\pi/2 \leq \delta_{RVb} < \pi$ | $\pi \leq \delta_{RVb} < 3\pi/2$ | $3\pi/2 \leq \delta_{RVb} < 2\pi$ |
| $0 \leq \delta_{RVa} < \pi/2$ | FIG. 9 | FIG. 12 | FIG. 11 | FIG. 10 |
| $\pi/2 \leq \delta_{RVa} < \pi$ | FIG. 22 | FIG. 21 | FIG. 24 | FIG. 23 |
| $\pi \leq \delta_{RVa} < 3\pi/2$ | FIG. 19 | FIG. 18 | FIG. 17 | FIG. 20 |
| $3\pi/2 \leq \delta_{RVa} < 2\pi$ | FIG. 16 | FIG. 15 | FIG. 14 | FIG. 13 |

Table 3 below puts into matrix form expressions for $\alpha_1$ and $\alpha_2$ for each of the 16 combinations of the ranges of values for $\delta_{RVa}$ and $\delta_{RVb}$ shown in Table 2.

TABLE 3

| | $0 \leq \delta_{RVb} < \pi/2$ | $\pi/2 \leq \delta_{RVb} < \pi$ | $\pi \leq \delta_{RVb} < 3\pi/2$ | $3\pi/2 \leq \delta_{RVb} < 2\pi$ |
|---|---|---|---|---|
| $\alpha_{1_{m,n}}$ | | | | |
| $0 \leq \delta_{RVa} < \pi/2$ | $\alpha_{1L_{1,1}} = \pi/2 - \delta_{RVa} + \beta_1$ | $\alpha_{1L_{1,2}} = 3\pi/2 + \delta_{RVa} - \beta_1$ | $\alpha_{1L_{1,3}} = -(3\pi/2 + \delta_{RVa} - \beta_1)$ | $\alpha_{1L_{1,4}} = \pi/2 - \delta_{RVa} + \beta_1$ |
| $\pi/2 \leq \delta_{RVa} < \pi$ | $\alpha_{1L_{2,1}} = \pi/2 - \delta_{RVa} + \beta_1$ | $\alpha_{1L_{2,2}} = \pi/2 - \delta_{RVa} + \beta_1$ | $\alpha_{1L_{2,3}} = 3\pi/2 + \delta_{RVa} - \beta_1$ | $\alpha_{1L_{2,4}} = \pi/2 - \delta_{RVa} + \beta_1$ |
| $\pi \leq \delta_{RVa} < 3\pi/2$ | $\alpha_{1L_{3,1}} = \pi/2 - \delta_{RVa} + \beta_1$ | $\alpha_{1L_{3,2}} = \pi/2 - \delta_{RVa} + \beta_1$ | $\alpha_{1L_{3,3}} = \pi/2 - \delta_{RVa} + \beta_1$ | $\alpha_{1L_{3,4}} = -(\pi/2 - \delta_{RVa} + \beta_1)$ |
| $3\pi/2 \leq \delta_{RVa} < 2\pi$ | $\alpha_{1L_{4,1}} = -(\pi/2 - \delta_{RVa} + \beta_1)$ | $\alpha_{1L_{4,2}} = \pi/2 - \delta_{RVa} + \beta_1$ | $\alpha_{1L_{4,3}} = \pi/2 - \delta_{RVa} + \beta_1$ | $\alpha_{1L_{4,4}} = \pi/2 - \delta_{RVa} + \beta_1$ |
| $\alpha_{2_{m,n}}$ | | | | |
| $0 \leq \delta_{RVa} < \pi/2$ | $\alpha_{2L_{1,1}} = \pi/2 + \delta_{RVb} - \beta_1$ | $\alpha_{2L_{1,2}} = -(\pi/2 + \delta_{RVb} - \beta_1)$ | $\alpha_{2L_{1,3}} = \pi/2 + \delta_{RVb} - \beta_1$ | $\alpha_{2L_{1,4}} = -(3\pi/2 - \delta_{RVb} + \beta_1)$ |
| $\pi/2 \leq \delta_{RVa} < \pi$ | $\alpha_{2L_{2,1}} = \pi/2 + \delta_{RVb} - \beta_1$ | $\alpha_{2L_{2,2}} = \pi/2 + \delta_{RVb} - \beta_1$ | $\alpha_{2L_{2,3}} = -(\pi/2 + \delta_{RVb} - \beta_1)$ | $\alpha_{2L_{2,4}} = -(3\pi/2 - \delta_{RVb} + \beta_1)$ |
| $\pi \leq \delta_{RVa} < 3\pi/2$ | $\alpha_{2L_{3,1}} = \pi/2 + \delta_{RVb} - \beta_1$ | $\alpha_{2L_{3,2}} = \pi/2 + \delta_{RVb} - \beta_1$ | $\alpha_{2L_{3,3}} = \pi/2 + \delta_{RVb} - \beta_1$ | $\alpha_{2L_{3,4}} = 3\pi/2 - \delta_{RVb} + \beta_1$ |
| $3\pi/2 \leq \delta_{RVa} < 2\pi$ | $\alpha_{2L_{4,1}} = -(\pi/2 + \delta_{RVb} - \beta_1)$ | $\alpha_{2L_{4,2}} = \pi/2 + \delta_{RVb} - \beta_1$ | $\alpha_{2L_{4,3}} = \pi/2 + \delta_{RVb} - \beta_1$ | $\alpha_{2L_{4,4}} = \pi/2 + \delta_{RVb} - \beta_1$ |

where $$\beta_1 = \pi\left[\frac{\theta_{RVa} - \theta_{RVb} - \sigma}{|\theta_{RVa} - \theta_{RVb}| + \sigma} + 1\right] - \cos^{-1}\left(\frac{(\phi_{RVb} - \phi_{RVa})}{\sqrt{(\theta_{RVb} - \theta_{RVa})^2\cos^2\phi_{RVb} + (\phi_{RVb} - \phi_{RVa})^2}}\right)\left[\frac{\theta_{RVa} - \theta_{RVb} - \sigma}{|\theta_{RVa} - \theta_{RVb}| + \sigma}\right]$$

and $\theta_{RVb}$=$RV_b$ longitude $\theta_{RVa}$=$RV_a$ longitude $\phi_{RVb}$=$RV_b$ latitude $\phi_{RVa}$=$RV_a$ latitude $\sigma$=a small constant added to the equation to prevent dividing by 0.

While the controller 22 is performing the calculations as discussed herein, values for $\alpha_1$ and $\alpha_2$ are used in order to first determine angle $\alpha_3'$, which is essential for determining radius of curvature. Based on FIGS. 9 through 24, it is readily seen that:

$$\pi=\alpha_1+\alpha_2+\alpha_2$$

and solving for $\alpha_3$ yields:

$$\alpha_3=\pi-(\alpha_1+\alpha_2).$$

Table 4 below puts into matrix form expressions for $\alpha_3$ for each of the 16 combinations of the ranges of values for $\delta_{RVa}$ and $\delta_{RVb}$ shown in Table 2.

TABLE 4

| $\alpha_{3_{m,n}}$ | $0 \le \delta_{RVb} < \pi/2$ | $\pi/2 \le \delta_{RVb} < \pi$ | $\pi \le \delta_{RVb} < 3\pi/2$ | $3\pi/2 \le \delta_{RVb} < 2\pi$ |
|---|---|---|---|---|
| $0 \le \delta_{RVa} < \pi/2$ | $\alpha_{3L_{1,1}} = \delta_{RVa} - \delta_{RVb}$ | $\alpha_{3L_{1,2}} = \delta_{RVb} - \delta_{RVa}$ | $\alpha_{3L_{1,3}} = 2\pi + \delta_{RVa} - \delta_{RVb}$ | $\alpha_{3L_{1,4}} = 2\pi + \delta_{RVa} - \delta_{RVb}$ |
| $\pi/2 \le \delta_{RVa} < \pi$ | $\alpha_{3L_{2,1}} = \delta_{RVa} - \delta_{RVb}$ | $\alpha_{3L_{2,2}} = \delta_{RVa} - \delta_{RVb}$ | $\alpha_{3L_{2,3}} = \delta_{RVb} - \delta_{RVa}$ | $\alpha_{3L_{2,4}} = 2\pi + \delta_{RVa} - \delta_{RVb}$ |
| $\pi \le \delta_{RVa} < 3\pi/2$ | $\alpha_{3L_{3,1}} = \delta_{RVa} - \delta_{RVb}$ | $\alpha_{3L_{3,2}} = \delta_{RVa} - \delta_{RVb}$ | $\alpha_{3L_{3,3}} = \delta_{RVa} - \delta_{RVb}$ | $\alpha_{3L_{3,4}} = \delta_{RVb} - \delta_{RVa}$ |
| $3\pi/2 \le \delta_{RVa} < 2\pi$ | $\alpha_{3L_{4,1}} = 2\pi - \delta_{RVa} + \delta_{RVb}$ | $\alpha_{3L_{4,2}} = \delta_{RVa} - \delta_{RVb}$ | $\alpha_{3L_{4,3}} = \delta_{RVa} - \delta_{RVb}$ | $\alpha_{3L_{4,4}} = \delta_{RVa} - \delta_{RVb}$ |

However, it can be appreciated from FIGS. 12, 16, 20 and 24 that the angle $\alpha_3'$ rather than $\alpha_3$ is needed to calculate the curve radius, R. Therefore, a new variable $\alpha_3'$ is defined which in most cases is equal to $\alpha_3$ thus:

$$\alpha_3'=\alpha_3=\pi-(\alpha_1+\alpha_2).$$

However, for the cases illustrated in FIGS. 12, 16, 20 and 24:

$$\alpha_3'=2\pi-\alpha_3$$

$$\alpha_3'=2\pi-(\pi-(\alpha_1+\alpha_2))$$

$$\alpha_3'=\pi+(\alpha_1+\alpha_2)$$

Table 5 below puts into matrix form expressions for $\alpha_{3L}'$ for each of the 16 combinations of the ranges of values for $\delta_{RVa}$ and $\delta_{RVb}$ shown in Table 2.

TABLE 5

| $\alpha'_{3_{m,n}}$ | $0 \le \delta_{RVb} < \pi/2$ | $\pi/2 \le \delta_{RVb} < \pi$ | $\pi \le \delta_{RVb} < 3\pi/2$ | $3\pi/2 \le \delta_{RVb} < 2\pi$ |
|---|---|---|---|---|
| $0 \le \delta_{RVa} < \pi/2$ | $\alpha'_{3L_{1,1}} = \delta_{RVa} - \delta_{RVb}$ | $\alpha'_{3L_{1,2}} = 2\pi + \delta_{RVa} - \delta_{RVb}$ | $\alpha'_{3L_{1,3}} = 2\pi + \delta_{RVa} - \delta_{RVb}$ | $\alpha'_{3L_{1,4}} = 2\pi + \delta_{RVa} - \delta_{RVb}$ |
| $\pi/2 \le \delta_{RVa} < \pi$ | $\alpha'_{3L_{2,1}} = \delta_{RVa} - \delta_{RVb}$ | $\alpha'_{3L_{2,2}} = \delta_{RVa} - \delta_{RVb}$ | $\alpha'_{3L_{2,3}} = 2\pi + \delta_{RVa} - \delta_{RVb}$ | $\alpha'_{3L_{2,4}} = 2\pi + \delta_{RVa} - \delta_{RVb}$ |
| $\pi \le \delta_{RVa} < 3\pi/2$ | $\alpha'_{3L_{3,1}} = \delta_{RVa} - \delta_{RVb}$ | $\alpha'_{3L_{3,2}} = \delta_{RVa} - \delta_{RVb}$ | $\alpha'_{3L_{3,3}} = \delta_{RVa} - \delta_{RVb}$ | $\alpha'_{3L_{3,4}} = 2\pi + \delta_{RVa} - \delta_{RVb}$ |
| $3\pi/2 \le \delta_{RVa} < 2\pi$ | $\alpha'_{3L_{4,1}} = \delta_{RVa} - \delta_{RVb}$ | $\alpha'_{3L_{4,2}} = \delta_{RVa} - \delta_{RVb}$ | $\alpha'_{3L_{4,3}} = \delta_{RVa} - \delta_{RVb}$ | $\alpha'_{3L_{4,4}} = \delta_{RVa} - \delta_{RVb}$ |

The controller 22 of the traffic circle identification system 12 can perform an evaluation similar to the counter-clockwise turn case for clockwise turns as discussed below.

Figure 25:
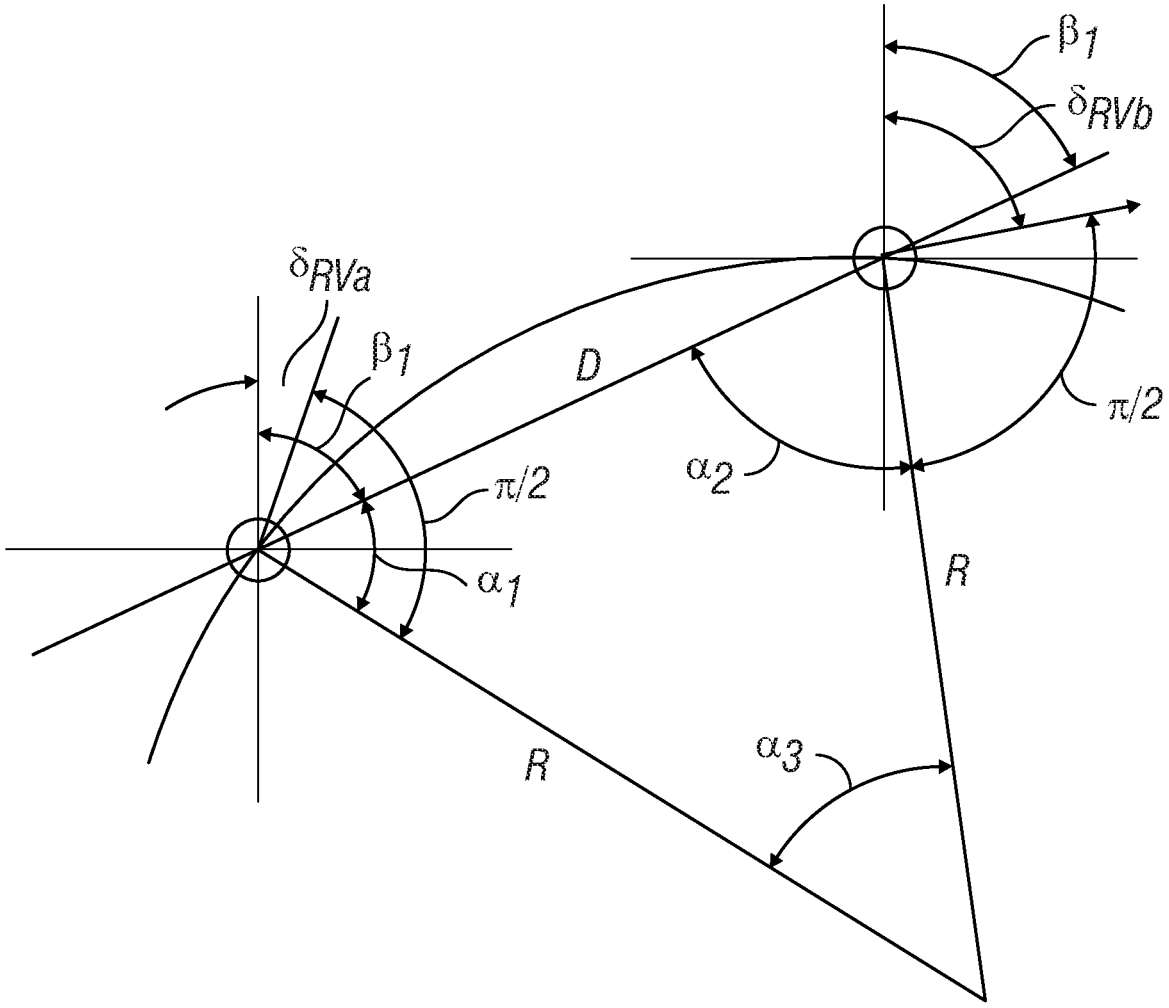
Figure 26:
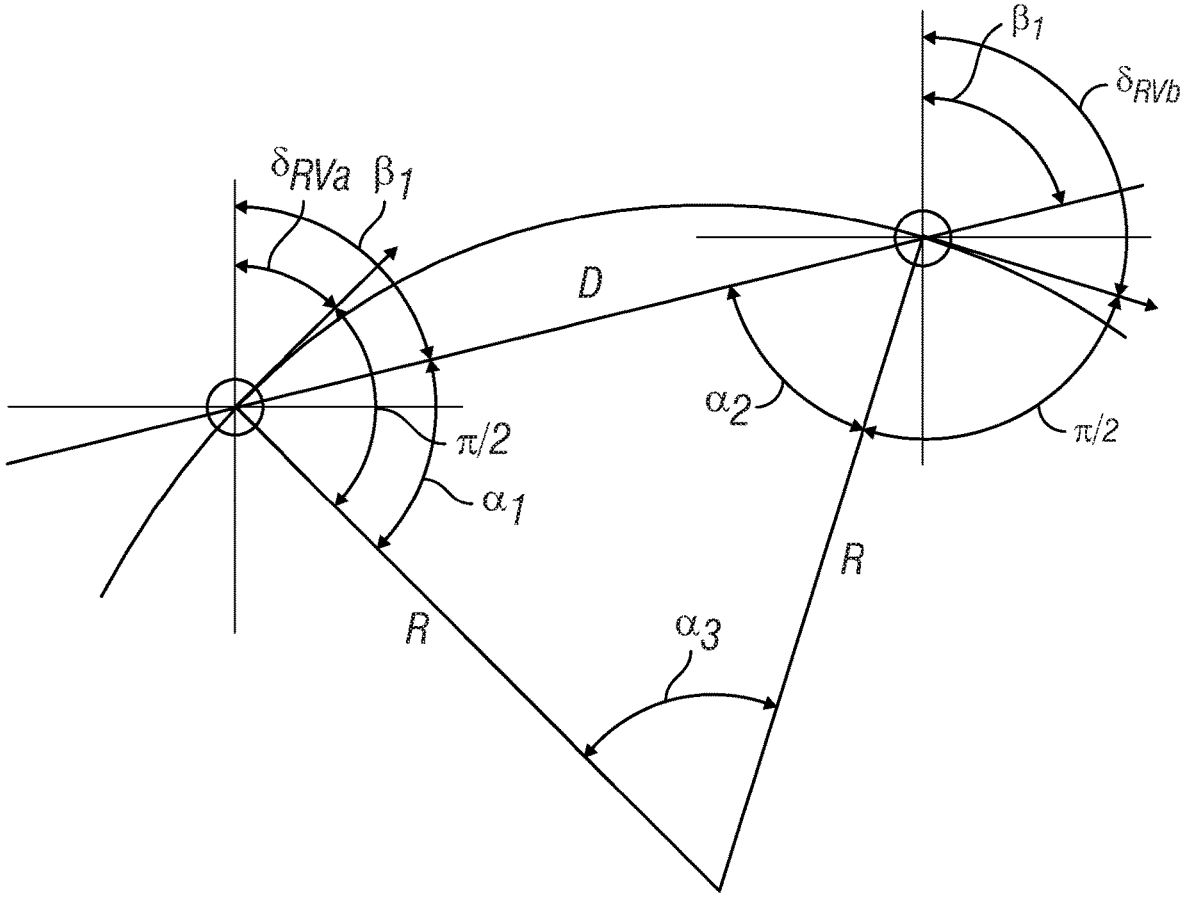
Figure 27:
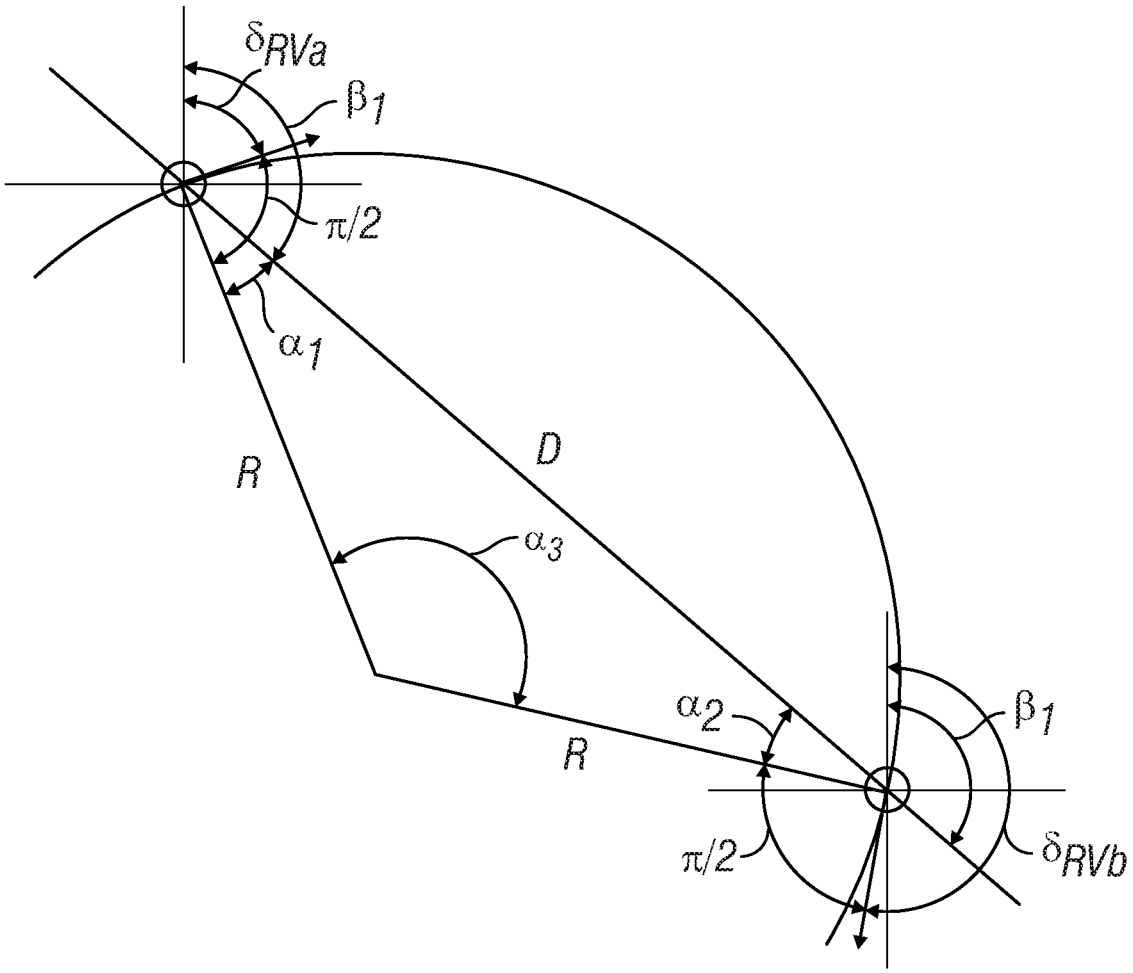
Figure 28:
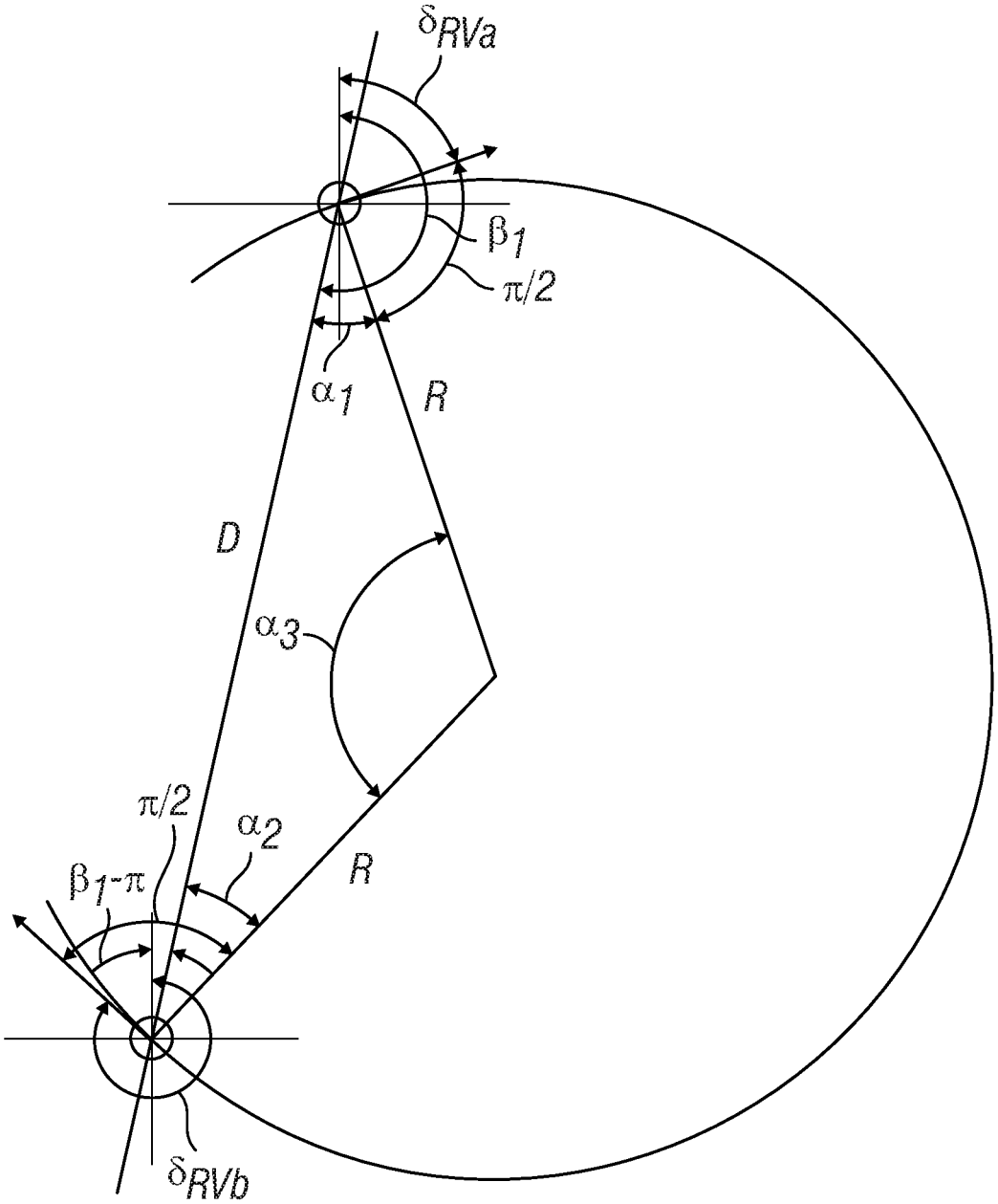
Figure 29:
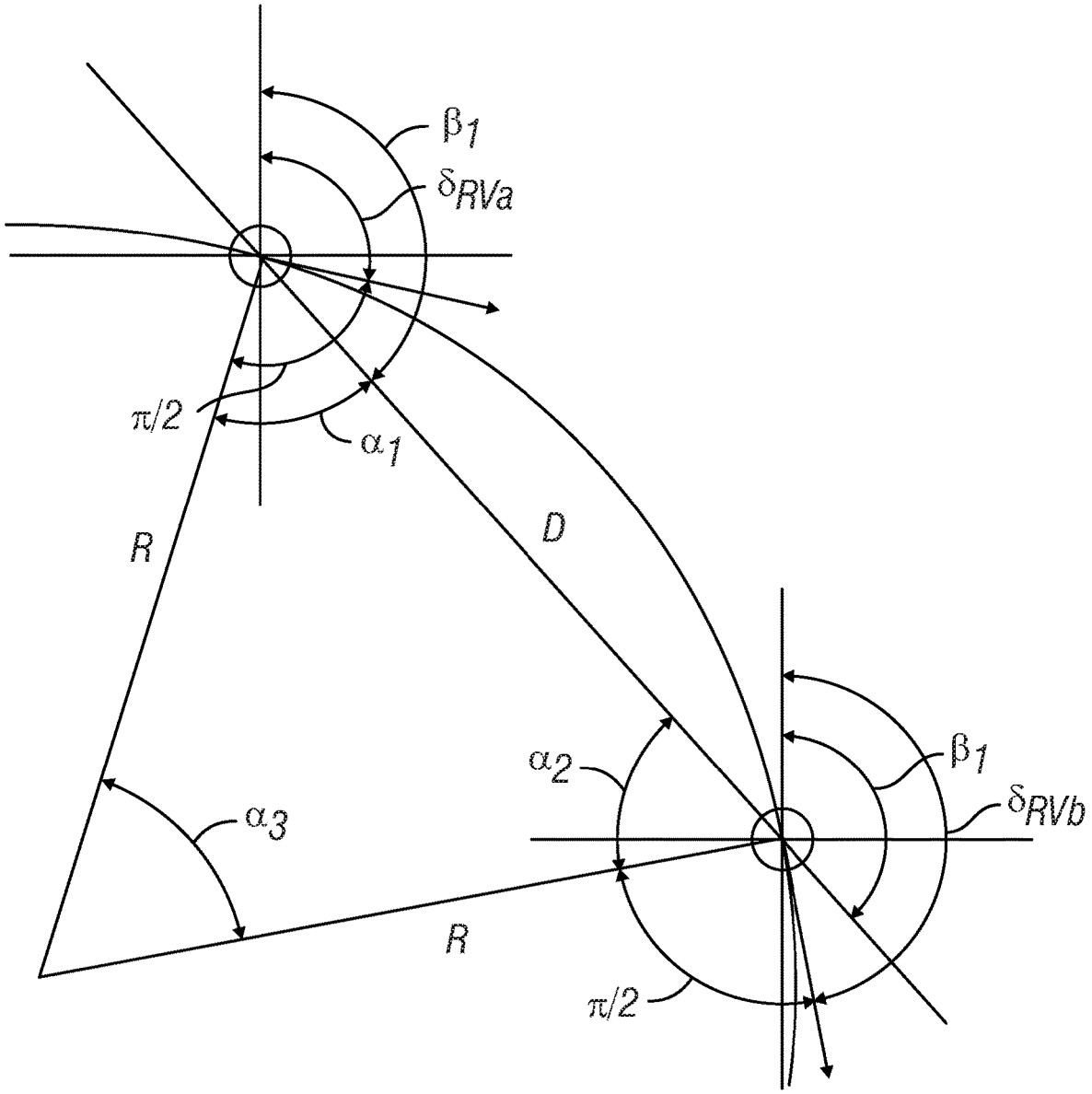
Figure 30:
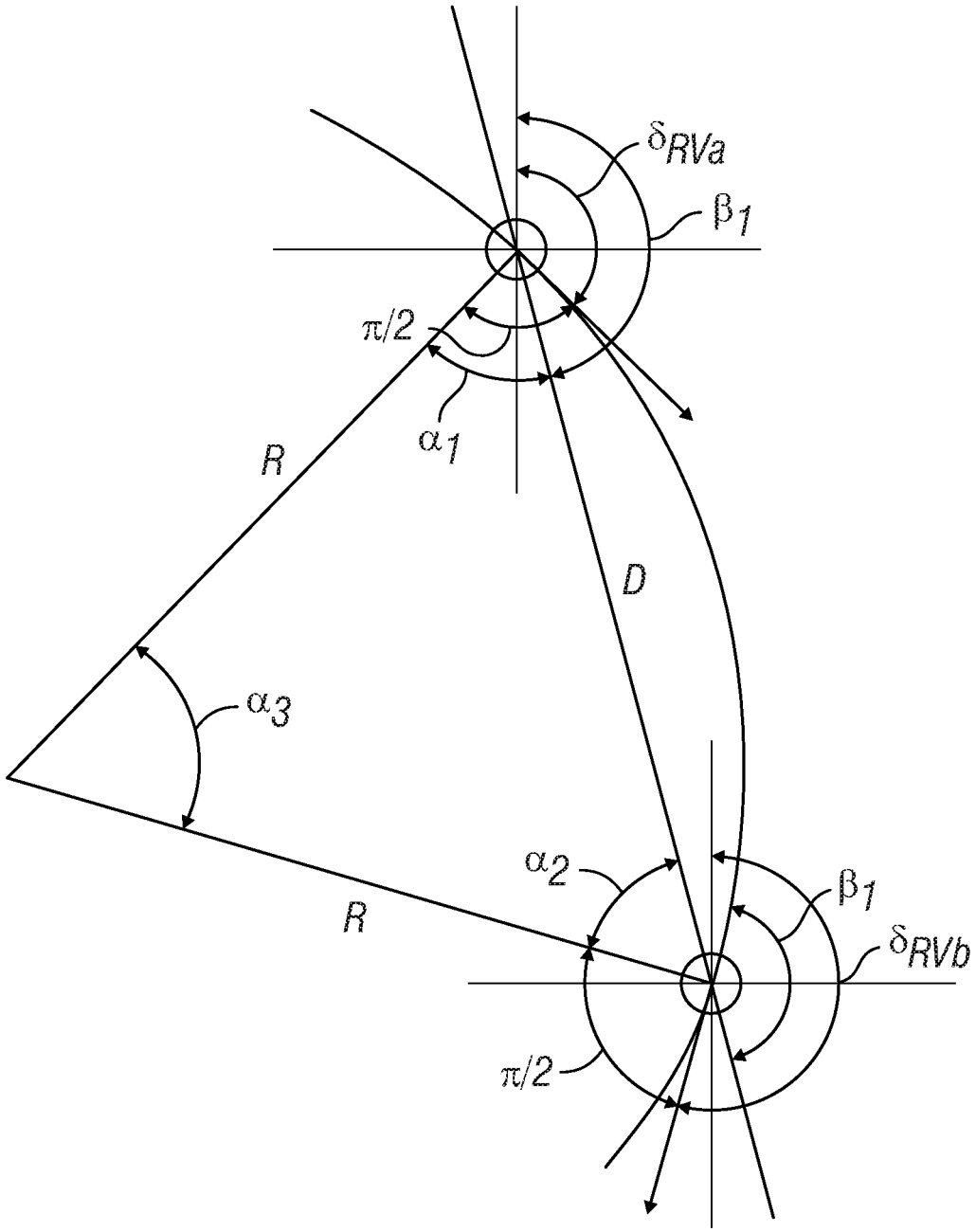
Figure 31:
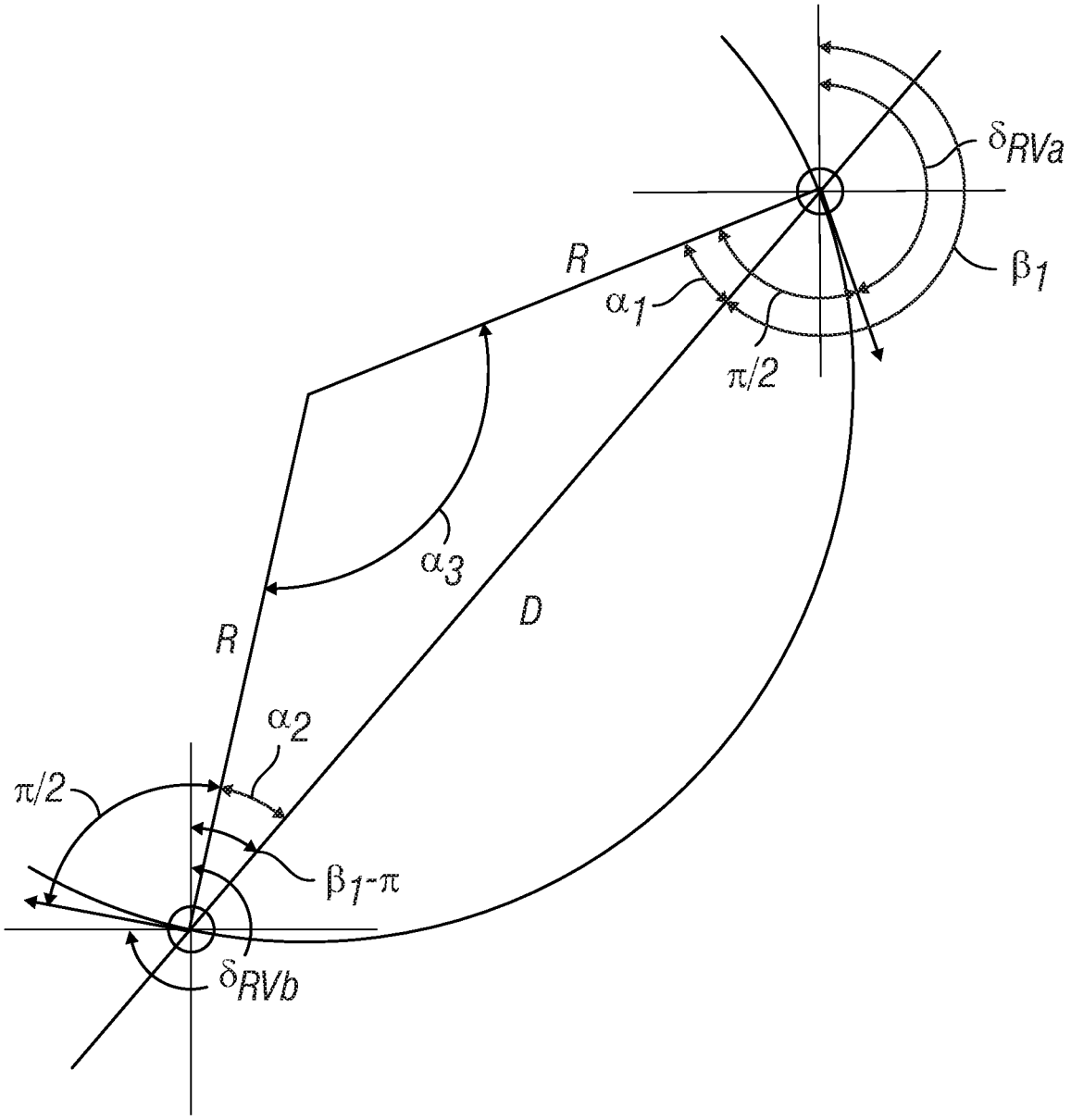
Figure 32:
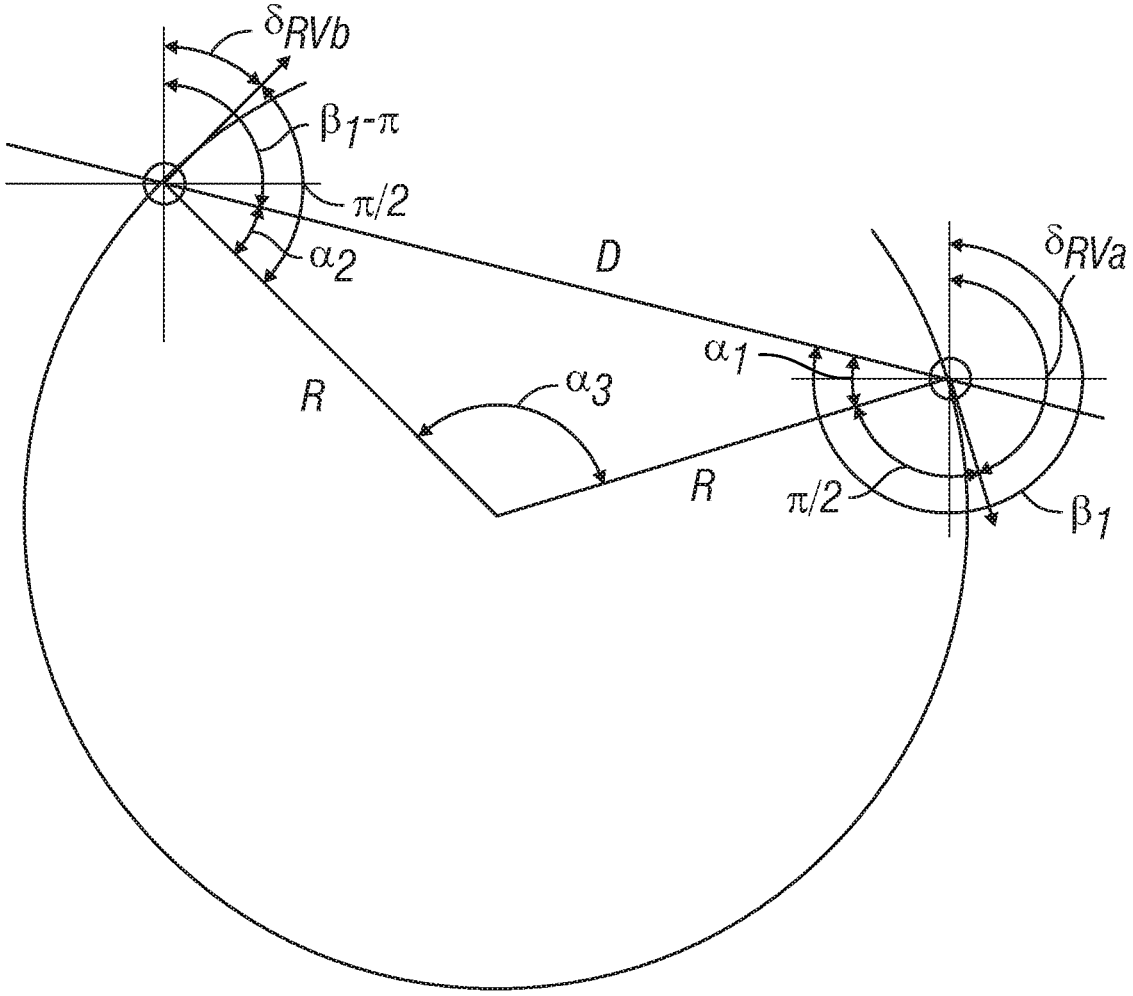
Figure 33:
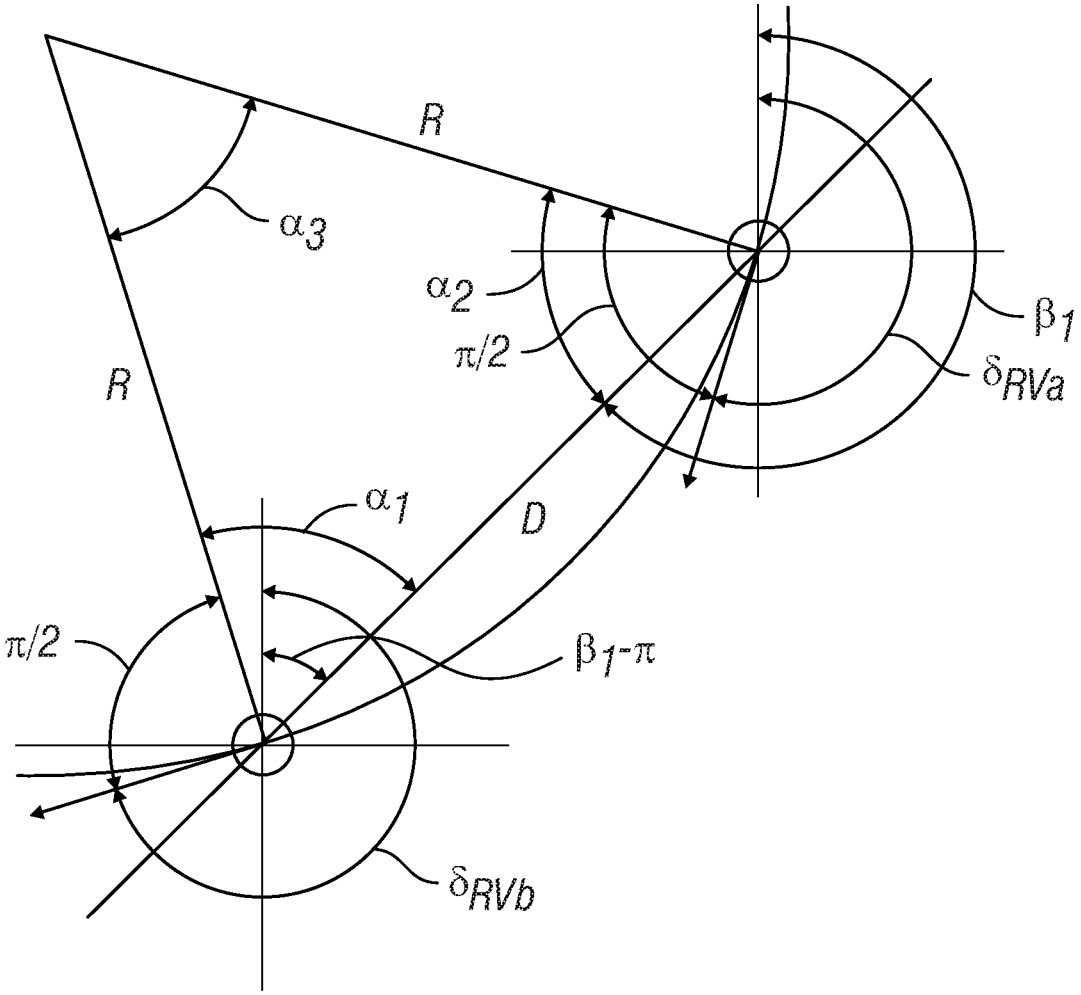
Figure 34:
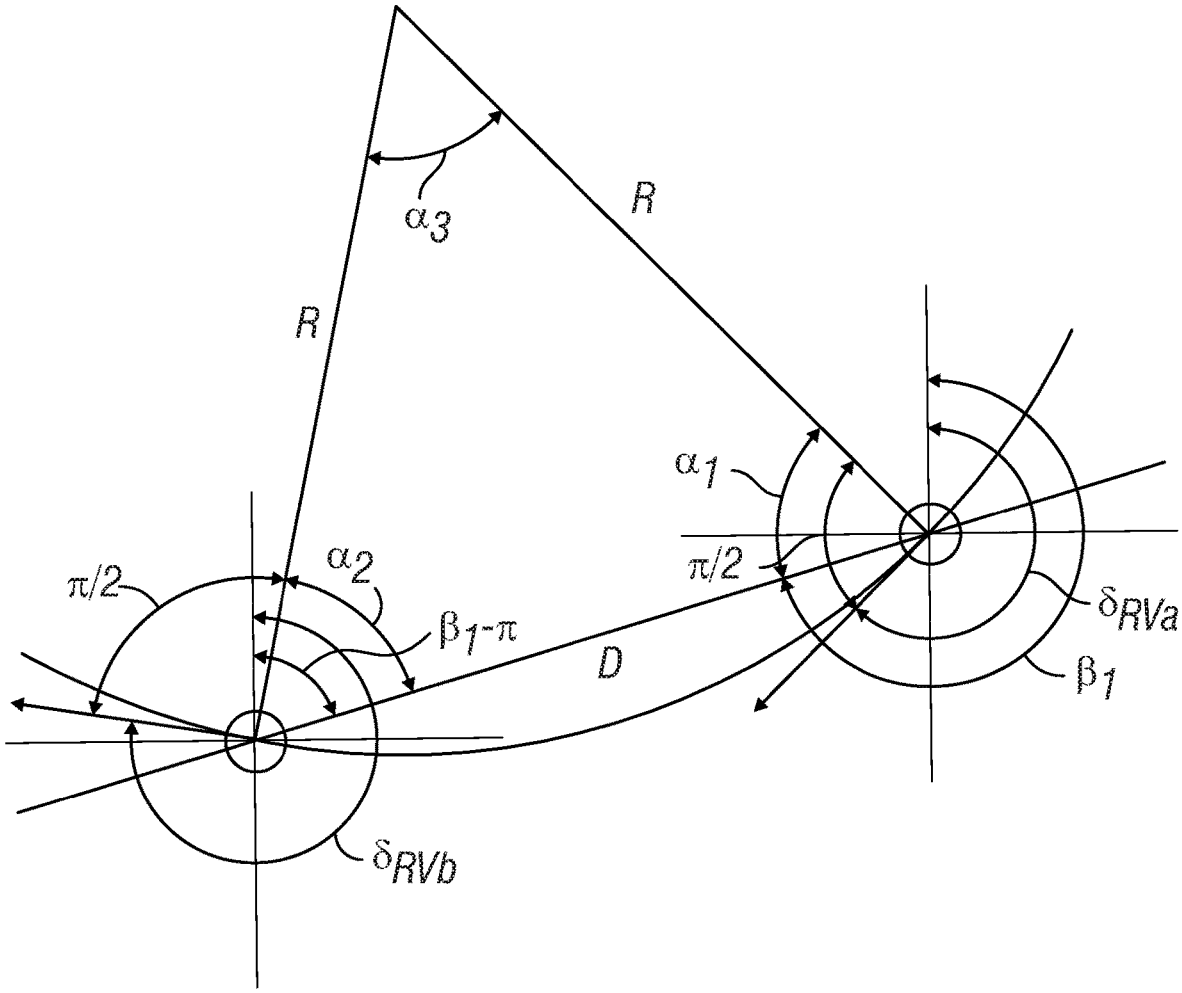
Figure 35:
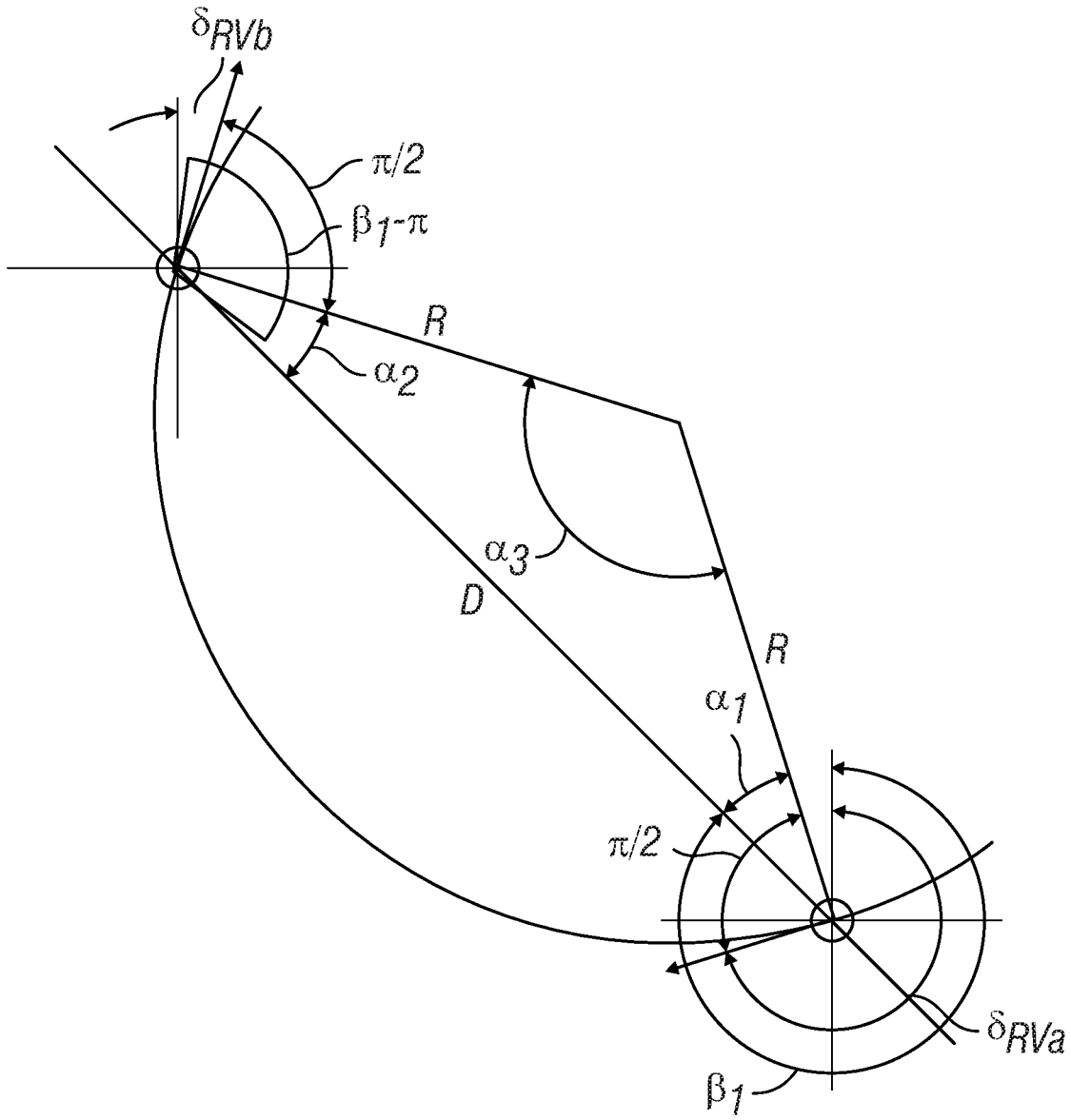
Figure 36:
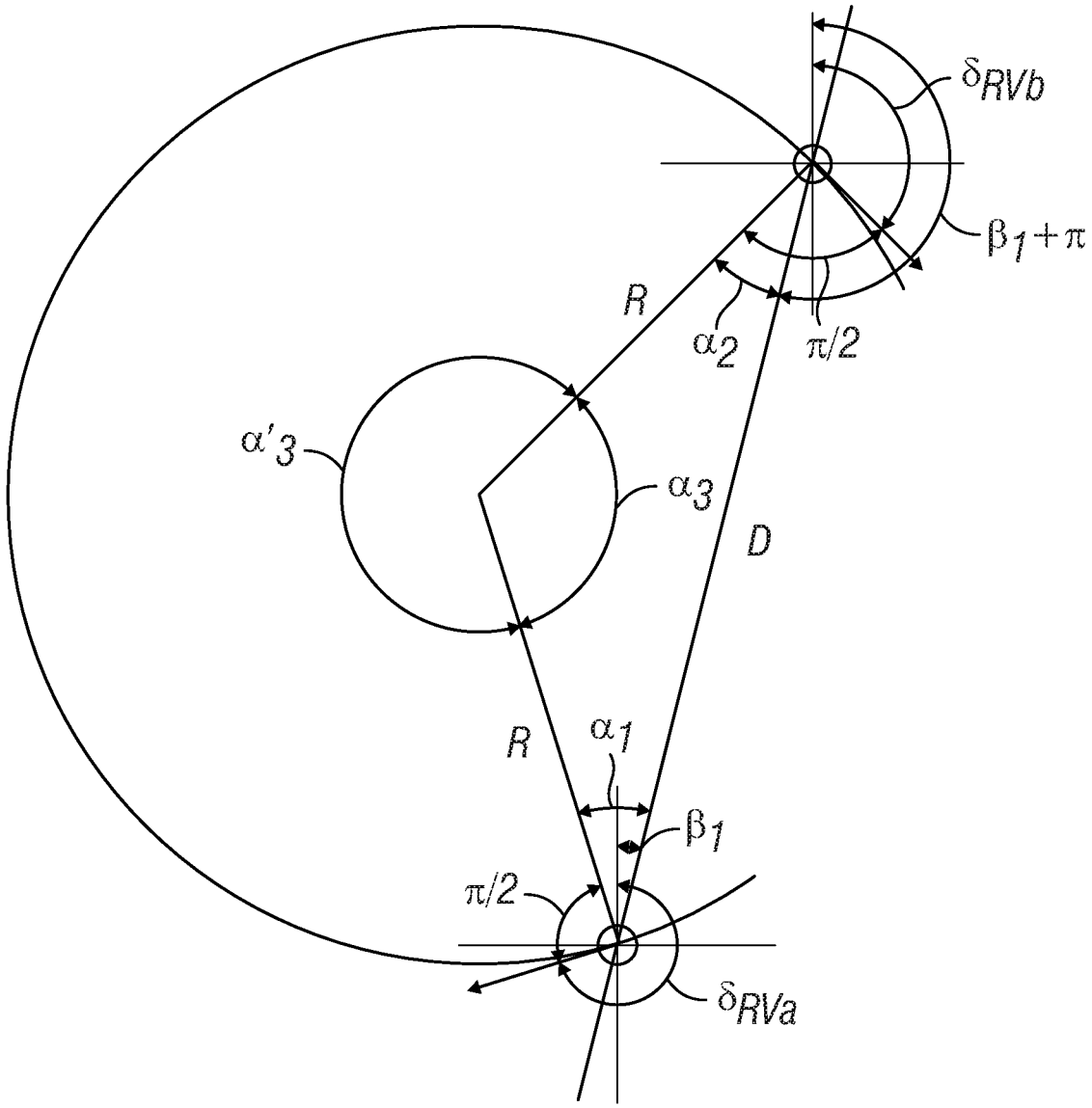
Figure 37:
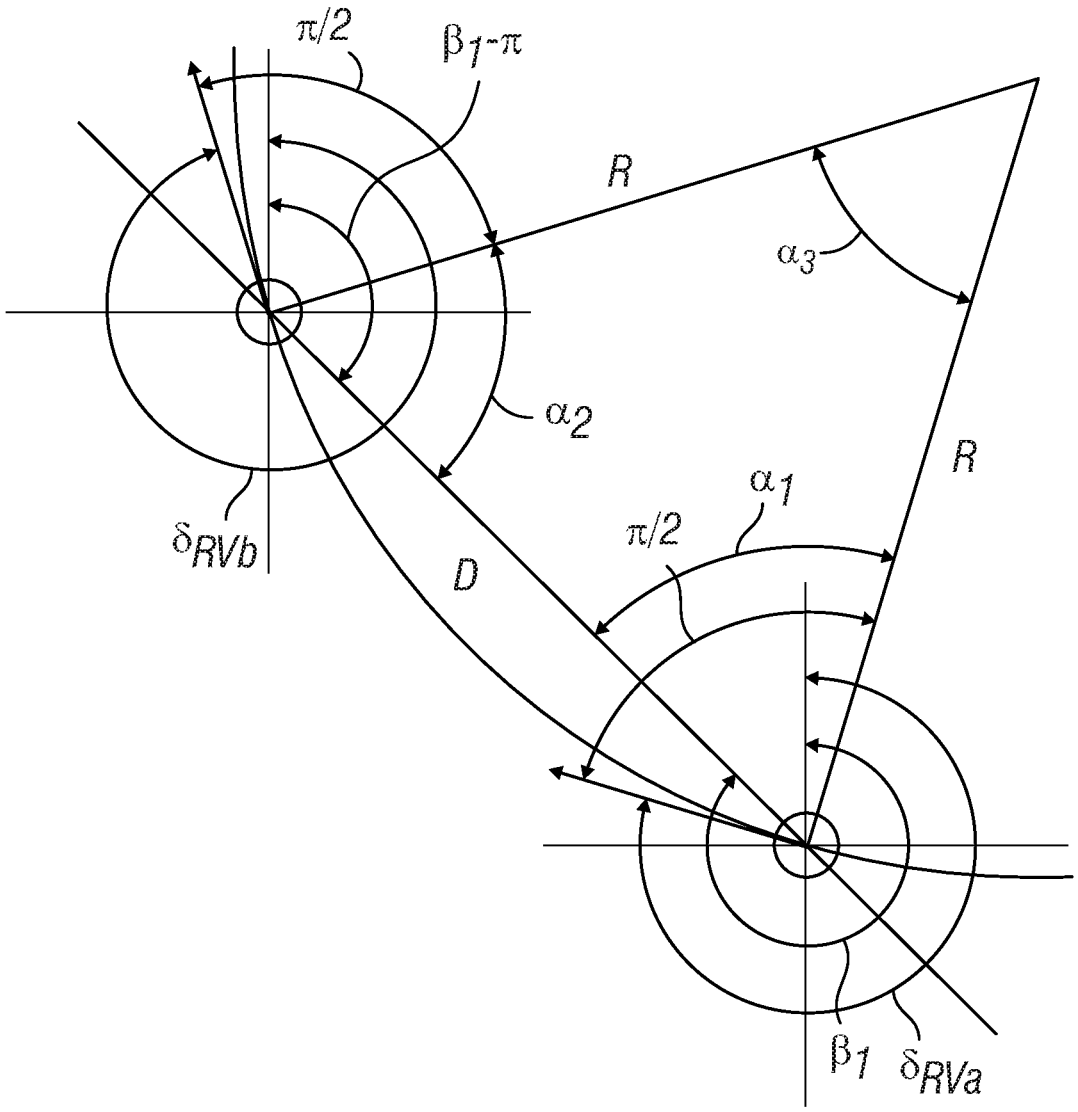
Figure 38:
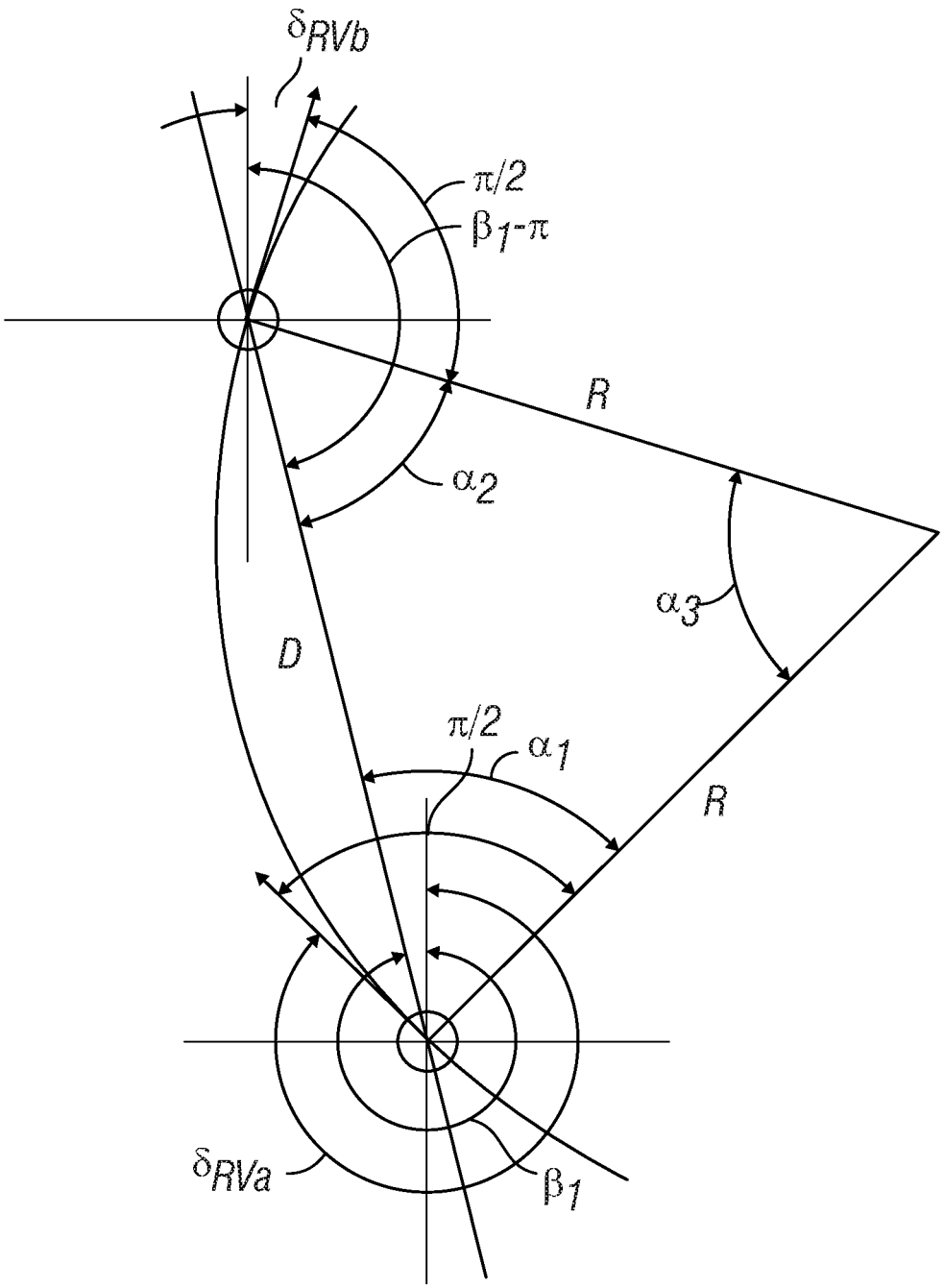
Figure 39:
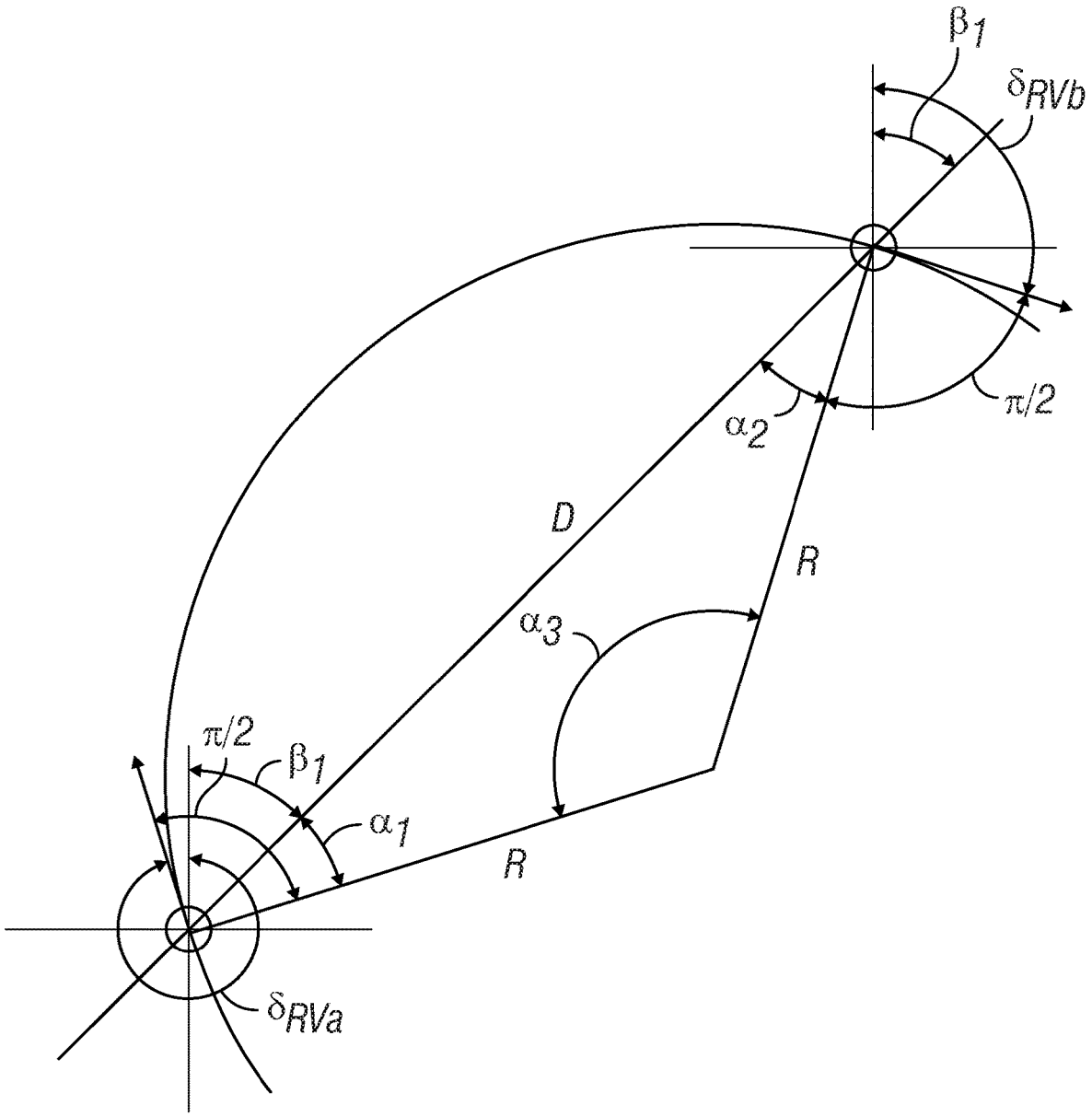
Figure 40:
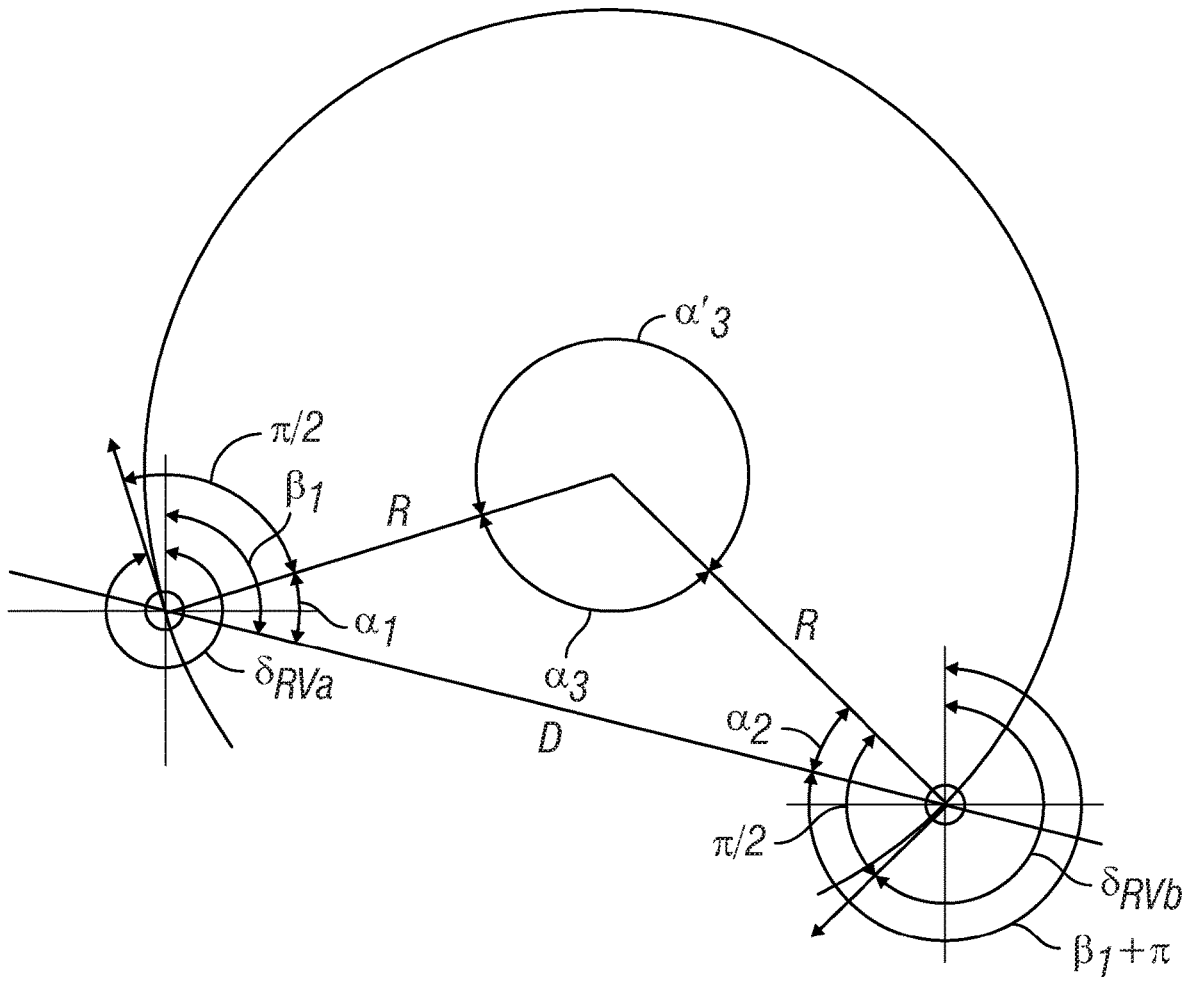

With reference to FIG. 25, for a clockwise turn, the initial conditions are:

$0 \leq \delta_{RVa} < \pi/2$ $0 \leq \delta_{RVb} < \pi/2$ and the solutions are:

$\pi/2+\delta_{RVa}=\alpha_1+\beta_1$ $\alpha_1=\pi/2+\delta_{RVa}-\beta_1$ $\delta_{RVb}-\beta_1+\pi/2+\alpha_2=\pi$ $\alpha_2=\pi/2-\delta_{RVb}+\beta_1$ With reference to FIG. 26, for a clockwise turn, the initial conditions are:

$0 \leq \delta_{RVa} < \pi/2$ $\pi/2 \leq \delta_{RVb} < \pi$ and the solutions are:

$\pi/2+\delta_{RVa}=\alpha_1+\beta_1$ $\alpha_1 \leq \pi/2+\delta_{RVa}-\beta_1$ $\delta_{RVb}-\beta_1+\pi/2+\alpha_2=\pi$ $\alpha_2=\pi/2-\delta_{RVb}+\beta_1$ With reference to FIG. 27, for a clockwise turn, the initial conditions are:

$0 \leq \delta_{RVa} < \pi/2$ $\pi \leq \delta_{RVb} < 3\pi/2$ and the solutions are:

$\pi/2+\delta_{RVa}=\alpha_1+\beta_1$ $\alpha_1=\pi/2+\delta_{RVa}-\beta_1$ $\delta_{RVb}-\beta_1+\pi/2+\alpha_2=\pi$ $\alpha_2=\pi/2-\delta_{RVb}+\beta_1$ With reference to FIG. 28, for a clockwise turn, the initial conditions are:

$0 \leq \delta_{RVa} < \pi/2$ $3\pi/2 \leq \delta_{RVb} < 2\pi$ and the solutions are:

$+\delta_{RVa}+\pi/2+\alpha_1=\beta_1$ $\alpha_1=-(\pi/2+\delta_{RVa}-\beta_1)$ $\delta_{RVb}+\pi/2-\alpha_2-(\beta_1-\pi)=2\pi$ $\alpha_2=-(\pi/2-\delta_{RVb}+\beta_1)$ With reference to FIG. 29, for a clockwise turn, the initial conditions are:

$\pi/2 \leq \delta_{RVa} < \pi$ $\pi/2 \leq \delta_{RVb} < \pi$ and the solutions are:

$\pi/2+\delta_{RVa}=\alpha_1+\beta_1$ $\alpha_1=\pi/2+\delta_{RVa}-\beta_1$ $\delta_{RVb}-\beta_1+\pi/2+\alpha_2=\pi$ $\alpha_2=\pi/2-\delta_{RVb}+\beta_1$ With reference to FIG. 30, for a clockwise turn, the initial conditions are:

$\pi/2 \leq \delta_{RVa} < \pi$ $\pi \leq \delta_{RVb} < 3\pi/2$ and the solutions are:

$\pi/2+\delta_{RVa}=\alpha_1=\beta_1$ $\alpha_1=\pi/2+\delta_{RVa}-\beta_1$ $\delta_{RVb}-\beta_1+\pi/2+\alpha_2=\pi$ $\alpha_2=\pi/2-\delta_{RVb}+\beta_1$ With reference to FIG. 31, for a clockwise turn, the initial conditions are:

$\pi/2 \leq \delta_{RVa} < \pi$ $3\pi/2 \leq \delta_{RVb} < \pi$ and the solutions are:

$\pi/2+\delta_{RVa}=\alpha_1+\beta_1$ $\alpha_1=\pi/2+\delta_{RVa}-\beta_1$ $\delta_{RVb}+\pi/2-(\beta_1-\pi-\alpha_2)=2\pi$ $\alpha_2=\pi/2-\delta_{RVb}+\beta_1$ With reference to FIG. 32, for a clockwise turn, the initial conditions are:

$\pi/2 \leq \delta_{RVa} < \pi$ $0 \leq \delta_{RVb} < \pi/2$ and the solutions are:

$\delta_{RVa}+\pi/2+\alpha_1=\beta_1$ $\alpha_1=-(\pi/2+\delta_{RVa}-\beta_1)$ $\delta_{RVb}+\pi/2=\beta_1-\pi+\alpha_2$ $\alpha_2-3\pi/2+\delta_{RVb}-\beta_1$ With reference to FIG. 33, for a clockwise turn, the initial conditions are:

$\pi \leq \delta_{RVa} < 3\pi/2$ $\pi \leq \delta_{RVb} < 3\pi/2$ and the solutions are:

$\pi/2+\delta_{RVa}=\alpha_1+\beta_1$ $\alpha_1=\pi/2+\delta_{RVa}-\beta_1$ $\delta_{RVb}+\pi/2+\alpha_2-(\beta_1-\pi)=2\pi$ $\alpha_2-\pi/2-\delta_{RVb}+\beta_1$ With reference to FIG. 34, for a clockwise turn, the initial conditions are:

$\pi \leq \delta_{RVa} < 3\pi/2$ $3\pi/2 \leq \delta_{RVb} < \pi$ and the solutions are:

$\pi/2+\delta_{RVa}=\alpha_1=\beta_1$ $\alpha_1=\pi/2+\delta_{RVa}-\beta_1$ $\delta_{RVb}+\pi/2-(\beta_1-\pi-\alpha_2)=2\pi$ $\alpha_2-\pi/2-\delta_{RVb}+\beta_1$ With reference to FIG. 35, for a clockwise turn, the initial conditions are:

$\pi \leq \delta_{RVa} < 3\pi/2$ $0 \leq \delta_{RVb} < \pi/2$ and the solutions are:

$\delta_{RVa}+\pi/2=\beta_1+\alpha_1$ $\alpha_1=-\pi/2+\delta_{RVa}-\beta_1$ $\delta_{RVb}+\pi/2+\alpha_2=\beta_1-\pi$ $\alpha_2=-(3\pi/2+\delta_{RVb}-\beta_1)$ With reference to FIG. 36, for a clockwise turn, the initial conditions are:

$\pi \leq \delta_{RVa} < 3\pi/2$ $\pi/2 \leq \delta_{RVb} < \pi$ and the solutions are:

$\delta_{RVa}+\pi/2+\alpha_1-\beta_1=2\pi$ $\alpha_1=3\pi/2-\delta_{RVa}+\beta_1$ $\delta_{RVb}+\pi/2=\beta_1+\pi+\alpha_2$ $\alpha_2=-(\pi/2-\delta_{RVb}+\beta_1)$ With reference to FIG. 37, for a clockwise turn, the initial conditions are:

$3\pi/2 \leq \delta_{RVa} < 2\pi$ $3\pi/2 \leq \delta_{RVb} < 2\pi$ and the solutions are:

$\beta_1+\delta_{RVa}=\pi/2-\alpha_1$ $\alpha_1=\pi/2+\delta_{RVa}-\beta_1$ $\delta_{RVb}+\pi/2+\alpha_2-(\beta_1-\pi)=2\pi$ $\alpha_2-\pi/2-\delta_{RVb}+\beta_1$ With reference to FIG. 38, for a clockwise turn, the initial conditions are:

$3\pi/2 \leq \delta_{RVa} < 2\pi$ $0 \leq \delta_{RVb} < \pi/2$ and the solutions are:

$\beta_1-\delta_{RVa}=\pi/2-\alpha_1$ $\alpha_1=\pi/2+\delta_{RVa}-\beta_1$ $\delta_{RVb}+\pi/2+\alpha_2=\beta_1-\pi$ $\alpha_2=-(3\pi/2+\delta_{RVb}-\beta_1)$ With reference to FIG. 39, for a clockwise turn, the initial conditions are:

$3\pi/2 \leq \delta_{RVa} < 2\pi$ $\pi/2 \leq \delta_{RVb} < \pi$ and the solutions are:

$\delta_{RVa}+\pi/2-\beta_1-\beta_1=2\pi$ $\alpha_1=-(3\pi/2-\delta_{RVa}+\beta_1)$ $\delta_{RVb}+\pi/2+\alpha_2-\beta_1-\pi$ $\alpha_2=\pi/2-\delta_{RVb}+\beta_1$ With reference to FIG. 40, for a clockwise turn, the initial conditions are:

$3\pi/2 \leq \delta_{RVa} < 2\pi$ $\pi \leq \delta_{RVb} < 3\pi/2$ and the solutions are:

$\delta_{RVa}+\pi/2+\alpha_1-\beta_1=2\pi$ $\alpha_1=3\pi/2-\delta_{RVa}+\beta_1$ $\beta_1+\pi+\alpha_2=\delta_{RVb}+\pi/2$ $\alpha_2=-(\pi/2-\delta_{RVb}+\beta_1)$ Table 6 below represents the conditions shown in FIGS. 25 through 40 as discussed above:

TABLE 6

| Clockwise Turn Cross-Reference: | | | | |
|---|---|---|---|---|
| | $0 \leq \delta_{RVb} < \pi/2$ | $\pi/2 \leq \delta_{RVb} < \pi$ | $\pi \leq \delta_{RVb} < 3\pi/2$ | $3\pi/2 \leq \delta_{RVb} < 2\pi$ |
| $0 \leq \delta_{RVa} < \pi/2$ | FIG. 25 | FIG. 26 | FIG. 27 | FIG. 28 |
| $\pi/2 \leq \delta_{RVa} < \pi$ | FIG. 32 | FIG. 29 | FIG. 30 | FIG. 31 |
| $\pi \leq \delta_{RVa} < 3\pi/2$ | FIG. 35 | FIG. 36 | FIG. 33 | FIG. 34 |
| $3\pi/2 \leq \delta_{RVa} < 2\pi$ | FIG. 38 | FIG. 39 | FIG. 40 | FIG. 37 |

Table 7 puts into matrix form expressions for $\alpha_1$ and $\alpha_2$ for each of the 16 combinations of the ranges of values for $\delta_{RVa}$ and $\delta_{RVb}$ in Table 6.

TABLE 7

| | $0 \le \delta_{RVb} < \pi/2$ | $\pi/2 \le \delta_{RVb} < \pi$ | $\pi \le \delta_{RVb} < 3\pi/2$ | $3\pi/2 \le \delta_{RVb} < 2\pi$ |
|---|---|---|---|---|
| $\alpha_{1_{m,n}}$ | | | | |
| $0 \le \delta_{RVa} < \pi/2$ | $\alpha_{1R_{1,1}} = \pi/2 + \delta_{RVa} - \beta_1$ | $\alpha_{1R_{1,2}} = \pi/2 + \delta_{RVa} - \beta_1$ | $\alpha_{1R_{1,3}} = \pi/2 + \delta_{RVa} - \beta_1$ | $\alpha_{1R_{1,4}} = -(\pi/2 + \delta_{RVa} - \beta_1)$ |
| $\pi/2 \le \delta_{RVa} < \pi$ | $\alpha_{1R_{2,1}} = -(\pi/2 + \delta_{RVa} - \beta_1)$ | $\alpha_{1R_{2,2}} = \pi/2 + \delta_{RVa} - \beta_1$ | $\alpha_{1R_{2,3}} = \pi/2 + \delta_{RVa} - \beta_1$ | $\alpha_{1R_{2,4}} = \pi/2 + \delta_{RVa} - \beta_1$ |
| $\pi \le \delta_{RVa} < 3\pi/2$ | $\alpha_{1R_{3,1}} = \pi/2 + \delta_{RVa} - \beta_1$ | $\alpha_{1R_{3,2}} = 3\pi/2 - \delta_{RVa} + \beta_1$ | $\alpha_{1R_{3,3}} = \pi/2 + \delta_{RVa} - \beta_1$ | $\alpha_{1R_{3,4}} = \pi/2 + \delta_{RVa} - \beta_1$ |
| $3\pi/2 \le \delta_{RVa} < 2\pi$ | $\alpha_{1R_{4,1}} = \pi/2 + \delta_{RVa} - \beta_1$ | $\alpha_{1R_{4,2}} = -(3\pi/2 - \delta_{RVa} + \beta_1)$ | $\alpha_{1R_{4,3}} = 3\pi/2 - \delta_{RVa} + \beta_1$ | $\alpha_{1R_{4,4}} = \pi/2 + \delta_{RVa} - \beta_1$ |
| $\alpha_{2_{m,n}}$ | | | | |
| $0 \le \delta_{RVa} < \pi/2$ | $\alpha_{2R_{1,1}} = \pi/2 - \delta_{RVb} + \beta_1$ | $\alpha_{2R_{1,2}} = \pi/2 - \delta_{RVb} + \beta_1$ | $\alpha_{2R_{1,3}} = \pi/2 - \delta_{RVb} + \beta_1$ | $\alpha_{2R_{1,4}} = -(\pi/2 - \delta_{RVb} + \beta_1)$ |
| $\pi/2 \le \delta_{RVa} < \pi$ | $\alpha_{2R_{2,1}} = 3\pi/2 + \delta_{RVb} - \beta_1$ | $\alpha_{2R_{2,2}} = \pi/2 - \delta_{RVb} + \beta_1$ | $\alpha_{2R_{2,3}} = \pi/2 - \delta_{RVb} + \beta_1$ | $\alpha_{2R_{2,4}} = \pi/2 - \delta_{RVb} + \beta_1$ |
| $\pi \le \delta_{RVa} < 3\pi/2$ | $\alpha_{2R_{3,1}} = -(3\pi/2 + \delta_{RVb} - \beta_1)$ | $\alpha_{2R_{3,2}} = -(\pi/2 - \delta_{RVb} + \beta_1)$ | $\alpha_{2R_{3,3}} = \pi/2 - \delta_{RVb} + \beta_1$ | $\alpha_{2R_{3,4}} = \pi/2 - \delta_{RVb} + \beta_1$ |
| $3\pi/2 \le \delta_{RVa} < 2\pi$ | $\alpha_{2R_{4,1}} = -(3\pi/2 + \delta_{RVb} - \beta_1)$ | $\alpha_{2R_{4,2}} = \pi/2 - \delta_{RVb} + \beta_1$ | $\alpha_{2R_{4,3}} = -(\pi/2 - \delta_{RVb} + \beta_1)$ | $\alpha_{2R_{4,4}} = \pi/2 - \delta_{RVb} + \beta_1$ |

where $$\beta_1 = \pi\left[\frac{\theta_{RVa} - \theta_{RVb} - \sigma}{|\theta_{RVa} - \theta_{RVb}| + \sigma} + 1\right] - \cos^{-1}\left(\frac{(\phi_{RVb} - \phi_{RVa})}{\sqrt{(\theta_{RVb} - \theta_{RVa})^2 \cos^2\phi_{RVb} + (\phi_{RVb} - \phi_{RVa})^2}}\right)\left[\frac{\theta_{RVa} - \theta_{RVb} - \sigma}{|\theta_{RVa} - \theta_{RVb}| + \sigma}\right]$$

and $\theta_{RVb}$=$RV_b$ longitude $\theta_{RVa}$=$RV_a$ longitude $\phi_{RVb}$=$RV_b$ latitude $\phi RV_a$=$RV_a$ latitude $\sigma$=a small constant added to the equation to prevent dividing by 0.

While the controller 22 is performing the calculations discussed herein, values for $\alpha_1$ and $\alpha_2$ are used in order to first determine angle $\alpha_3'$, which is essential for determining curve radius. Based on FIGS. 25 through 40, it is readily seen that:

$$\pi = \alpha_1 + \alpha_2 + \alpha_3$$

and solving for $\alpha_3$ yields:

$$\alpha_3 = \pi - (\alpha_1 + \alpha_2).$$

Table 8 below puts into matrix form expressions for $\alpha_3$ for each of the 16 combinations of the ranges of values for $\delta_{RVa}$ and $\delta_{RVb}$ in Table 6.

TABLE 8

| $\alpha_{3_{m,n}}$ | $0 \le \delta_{RVb} < \pi/2$ | $\pi/2 \le \delta_{RVb} < \pi$ | $\pi \le \delta_{RVb} < 3\pi/2$ | $3\pi/2 \le \delta_{RVb} < 2\pi$ |
|---|---|---|---|---|
| $0 \le \delta_{RVa} < \pi/2$ | $\alpha_{3R_{1,1}} = \delta_{RVb} - \delta_{RVa}$ | $\alpha_{3R_{1,1}} = \delta_{RVb} - \delta_{RVa}$ | $\alpha_{3R_{1,1}} = \delta_{RVb} - \delta_{RVa}$ | $\alpha_{3R_{1,1}} = 2\pi + \delta_{RVa} - \delta_{RVb}$ |
| $\pi/2 \le \delta_{RVa} < \pi$ | $\alpha_{3R_{1,1}} = \delta_{RVa} - \delta_{RVb}$ | $\alpha_{3R_{1,1}} = \delta_{RVb} - \delta_{RVa}$ | $\alpha_{3R_{1,1}} = \delta_{RVb} - \delta_{RVa}$ | $\alpha_{3R_{1,1}} = \delta_{RVb} - \delta_{RVa}$ |
| $\pi \le \delta_{RVa} < 3\pi/2$ | $\alpha_{3R_{1,1}} = 2\pi - \delta_{RVa} + \delta_{RVb}$ | $\alpha_{3R_{1,1}} = \delta_{RVa} - \delta_{RVb}$ | $\alpha_{3R_{1,1}} = \delta_{RVb} - \delta_{RVa}$ | $\alpha_{3R_{1,1}} = \delta_{RVb} - \delta_{RVa}$ |
| $3\pi/2 \le \delta_{RVa} < 2\pi$ | $\alpha_{3R_{1,1}} = 2\pi - \delta_{RVa} + \delta_{RVb}$ | $\alpha_{3R_{1,1}} = 2\pi - \delta_{RVa} + \delta_{RVb}$ | $\alpha_{3R_{1,1}} = \delta_{RVa} - \delta_{RVb}$ | $\alpha_{3R_{1,1}} = \delta_{RVb} - \delta_{RVa}$ |

It can be appreciated from FIGS. 28, 32, 36 and 40 that the angle $\alpha_3'$ rather than $\alpha_3$ is needed to calculate the radius of curvature, R therefore a new variable, $\alpha_3'$ is defined which under most cases is equal to $\alpha_3$ thus:

$$\alpha_3'=\alpha_3=\pi-(\alpha_1+\alpha_2).$$

However, for the cases illustrated in FIGS. 28, 32, 36 and 40:

$$\alpha_3'=2\pi-\alpha_3$$

$$\alpha_3'=2\pi-(\pi_1+\alpha_2))$$

$$\alpha_3'=\pi+(\alpha_1+\alpha_2)$$

Table 9 below puts into matrix form expressions for $\alpha_3'$ for each of the 16 combinations of the ranges of values for $\delta_{HV}$ and $\delta_{RV}$ defined in Table 6.

TABLE 9

| $\alpha'_{3_{m,n}}$ | $0 \le \delta_{RVb} < \pi/2$ | $\pi/2 \le \delta_{RVb} < \pi$ | $\pi \le \delta_{RVb} < 3\pi/2$ | $3\pi/2 \le \delta_{RVb} < 2\pi$ |
|---|---|---|---|---|
| $0 \le \delta_{RVa} < \pi/2$ | $\alpha'_{3R_{1,1}} = \delta_{RVb} - \delta_{RVa}$ | $\alpha'_{3R_{1,2}} = \delta_{RVb} - \delta_{RVa}$ | $\alpha'_{3R_{1,3}} = \delta_{RVb} - \delta_{RVa}$ | $\alpha'_{3R_{1,4}} = \delta_{RVb} - \delta_{RVa}$ |
| $\pi/2 \le \delta_{RVa} < \pi$ | $\alpha'_{3R_{2,1}} = 2\pi + \delta_{RVb} - \delta_{RVa}$ | $\alpha'_{3R_{2,2}} = \delta_{RVb} - \delta_{RVa}$ | $\alpha'_{3R_{2,3}} = \delta_{RVb} - \delta_{RVa}$ | $\alpha'_{3R_{2,4}} = \delta_{RVb} - \delta_{RVa}$ |
| $\pi \le \delta_{RVa} < 3\pi/2$ | $\alpha'_{3R_{3,1}} = 2\pi + \delta_{RVb} - \delta_{RVa}$ | $\alpha'_{3R_{3,2}} = 2\pi + \delta_{RVb} - \delta_{RVa}$ | $\alpha'_{3R_{3,3}} = \delta_{RVb} - \delta_{RVa}$ | $\alpha'_{3R_{3,4}} = \delta_{RVb} - \delta_{RVa}$ |
| $3\pi/2 \le \delta_{RVa} < 2\pi$ | $\alpha'_{3R_{4,1}} = 2\pi + \delta_{RVb} - \delta_{RVa}$ | $\alpha'_{3R_{4,2}} = 2\pi + \delta_{RVb} - \delta_{RVa}$ | $\alpha'_{3R_{4,3}} = 2\pi + \delta_{RVb} - \delta_{RVa}$ | $\alpha'_{3R_{4,4}} = \delta_{RVb} - \delta_{RVa}$ |

The controller 22 can perform, for example, the following mathematical process to determine $\alpha_{1_{m,n}}$, $\alpha_{2_{m,n}}$ and $\alpha_{3_{m,n}}'$. The $\alpha_{1L_{m,n}}$, $\alpha_{2L_{m,n}}$, $\alpha_{3L_{m,n}}'$, $\alpha_{1R_{m,n}}$, $\alpha_{2R_{m,n}}$ and $\alpha_{3R_{m,n}}'$ matrices provide 16 different values for each angle however, it is desirable to have a single equation for each angle which can be obtained as follows. First, the controller 22 can define the following expressions:

$$H_1 = \frac{1}{4}\left[\frac{\delta_{RVa} - 0 + \sigma}{|\delta_{RVa} - 0| + \sigma} + 1\right] \times \left[\frac{0.5\pi - \delta_{RVa} - \sigma}{|0.5\pi - \delta_{RVa}| + \sigma} + 1\right]$$

$$R_1 = \frac{1}{4}\left[\frac{\delta_{RVb} - 0 + \sigma}{|\delta_{RVb} - 0| + \sigma} + 1\right] \times \left[\frac{0.5\pi - \delta_{RVb} - \sigma}{|0.5\pi - \delta_{RVb}| + \sigma} + 1\right]$$

$$H_2 = \frac{1}{4}\left[\frac{\delta_{RVa} - 0.5\pi + \sigma}{|\delta_{RVa} - 0.5\pi| + \sigma} + 1\right] \times \left[\frac{\pi - \delta_{RVa} - \sigma}{|\pi - \delta_{RVa}| + \sigma} + 1\right]$$

$$R_2 = \frac{1}{4}\left[\frac{\delta_{RVb} - 0.5\pi + \sigma}{|\delta_{RVb} - 0.5\pi| + \sigma} + 1\right] \times \left[\frac{\pi - \delta_{RVb} - \sigma}{|\pi - \delta_{RVb}| + \sigma} + 1\right]$$

$$H_3 = \frac{1}{4}\left[\frac{\delta_{RVa} - \pi + \sigma}{|\delta_{RVa} - \pi| + \sigma} + 1\right] \times \left[\frac{1.5\pi - \delta_{RVa} - \sigma}{|1.5\pi - \delta_{RVa}| + \sigma} + 1\right]$$

$$R_3 = \frac{1}{4}\left[\frac{\delta_{RVb} - \pi + \sigma}{|\delta_{RVb} - \pi| + \sigma} + 1\right] \times \left[\frac{1.5\pi - \delta_{RVb} - \sigma}{|1.5\pi - \delta_{RVb}| + \sigma} + 1\right]$$

-continued $$H_4 = \frac{1}{4}\left[\frac{\delta_{RVa} - 1.5\pi + \sigma}{|\delta_{RVa} - 1.5\pi| + \sigma} + 1\right] \times \left[\frac{2\pi - \delta_{RVa} - \sigma}{|2\pi - \delta_{RVa}| + \sigma} + 1\right]$$

$$R_4 = \frac{1}{4}\left[\frac{\delta_{RVb} - 1.5\pi + \sigma}{|\delta_{RVb} - 1.5\pi| + \sigma} + 1\right] \times \left[\frac{2\pi - \delta_{RVb} - \sigma}{|2\pi - \delta_{RVb}| + \sigma} + 1\right]$$

The controller 22 can use these expressions to form the F Matrix as shown in Table 10 below.

TABLE 10

| $F_{m,n}$ | $R_1$ | $R_2$ | $R_3$ | $R_4$ |
|---|---|---|---|---|
| $H_1$ | $F_{1,1} = H_1 \times R_1$ | $F_{1,2} = H_1 \times R_2$ | $F_{1,3} = H_1 \times R_3$ | $F_{1,4} = H_1 \times R_4$ |
| $H_2$ | $F_{2,1} = H_2 \times R_1$ | $F_{2,2} = H_2 \times R_2$ | $F_{2,3} = H_2 \times R_3$ | $F_{2,4} = H_2 \times R_4$ |
| $H_3$ | $F_{3,1} = H_3 \times R_1$ | $F_{2,3} = H_2 \times R_3$ | $F_{3,3} = H_3 \times R_3$ | $F_{3,4} = H_3 \times R_4$ |
| $H_4$ | $F_{4,1} = H_4 \times R_1$ | $F_{4,2} = H_4 \times R_2$ | $F_{4,3} = H_4 \times R_3$ | $F_{4,4} = H_4 \times R_4$ |

The controller 22 can then use the F Matrix to filter out all but the relevant values for $\alpha_{1L}$ and $\alpha_{1R}$ in the following matrix in Table 11 below:

TABLE 11

| $\alpha_1$ | Counter-Clockwise Turn, $\alpha_{1L_{m,n}}$ | | | | Clockwise Turn, $\alpha_{1R_{m,n}}$ | | | |
|---|---|---|---|---|---|---|---|---|
| | $\alpha_{1L_{1,1}} \times F_{1,1}$ | $\alpha_{1L_{1,2}} \times F_{1,2}$ | $\alpha_{1L_{1,3}} \times F_{1,3}$ | $\alpha_{1L_{1,4}} \times F_{1,4}$ | $\alpha_{1R_{1,1}} \times F_{1,1}$ | $\alpha_{1R_{1,2}} \times F_{1,2}$ | $\alpha_{1R_{1,3}} \times F_{1,3}$ | $\alpha_{1R_{1,4}} \times F_{1,4}$ |
| | $\alpha_{1L_{2,1}} \times F_{2,1}$ | $\alpha_{1L_{2,2}} \times F_{2,2}$ | $\alpha_{1L_{2,3}} \times F_{2,3}$ | $\alpha_{1L_{2,4}} \times F_{2,4}$ | $\alpha_{1R_{2,1}} \times F_{2,1}$ | $\alpha_{1R_{2,2}} \times F_{2,2}$ | $\alpha_{1R_{2,3}} \times F_{2,3}$ | $\alpha_{1R_{2,4}} \times F_{2,4}$ |
| | $\alpha_{1L_{3,1}} \times F_{3,1}$ | $\alpha_{1L_{3,2}} \times F_{3,2}$ | $\alpha_{1L_{3,3}} \times F_{3,3}$ | $\alpha_{1L_{3,4}} \times F_{3,4}$ | $\alpha_{1R_{3,1}} \times F_{3,1}$ | $\alpha_{1R_{3,2}} \times F_{3,2}$ | $\alpha_{1R_{3,3}} \times F_{3,3}$ | $\alpha_{1R_{3,4}} \times F_{3,4}$ |
| | $\alpha_{1L_{4,1}} \times F_{4,1}$ | $\alpha_{1L_{4,2}} \times F_{4,2}$ | $\alpha_{1L_{4,3}} \times F_{4,3}$ | $\alpha_{1L_{4,4}} \times F_{4,4}$ | $\alpha_{1R_{4,1}} \times F_{4,1}$ | $\alpha_{1R_{4,2}} \times F_{4,2}$ | $\alpha_{1R_{4,3}} \times F_{4,3}$ | $\alpha_{1R_{4,4}} \times F_{4,4}$ |

using, for example, the following equations:

$$\alpha_{1L} = \sum_{n=1}^{4}\sum_{m=1}^{4} \alpha_{1L_{m,n}} \times F_{m,n} \text{ and } \alpha_{1R} = \sum_{n=1}^{4}\sum_{m=1}^{4} \alpha_{1R_{m,n}} \times F_{m,n}.$$

The controller 22 can perform similar operations to obtain the relevant values for $\alpha_{2L}$ and $\alpha_{2R}$ in the following matrix in Table 12 below:

TABLE 12

| $\alpha_2$ | Counter-Clockwise Turn, $\alpha_{2L_{m,n}}$ | | | | Clockwise Turn, $\alpha_{2R_{m,n}}$ | | | |
|---|---|---|---|---|---|---|---|---|
| $\alpha_{2L_{1,1}} \times F_{1,1}$ | $\alpha_{2L_{1,2}} \times F_{1,2}$ | $\alpha_{2L_{1,3}} \times F_{1,3}$ | $\alpha_{2L_{1,4}} \times F_{1,4}$ | $\alpha_{2R_{1,1}} \times F_{1,1}$ | $\alpha_{2R_{1,2}} \times F_{1,2}$ | $\alpha_{2R_{1,3}} \times F_{1,3}$ | $\alpha_{2R_{1,4}} \times F_{1,4}$ |
| $\alpha_{2L_{2,1}} \times F_{2,1}$ | $\alpha_{2L_{2,2}} \times F_{2,2}$ | $\alpha_{2L_{2,3}} \times F_{2,3}$ | $\alpha_{2L_{2,4}} \times F_{2,4}$ | $\alpha_{2R_{2,1}} \times F_{2,1}$ | $\alpha_{2R_{2,2}} \times F_{2,2}$ | $\alpha_{2R_{2,3}} \times F_{2,3}$ | $\alpha_{2R_{2,4}} \times F_{2,4}$ |
| $\alpha_{2L_{3,1}} \times F_{3,1}$ | $\alpha_{2L_{3,2}} \times F_{3,2}$ | $\alpha_{2L_{3,3}} \times F_{3,3}$ | $\alpha_{2L_{3,4}} \times F_{3,4}$ | $\alpha_{2R_{3,1}} \times F_{3,1}$ | $\alpha_{2R_{3,2}} \times F_{3,2}$ | $\alpha_{2R_{3,3}} \times F_{3,3}$ | $\alpha_{2R_{3,4}} \times F_{3,4}$ |
| $\alpha_{2L_{4,1}} \times F_{4,1}$ | $\alpha_{2L_{4,2}} \times F_{4,2}$ | $\alpha_{2L_{4,3}} \times F_{4,3}$ | $\alpha_{2L_{4,4}} \times F_{4,4}$ | $\alpha_{2R_{4,1}} \times F_{4,1}$ | $\alpha_{2R_{4,2}} \times F_{4,2}$ | $\alpha_{2R_{4,3}} \times F_{4,3}$ | $\alpha_{2R_{4,4}} \times F_{4,4}$ |

using, for example, the following equations:

$$\alpha_{2L} = \sum_{n=1}^{4}\sum_{m=1}^{4} \alpha_{2L_{m,n}} \times F_{m,n} \text{ and } \alpha_{2R} = \sum_{n=1}^{4}\sum_{m=1}^{4} \alpha_{2R_{m,n}} \times F_{m,n}.$$

The controller 22 can perform similar calculations to obtain the relevant values for $\alpha_{3L}'$ and $\alpha_{3R}'$, in the following matrix in Table 13 blow:

TABLE 13

| $\alpha'_3$ | Counter-Clockwise Turn, $\alpha'_{3L_{m,n}}$ | | | | Clockwise Turn, $\alpha'_{3R_{m,n}}$ | | | |
|---|---|---|---|---|---|---|---|---|
| $\alpha'_{3L_{1,1}} \times F_{1,1}$ | $\alpha'_{3L_{1,2}} \times F_{1,2}$ | $\alpha'_{3L_{1,3}} \times F_{1,3}$ | $\alpha'_{3L_{1,4}} \times F_{1,4}$ | $\alpha'_{3R_{1,1}} \times F_{1,1}$ | $\alpha'_{3R_{1,2}} \times F_{1,2}$ | $\alpha'_{3R_{1,3}} \times F_{1,3}$ | $\alpha'_{3R_{1,4}} \times F_{1,4}$ |
| $\alpha'_{3L_{2,1}} \times F_{2,1}$ | $\alpha'_{3L_{2,2}} \times F_{2,2}$ | $\alpha'_{3L_{2,3}} \times F_{2,3}$ | $\alpha'_{3L_{2,4}} \times F_{2,4}$ | $\alpha'_{3R_{2,1}} \times F_{2,1}$ | $\alpha'_{3R_{2,2}} \times F_{2,2}$ | $\alpha'_{3R_{2,3}} \times F_{2,3}$ | $\alpha'_{3R_{2,4}} \times F_{2,4}$ |
| $\alpha'_{3L_{3,1}} \times F_{3,1}$ | $\alpha'_{3L_{3,2}} \times F_{3,2}$ | $\alpha'_{3L_{3,3}} \times F_{3,3}$ | $\alpha'_{3L_{3,4}} \times F_{3,4}$ | $\alpha'_{3R_{3,1}} \times F_{3,1}$ | $\alpha'_{3R_{3,2}} \times F_{3,2}$ | $\alpha'_{3R_{3,3}} \times F_{3,3}$ | $\alpha'_{3R_{3,4}} \times F_{3,4}$ |
| $\alpha'_{3L_{4,1}} \times F_{4,1}$ | $\alpha'_{3L_{4,2}} \times F_{4,2}$ | $\alpha'_{3L_{4,3}} \times F_{4,3}$ | $\alpha'_{3L_{4,4}} \times F_{4,4}$ | $\alpha'_{3R_{4,1}} \times F_{4,1}$ | $\alpha'_{3R_{4,2}} \times F_{4,2}$ | $\alpha'_{3R_{4,3}} \times F_{4,3}$ | $\alpha'_{3R_{4,4}} \times F_{4,4}$ |

using, for example, the equations $$\alpha'_{3L} = \sum_{n=1}^{4}\sum_{m=1}^{4} \alpha'_{3L_{m,n}} \times F_{m,n} \text{ and } \alpha'_{3R} = \sum_{n=1}^{4}\sum_{m=1}^{4} \alpha'_{3R_{m,n}} \times F_{m,n}.$$

The matrices for $\alpha_1$, $\alpha_2$ and $\alpha_3'$ above produce two values, one for counter-clockwise turns and one for clockwise turns. The controller 22 can perform the following calculations to determine which values are relevant.

Two operators, L and R, are defined as follows:

$$L_{m,n} = \frac{1}{4}\left[\frac{\alpha'_{3L_{m,n}} \times F_{m,n} - 0 - \sigma}{\left|\alpha'_{3L_{m,n}} \times F_{m,n} - 0\right| + \sigma} + 1\right] \times \left[\frac{\pi - \alpha'_{3L_{m,n}} \times F_{m,n} - \sigma}{\left|\pi - \alpha'_{3L_{m,n}} \times F_{m,n}\right| + \sigma} + 1\right]$$

$$R_{1,1} = \frac{1}{4}\left[\frac{\alpha'_{3R_{m,n}} \times F_{m,n} - 0 - \sigma}{\left|\alpha'_{3R_{m,n}} \times F_{m,n} - 0\right| + \sigma} + 1\right] \times \left[\frac{\pi - \alpha'_{3R_{m,n}} \times F_{m,n} - \sigma}{\left|\pi - \alpha'_{3R_{m,n}} \times F_{m,n}\right| + \sigma} + 1\right] \text{ with}$$

-continued $$L = \sum_{n=1}^{4}\sum_{m=1}^{4} L_{m,n} \text{ and } R = \sum_{n=1}^{4}\sum_{m=1}^{4} R_{m,n}.$$

Whichever one of the above equations for L and R equals 1 defines the direction of the turn. Thus, if L=1, the remote vehicle 14 is in a counter-clockwise turn around the traffic circle 40. However, if R=1, the remote vehicle 14 is travelling in a clockwise turn around the traffic circle 40. The controller 22 of the traffic circle identification system 12 can thus easily determine if a remote vehicle 14 is traveling around the traffic circle 40 in the wrong direction. For example, if R=1 for any traffic circle in North America, the traffic circle identification system 12 onboard the host vehicle 10 can immediately provide a warning to the driver to be aware of a remote vehicle 14 traveling the wrong way in the approaching traffic circle 40. As can be appreciated from FIG. 2, such as warning can be a displayed warning on the screen display 32A, an audio warning via the audio speaker 32B, a tactile warning, or any other suitable type of warning as understood in the art.

In addition, the controller 22 can define angles $\alpha_1$, $\alpha_2$ and $a'_3$ are then defined as follows:

$$\alpha_1 = L \times \sum_{n=1}^{4}\sum_{m=1}^{4} \alpha_{1L_{m,n}} \times F_{m,n} + R \times \sum_{n=1}^{4}\sum_{m=1}^{4} \alpha_{1R_{m,n}} \times F_{m,n}$$

$$\alpha_2 = L \times \sum_{n=1}^{4}\sum_{m=1}^{4} \alpha_{2L_{m,n}} \times F_{m,n} + R \times \sum_{n=1}^{4}\sum_{m=1}^{4} \alpha_{2R_{m,n}} \times F_{m,n}$$

$$\alpha'_3 = L \times \sum_{n=1}^{4}\sum_{m=1}^{4} \alpha'_{3L_{m,n}} \times F_{m,n} + R \times \sum_{n=1}^{4}\sum_{m=1}^{4} \alpha'_{3R_{m,n}} \times F_{m,n}$$

and can employ the Law of Sines to obtain expressions for R.

$$\frac{R_1}{\sin\alpha_1} = \frac{D}{|\sin\alpha_3'|}$$

$$R_1 = D\frac{\sin\alpha_1}{|\sin\alpha_3'|} \text{ or}$$

$$\frac{R_2}{\sin\alpha_2} = \frac{D}{|\sin\alpha_3'|}$$

$$R_2 = D\frac{\sin\alpha_2}{|\sin\alpha_3'|} \text{ where}$$

$$D = (1-f)r_e\sqrt{\frac{(\theta_{RVb}-\theta_{RVa})^2\cos^2\phi_{RVa}+(\phi_{RVb}-\phi_{RVa})^2}{\sin^2\phi_{RVa}+(1-f)^2\cos^2\phi_{RVa}}}$$

The controller 22 can compare $R_1$ and $R_2$ to assess the quality of the calculated radius of curvature of the traffic circle 40. However, since the two values should be nearly equal, the controller 22 can determine that a significant difference between the values $R_1$ and $R_2$ indicate low reliability in the values and thus, the values should not be trusted.

Thus, using the above calculations in Step 102 in the flowchart of FIG. 8, the traffic circle identification system 12 can determine in Step 104 whether or not a traffic circle 40 is present in the path along which the host vehicle 10 is travelling. If so, the traffic circle identification system 12 can provide an indication in Step 106 that the host vehicle 10 is approaching the traffic circle 40. Such as indication can be a display of the traffic circle 40 on a map display that is being displayed on the screen display 32A shown in FIG. 2. The indication can also represent the diameter of the traffic circle 40. The traffic circle identification system 12 can also provide an audio indication of the approaching circle via the audio speaker 32B, a tactile indication, or any other suitable type of warning. However, if the traffic circle identification system 12 determines in Step 104 that no traffic circle 40 is present, the traffic circle identification system 12 can provide an indication that the host vehicle 10 is not approaching a traffic circle 40. The indication can be, for example, refraining from providing a warning of an approaching traffic circle 40, as well as a display of the map data on the screen display 32A indicating that the path along which the host vehicle 10 is travelling does not include a traffic circle 40 in proximity to the location of the host vehicle 10.

Moreover, as can be appreciated from the above, the controller 22 can determine from the above calculations the location of the traffic circle 40 relative to the location of the host vehicle 10 at a predetermined time when the controller 22 determines that the traffic circle 40 exists. Also, since the controller 22 is determining a movement characteristic of the remote vehicle 14 in the traffic circle 40 when the controller 22 determines that the traffic circle exists, the controller 22 can control the warning system onboard the host vehicle 10 to issue a warning based on the movement characteristic of the remote vehicle 14 relative to the host vehicle 10, if appropriate. For instance, the controller 22 can control the warning system to issue a warning upon determining that the direction of movement the remote vehicle 14 in the traffic circle 40 is opposite to a direction of movement of the host vehicle 10 in the traffic circle 40 as discussed above. The controller 22 can control the warning system to issue a warning upon determining that the distance of the remote vehicle 14 in the traffic circle 40 from the host vehicle 10 is decreasing.

Figure 41:
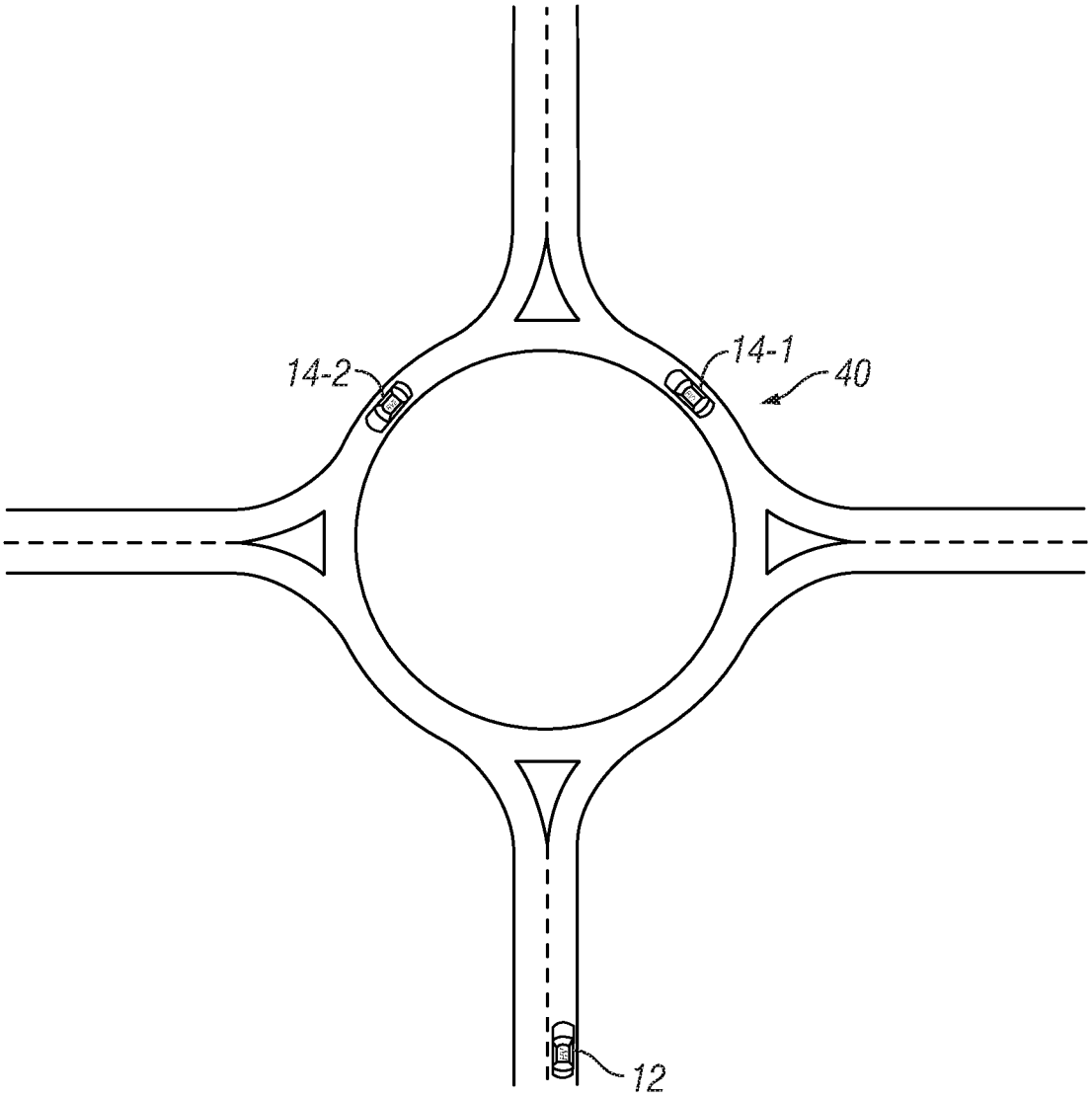
FIG. 41 is a diagrammatic view illustrating a condition in which two remote vehicles pass through the traffic circle and are in quadrant 1 and quadrant 2 of the traffic circle.
Figure 42:
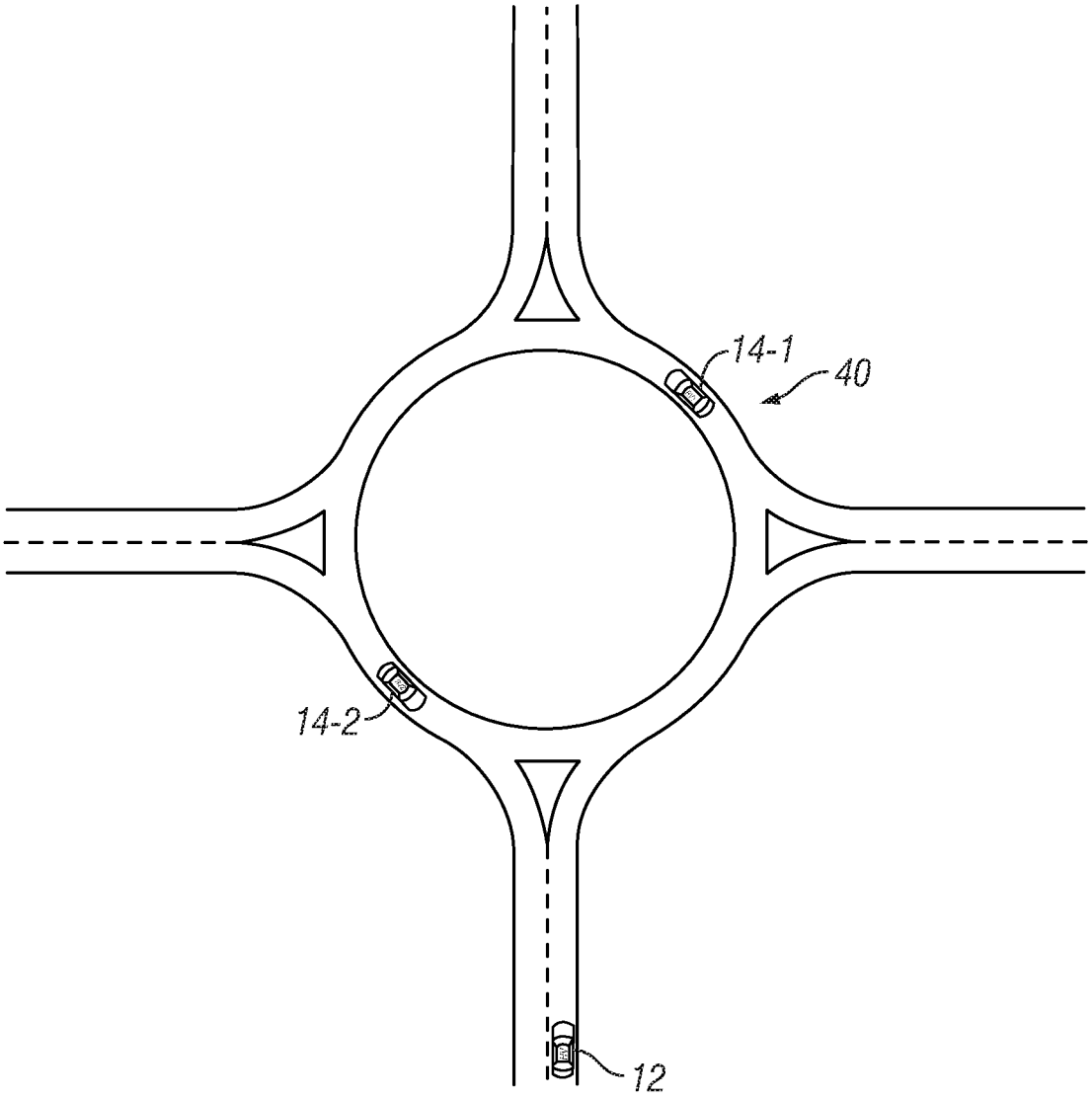
FIG. 42 is a diagrammatic view illustrating a condition in which two remote vehicles pass through the traffic circle and are in quadrant 1 and quadrant 3 of the traffic circle.
Figure 43:
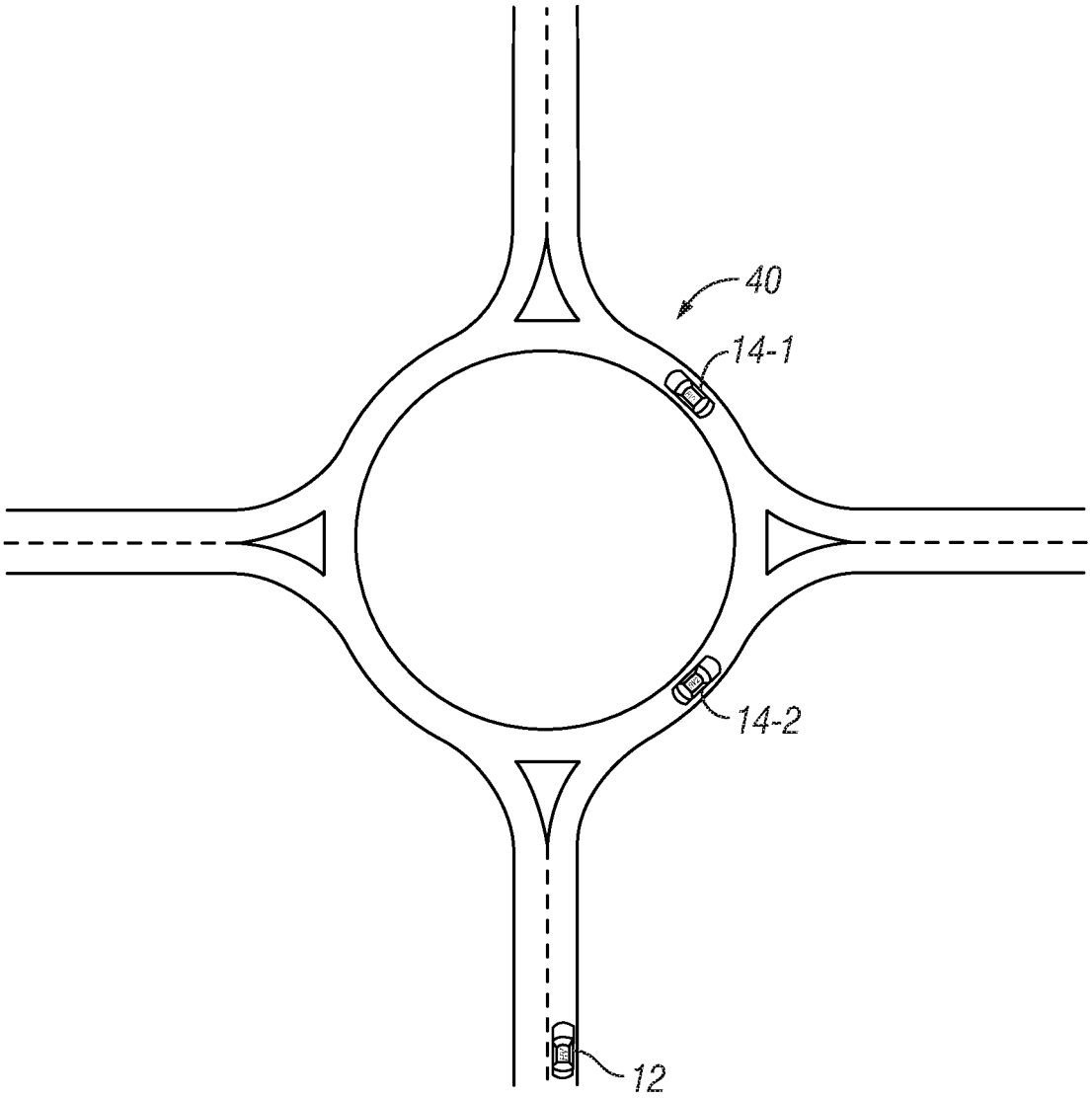
FIG. 43 is a diagrammatic view illustrating a condition in which two remote vehicles pass through the traffic circle and are in quadrant 1 and quadrant 4 of the traffic circle.

The following description pertains to exemplary calculations that can be performed by the controller 22 of the traffic circle identification system 12 based on remote vehicle information received from a plurality of remote vehicles 14-1 and 14-2 as shown, for example, in FIGS. 41 through 43. FIG. 41 shows two remote vehicles 14-1 and 14-2 passing through the traffic circle 40 in quadrant 1 and quadrant 2 of the traffic circle 40. FIG. 42 shows two remote vehicles 14-1 and 14-2 passing through the traffic circle 40 in quadrant 1 and quadrant 3 of the traffic circle 40. FIG. 43 shows two remote vehicles 14-1 and 14-2 passing through the traffic circle in quadrant 1 and quadrant 4 of the traffic circle 40.

When multiple remote vehicles 14-1 and 14-2 are present in the traffic circle 40 as shown in the FIGS. 41 through 43, the traffic circle identification system 12 onboard the host vehicle 10 can collect remote vehicle information sufficient to determine that the traffic circle 40 exits, and also the diameter of the traffic circle 40, without having to collect data over a period of time. In other words, the traffic circle identification system 12 can use remote vehicle information received from remote vehicles 14-1 and 14-2 at the same time. The same process discussed above with regard to FIGS. 8 through 40 for a single remote vehicle 14 can be used, but with remote information from multiple remote vehicles 14-1 and 14-2. As one non-limiting example, if controller 22 identifies each remote vehicle 14-1 and 14-2 travels a different 5 degree or greater portion of the traffic circle, these paths and their relationship to each other in space will allow the traffic circle identification system 12 to confirm the traffic circle exists. On the other hand, if controller 22 identifies one of remote vehicles 14-1 and 14-2 has traveled a less than κ degree portion of the traffic circle, the traffic circle identification system 12 cannot confirm the traffic circle exists. As a second non-limiting example, if controller 22 identifies three or more remote vehicles, their GPS positions and their headings, this information collected at a single point in time will also allow the traffic circle identification system 12 to confirm the traffic circle exists.

As with the process for a single remote vehicle 14 discussed above, the traffic circle identification system 12 stores the remote vehicle information, including respective GPS position heading and speed information, received from each of the remote vehicles 14-1 and 14-2. The software being run by the controller 22 can include, for example, a software application onboard the host vehicle 10 to use this remote vehicle information to calculate the radius of curvature for the paths of the remote vehicles 14-1 and 14-2 according to the following process.

As shown in FIGS. 41 through 43, the remote vehicles 14-1 and 14- are turning counter-clockwise in the traffic circle 40. As shown in Table 14 below, the controller 22 can put into matrix form expressions for $\alpha_1$ and $\alpha_2$ for each of the 16 combinations of the ranges of values for $\delta_{RV1}$ and $\delta_{RV2}$ as shown in Table 2 discussed above for the single remote vehicle situation.

TABLE 14

| | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $\alpha_{1_{m,n}}$ | | | | |
| $0 \le \delta_{RV1} < \pi/2$ | $\alpha_{1L_{1,1}} = \pi/2 - \delta_{RV1} + \beta_1$ | $\alpha_{1L_{1,2}} = 3\pi/2 + \delta_{RV1} - \beta_1$ | $\alpha_{1L_{1,3}} = -(3\pi/2 + \delta_{RV1} - \beta_1)$ | $\alpha_{1L_{1,4}} = \pi/2 - \delta_{RV1} + \beta_1$ |
| $\pi/2 \le \delta_{RV1} < \pi$ | $\alpha_{1L_{2,1}} = \pi/2 - \delta_{RV1} + \beta_1$ | $\alpha_{1L_{2,2}} = \pi/2 - \delta_{RV1} + \beta_1$ | $\alpha_{1L_{2,3}} = 3\pi/2 + \delta_{RV1} - \beta_1$ | $\alpha_{1L_{2,4}} = \pi/2 - \delta_{RV1} + \beta_1$ |
| $\pi \le \delta_{RV1} < 3\pi/2$ | $\alpha_{1L_{3,1}} = \pi/2 - \delta_{RV1} + \beta_1$ | $\alpha_{1L_{3,2}} = \pi/2 - \delta_{RV1} + \beta_1$ | $\alpha_{1L_{3,3}} = \pi/2 - \delta_{RV1} + \beta_1$ | $\alpha_{1L_{3,4}} = -(\pi/2 - \delta_{RV1} + \beta_1)$ |
| $3\pi/2 \le \delta_{RV1} < 2\pi$ | $\alpha_{1L_{4,1}} = -(\pi/2 - \delta_{RVa} + \beta_1)$ | $\alpha_{1L_{4,2}} = \pi/2 - \delta_{RV1} + \beta_1$ | $\alpha_{1L_{4,3}} = \pi/2 - \delta_{RV1} + \beta_1$ | $\alpha_{1L_{4,4}} = \pi/2 - \delta_{RV1} + \beta_1$ |
| $\alpha_{2_{m,n}}$ | | | | |
| $0 \le \delta_{RV1} < \pi/2$ | $\alpha_{2L_{1,1}} = \pi/2 + \delta_{RV2} - \beta_1$ | $\alpha_{2L_{1,2}} = -(\pi/2 + \delta_{RV2} - \beta_1)$ | $\alpha_{2L_{1,3}} = \pi/2 + \delta_{RV2} - \beta_1$ | $\alpha_{2L_{1,4}} = -(3\pi/2 - \delta_{RV2} + \beta_1)$ |
| $\pi/2 \le \delta_{RV1} < \pi$ | $\alpha_{2L_{2,1}} = \pi/2 + \delta_{RV2} - \beta_1$ | $\alpha_{2L_{2,2}} = \pi/2 + \delta_{RV2} - \beta_1$ | $\alpha_{2L_{2,3}} = -(\pi/2 + \delta_{RV2} - \beta_1)$ | $\alpha_{2L_{2,4}} = -(3\pi/2 - \delta_{RV2} + \beta_1)$ |
| $\pi \le \delta_{RV1} < 3\pi/2$ | $\alpha_{2L_{3,1}} = \pi/2 + \delta_{RV2} - \beta_1$ | $\alpha_{2L_{3,2}} = \pi/2 + \delta_{RV2} - \beta_1$ | $\alpha_{2L_{3,3}} = \pi/2 + \delta_{RV2} - \beta_1$ | $\alpha_{2L_{3,4}} = 3\pi/2 - \delta_{RV2} + \beta_1$ |
| $3\pi/2 \le \delta_{RV1} < 2\pi$ | $\alpha_{2L_{4,1}} = -(\pi/2 + \delta_{RV2} - \beta_1)$ | $\alpha_{2L_{4,2}} = \pi/2 + \delta_{RV2} - \beta_1$ | $\alpha_{2L_{4,3}} = \pi/2 + \delta_{RV2} - \beta_1$ | $\alpha_{2L_{4,4}} = \pi/2 + \delta_{RV2} - \beta_1$ |

where $$\beta_1 = \pi\left[\frac{\theta_{RV1} - \theta_{RV2} - \sigma}{|\theta_{RV1} - \theta_{RV2}| + \sigma} + 1\right] - \cos^{-1}\left(\frac{(\phi_{RV2} - \phi_{RV1})}{\sqrt{(\theta_{RV2} - \theta_{RV1})^2 \cos^2\phi_{RV2} + (\phi_{RV2} - \phi_{RV1})^2}}\right)\left[\frac{\theta_{RV1} - \theta_{RV2} - \sigma}{|\theta_{RV1} - \theta_{RV2}| + \sigma}\right]$$

and $\theta_{RVb}$=RV$_b$ longitude $\theta_{RVa}$=RV$_a$ longitude $\phi$RV$_b$=RVb latitude $\phi_{RVa}$=RV$_a$ latitude $\sigma$=a small constant added to the equation to prevent dividing by 0.

While the controller 22 is performing the calculations discussed herein, values for $\alpha_1$ and $\alpha_2$ are used in order to first determine angle $\alpha_3'$, which is essential for determining radius of curvature of the traffic circle 40. As can be appreciated from FIGS. 9 through 24, it is readily seen that:

$$\pi = \alpha_1 + \alpha_2 + \alpha_3$$

and solving for $\alpha_3$ yields:

$$\alpha_3 = \pi - (\alpha_1 + \alpha_2)$$

Table 15 below puts into matrix form expressions for $\alpha_3$ for each of the 16 combinations of the ranges of values for $\delta_{RV1}$ and $\alpha_{RV2}$.

TABLE 15

| $\alpha_{3_{m,n}}$ | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $0 \le \delta_{RV1} < \pi/2$ | $\alpha_{3L_{1,1}} = \delta_{RV1} - \delta_{RV2}$ | $\alpha_{3L_{1,2}} = \delta_{RV2} - \delta_{RV1}$ | $\alpha_{3L_{1,3}} = 2\pi + \delta_{RV1} - \delta_{RV2}$ | $\alpha_{3L_{1,4}} = 2\pi + \delta_{RV1} - \delta_{RV2}$ |
| $\pi/2 \le \delta_{RV1} < \pi$ | $\alpha_{3L_{2,1}} = \delta_{RV1} - \delta_{RV2}$ | $\alpha_{3L_{2,2}} = \delta_{RV1} - \delta_{RV2}$ | $\alpha_{3L_{2,3}} = \delta_{RV2} - \delta_{RV1}$ | $\alpha_{3L_{2,4}} = 2\pi + \delta_{RV1} - \delta_{RV2}$ |
| $\pi \le \delta_{RV1} < 3\pi/2$ | $\alpha_{3L_{3,1}} = \delta_{RV1} - \delta_{RV2}$ | $\alpha_{3L_{3,2}} = \delta_{RV1} - \delta_{RV2}$ | $\alpha_{3L_{3,3}} = \delta_{RV1} - \delta_{RV2}$ | $\alpha_{3L_{3,4}} = \delta_{RV2} - \delta_{RV1}$ |
| $3\pi/2 \le \delta_{RV1} < 2\pi$ | $\alpha_{3L_{4,1}} = 2\pi - \delta_{RV1} + \delta_{RV2}$ | $\alpha_{3L_{4,2}} = \delta_{RV1} - \delta_{RV2}$ | $\alpha_{3L_{4,3}} = \delta_{RV1} - \delta_{RV2}$ | $\alpha_{3L_{4,4}} = \delta_{RV1} - \delta_{RV2}$ |

However, it can be appreciated from FIGS. 12, 16, 20 and 24 that the angle $\alpha_3'$ rather than $\alpha_3$ is needed to calculate the curve radius, R therefore a new variable, $\alpha_3'$ is defined which in most cases is equal to $\alpha_3$ thus:

$$\alpha_3'=\alpha_3=\pi-(\alpha_1+\alpha_2).$$

However, for the cases illustrated in FIGS. 12, 16, 20 and 24:

$$\alpha_3'=2\pi-\alpha_3$$

$$\alpha_3'=2\pi-(\pi-(\alpha_1+\alpha_2))$$

$$\alpha_3'=\pi-(\alpha_1+\alpha_2).$$

Table 16 below puts into matrix form expressions for $a'_{3L}$ for each of the 16 combinations of the ranges of values for $\delta_{RV1}$, and $\delta_{RV2}$.

TABLE 16

| $\alpha'_{3_{m,n}}$ | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $0 \le \delta_{RV1} < \pi/2$ | $\alpha'_{3L_{1,1}} = \delta_{RV1} - \delta_{RV2}$ | $\alpha'_{3L_{1,2}} = 2\pi + \delta_{RV1} - \delta_{RV2}$ | $\alpha'_{3L_{1,3}} = 2\pi + \delta_{RV1} - \delta_{RV2}$ | $\alpha'_{3L_{1,4}} = 2\pi + \delta_{RV1} - \delta_{RV2}$ |
| $\pi/2 \le \delta_{RV1} < \pi$ | $\alpha'_{3L_{2,1}} = \delta_{RV1} - \delta_{RV2}$ | $\alpha'_{3L_{2,2}} = \delta_{RV1} - \delta_{RV2}$ | $\alpha'_{3L_{2,3}} = 2\pi + \delta_{RV1} - \delta_{RV2}$ | $\alpha'_{3L_{2,4}} = 2\pi + \delta_{RV1} - \delta_{RV2}$ |
| $\pi \le \delta_{RV1} < 3\pi/2$ | $\alpha'_{3L_{3,1}} = \delta_{RV1} - \delta_{RV2}$ | $\alpha'_{3L_{3,2}} = \delta_{RV1} - \delta_{RV2}$ | $\alpha'_{3L_{3,3}} = \delta_{RV1} - \delta_{RV2}$ | $\alpha'_{3L_{3,4}} = 2\pi + \delta_{RV1} - \delta_{RV2}$ |
| $3\pi/2 \le \delta_{RV1} < 2\pi$ | $\alpha'_{3L_{4,1}} = \delta_{RV1} - \delta_{RV2}$ | $\alpha'_{3L_{4,2}} = \delta_{RV1} - \delta_{RV2}$ | $\alpha'_{3L_{4,3}} = \delta_{RV1} - \delta_{RV2}$ | $\alpha'_{3L_{4,4}} = \delta_{RV1} - \delta_{RV2}$ |

For clockwise turns, Table 17 below put into matrix form expressions for $\alpha_1$ and $\alpha_2$ for each of the 16 combinations of the ranges of values for $\delta_{RV1}$ and $\delta_{RV2}$ in Table 6.

TABLE 17

| | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $\alpha_{1_{m,n}}$ | | | | |
| $0 \le \delta_{RV1} < \pi/2$ | $\alpha_{1R_{1,1}} = \pi/2 + \delta_{RV1} - \beta_1$ | $\alpha_{1R_{1,2}} = \pi/2 + \delta_{RV1} - \beta_1$ | $\alpha_{1R_{1,3}} = \pi/2 + \delta_{RV1} - \beta_1$ | $\alpha_{1R_{1,4}} = -(\pi/2 + \delta_{RV1} - \beta_1)$ |
| $\pi/2 \le \delta_{RV1} < \pi$ | $\alpha_{1R_{2,1}} = -(\pi/2 + \delta_{RV1} - \beta_1)$ | $\alpha_{1R_{2,2}} = \pi/2 + \delta_{RV1} - \beta_1$ | $\alpha_{1R_{2,3}} = \pi/2 + \delta_{RV1} - \beta_1$ | $\alpha_{1R_{2,4}} = \pi/2 + \delta_{RV1} - \beta_1$ |
| $\pi \le \delta_{RV1} < 3\pi/2$ | $\alpha_{1R_{3,1}} = \pi/2 + \delta_{RV1} - \beta_1$ | $\alpha_{1R_{3,2}} = 3\pi/2 - \delta_{RV1} + \beta_1$ | $\alpha_{1R_{3,3}} = \pi/2 + \delta_{RV1} - \beta_1$ | $\alpha_{1R_{3,4}} = \pi/2 + \delta_{RV1} - \beta_1$ |
| $3\pi/2 \le \delta_{RV1} < 2\pi$ | $\alpha_{1R_{4,1}} = \pi/2 + \delta_{RV1} - \beta_1$ | $\alpha_{1R_{4,2}} = -(3\pi/2 - \delta_{RV1} + \beta_1)$ | $\alpha_{1R_{4,3}} = 3\pi/2 - \delta_{RV1} + \beta_1$ | $\alpha_{1R_{4,4}} = \pi/2 + \delta_{RV1} - \beta_1$ |
| $\alpha_{2_{m,n}}$ | | | | |
| $0 \le \delta_{RV1} < \pi/2$ | $\alpha_{2R_{1,1}} = \pi/2 - \delta_{RV2} + \beta_1$ | $\alpha_{2R_{1,2}} = \pi/2 - \delta_{RV2} + \beta_1$ | $\alpha_{2R_{1,3}} = \pi/2 - \delta_{RV2} + \beta_1$ | $\alpha_{2R_{1,4}} = -(\pi/2 - \delta_{RV2} + \beta_1)$ |
| $\pi/2 \le \delta_{RV1} < \pi$ | $\alpha_{2R_{2,1}} = 3\pi/2 + \delta_{RV2} - \beta_1$ | $\alpha_{2R_{2,2}} = \pi/2 - \delta_{RV2} + \beta_1$ | $\alpha_{2R_{2,3}} = \pi/2 - \delta_{RV2} + \beta_1$ | $\alpha_{2R_{2,4}} = \pi/2 - \delta_{RV2} + \beta_1$ |
| $\pi \le \delta_{RV1} < 3\pi/2$ | $\alpha_{2R_{3,1}} = -(3\pi/2 + \delta_{RV2} - \beta_1)$ | $\alpha_{2R_{3,2}} = -(\pi/2 - \delta_{RV2} + \beta_1)$ | $\alpha_{2R_{3,3}} = \pi/2 - \delta_{RV2} + \beta_1$ | $\alpha_{2R_{3,4}} = \pi/2 - \delta_{RV2} + \beta_1$ |
| $3\pi/2 \le \delta_{RV1} < 2\pi$ | $\alpha_{2R_{4,1}} = -(3\pi/2 + \delta_{RV2} - \beta_1)$ | $\alpha_{2R_{4,2}} = \pi/2 - \delta_{RV2} + \beta_1$ | $\alpha_{2R_{4,3}} = -(\pi/2 - \delta_{RV2} + \beta_1)$ | $\alpha_{2R_{4,4}} = \pi/2 - \delta_{RV2} + \beta_1$ |

where $$\beta_1 = \pi\left[\frac{\theta_{RV1} - \theta_{RV2} - \sigma}{|\theta_{RV1} - \theta_{RV2}| + \sigma} + 1\right] - \cos^{-1}\left(\frac{(\phi_{RV2} - \phi_{RV1})}{\sqrt{(\theta_{RV2} - \theta_{RV1})^2\cos^2\phi_{RV2} + (\phi_{RV2} - \phi_{RV1})^2}}\right)\left[\frac{\theta_{RV1} - \theta_{RV2} - \sigma}{|\theta_{RV1} - \theta_{RV2}| + \sigma}\right]$$

and $\theta_{RV2}$=$RV_2$ longitude $\theta_{RV1}$=$RV_1$ longitude $\phi_{RV2}$=$RV_2$ latitude $\phi_{RV1}$=$RV_1$ latitude $\sigma$=a small constant added to the equation to prevent dividing by 0.

While the controller 22 is performing the calculations discussed herein, values for $\alpha_1$ and $\alpha_2$ are used in order to first determine angle $\alpha_3'$, which is essential for determining curve radius. As can be appreciated from FIGS. 25 through 40 it is readily seen that:

$$\pi=\alpha_1+\alpha_2+\alpha_3$$

and solving for $\alpha_3$ yields:

$$\alpha_3=\pi-(\alpha_1+\alpha_2)$$

Table 18 below puts into matrix form expressions for $\alpha_3$ for each of the 16 combinations of the ranges of values for $\delta_{HV}$ and $\delta_{RV}$ defined in Table 6.

TABLE 18

| $\alpha_{3_{m,n}}$ | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $0 \le \delta_{RV1} < \pi/2$ | $\alpha_{3R_{1,1}} = \delta_{RV2} - \delta_{RV1}$ | $\alpha_{3R_{1,1}} = \delta_{RV2} - \delta_{RV1}$ | $\alpha_{3R_{1,1}} = \delta_{RV2} - \delta_{RV1}$ | $\alpha_{3R_{1,1}} = 2\pi + \delta_{RV1} - \delta_{RV2}$ |
| $\pi/2 \le \delta_{RV1} < \pi$ | $\alpha_{3R_{1,1}} = \delta_{RV1} - \delta_{RV2}$ | $\alpha_{3R_{1,1}} = \delta_{RV2} - \delta_{RV1}$ | $\alpha_{3R_{1,1}} = \delta_{RV2} - \delta_{RV1}$ | $\alpha_{3R_{1,1}} = \delta_{RV2} - \delta_{RV1}$ |
| $\pi \le \delta_{RV1} < 3\pi/2$ | $\alpha_{3R_{1,1}} = 2\pi - \delta_{RV1} + \delta_{RV2}$ | $\alpha_{3R_{1,1}} = \delta_{RV1} - \delta_{RV2}$ | $\alpha_{3R_{1,1}} = \delta_{RV2} - \delta_{RV1}$ | $\alpha_{3R_{1,1}} = \delta_{RV2} - \delta_{RV1}$ |
| $3\pi/2 \le \delta_{RV1} < 2\pi$ | $\alpha_{3R_{1,1}} = 2\pi - \delta_{RV1} + \delta_{RV2}$ | $\alpha_{3R_{1,1}} = 2\pi - \delta_{RV1} + \delta_{RV2}$ | $\alpha_{3R_{1,1}} = \delta_{RV1} - \delta_{RV2}$ | $\alpha_{3R_{1,1}} = \delta_{RV2} - \delta_{RV1}$ |

However, it can be appreciated from FIGS. 28, 32, 36 and 40 that the angle $\alpha_3'$ rather than $\alpha_3$ is needed to calculate the radius of curvature, R therefore a new variable, $\alpha_3'$ is defined which under most cases is equal to $\alpha_3$ thus:

$$\alpha_3' = \alpha_3 = \pi - (\alpha_1 + \alpha_2)$$

However, for the cases illustrated in FIGS. 28, 32, 36 and 40:

$$\alpha_3' = 2\pi - \alpha_3$$

$$\alpha_3' = 2\pi - (\alpha_1 + \alpha_2))$$

$$\alpha_3' = \pi + (\alpha_1 + \alpha_2).$$

Table 19 below puts into matrix form expressions for $\alpha_3'$ for each of the 16 combinations of the ranges of values for $\delta_{HV}$ and $\delta_{RV}$ defined in Table 6.

TABLE 19

| $\alpha'_{3_{m,n}}$ | $0 \le \delta_{RV2} < \pi/2$ | $\pi/2 \le \delta_{RV2} < \pi$ | $\pi \le \delta_{RV2} < 3\pi/2$ | $3\pi/2 \le \delta_{RV2} < 2\pi$ |
|---|---|---|---|---|
| $0 \le \delta_{RV1} < \pi/2$ | $\alpha'_{3R_{1,1}} = \delta_{RV2} - \delta_{RV1}$ | $\alpha'_{3R_{1,2}} = \delta_{RV2} - \delta_{RV1}$ | $\alpha'_{3R_{1,3}} = \delta_{RV2} - \delta_{RV1}$ | $\alpha'_{3R_{1,4}} = \delta_{RV2} - \delta_{RV1}$ |
| $\pi/2 \le \delta_{RV1} < \pi$ | $\alpha'_{3R_{2,1}} = 2\pi + \delta_{RV2} - \delta_{RV1}$ | $\alpha'_{3R_{2,2}} = \delta_{RV2} - \delta_{RV1}$ | $\alpha'_{3R_{2,3}} = \delta_{RV2} - \delta_{RV1}$ | $\alpha'_{3R_{2,4}} = \delta_{RV2} - \delta_{RV1}$ |
| $\pi \le \delta_{RV1} < 3\pi/2$ | $\alpha'_{3R_{3,1}} = 2\pi + \delta_{RV2} - \delta_{RV1}$ | $\alpha'_{3R_{3,2}} = 2\pi + \delta_{RV2} - \delta_{RV1}$ | $\alpha'_{3R_{3,3}} = \delta_{RV2} - \delta_{RV1}$ | $\alpha'_{3R_{3,4}} = \delta_{RV2} - \delta_{RV1}$ |
| $3\pi/2 \le \delta_{RV1} < 2\pi$ | $\alpha'_{3R_{4,1}} = 2\pi + \delta_{RV2} - \delta_{RV1}$ | $\alpha'_{3R_{4,2}} = 2\pi + \delta_{RV2} - \delta_{RV1}$ | $\alpha'_{3R_{4,3}} = 2\pi + \delta_{RV2} - \delta_{RV1}$ | $\alpha'_{3R_{4,4}} = \delta_{RV2} - \delta_{RV1}$ |

The controller 22 can perform, for example, the following mathematical process to determine $\alpha_{1_{m,n}}$, $\alpha_{2_{m,n}}$ and $\alpha_{3_{m,n}}'$. The $\alpha_{1L_{m,n}}$, $\alpha_{2L_{m,n}}$, $\alpha_{3L_{m,n}}'$, $\alpha_{1R_{m,n}}$, $\alpha_{2R_{m,n}}$ and $\alpha_{3R_{m,n}}'$ matrices provide 16 different values for each angle however, it is desirable to have a single equation for each angle which can be obtained as follows. First, the controller 22 can define the following expressions:

$$H_1 = \frac{1}{4}\left[\frac{\delta_{RV1} - 0 + \sigma}{|\delta_{RV1} - 0| + \sigma} + 1\right] \times \left[\frac{0.5\pi - \delta_{RV1} - \sigma}{|0.5\pi - \delta_{RV1}| + \sigma} + 1\right]$$

$$R_1 = \frac{1}{4}\left[\frac{\delta_{RV2} - 0 + \sigma}{|\delta_{RV2} - 0| + \sigma} + 1\right] \times \left[\frac{0.5\pi - \delta_{RV2} - \sigma}{|0.5\pi - \delta_{RV2}| + \sigma} + 1\right]$$

$$H_2 = \frac{1}{4}\left[\frac{\delta_{RV1} - 0.5\pi + \sigma}{|\delta_{RV1} - 0.5\pi| + \sigma} + 1\right] \times \left[\frac{\pi - \delta_{RV1} - \sigma}{|\pi - \delta_{RV1}| + \sigma} + 1\right]$$

$$R_2 = \frac{1}{4}\left[\frac{\delta_{RV2} - 0.5\pi + \sigma}{|\delta_{RV2} - 0.5\pi| + \sigma} + 1\right] \times \left[\frac{\pi - \delta_{RV2} - \sigma}{|\pi - \delta_{RV2}| + \sigma} + 1\right]$$

$$H_3 = \frac{1}{4}\left[\frac{\delta_{RV1} - \pi + \sigma}{|\delta_{RV1} - \pi| + \sigma} + 1\right] \times \left[\frac{1.5\pi - \delta_{RV1} - \sigma}{|1.5\pi - \delta_{RV1}| + \sigma} + 1\right]$$

$$R_3 = \frac{1}{4}\left[\frac{\delta_{RV2} - \pi + \sigma}{|\delta_{RV2} - \pi| + \sigma} + 1\right] \times \left[\frac{1.5\pi - \delta_{RV2} - \sigma}{|1.5\pi - \delta_{RV2}| + \sigma} + 1\right]$$

-continued $$H_4 = \frac{1}{4}\left[\frac{\delta_{RV1} - 1.5\pi + \sigma}{|\delta_{RV1} - 1.5\pi| + \sigma} + 1\right] \times \left[\frac{2\pi - \delta_{RV1} - \sigma}{|2\pi - \delta_{RV1}| + \sigma} + 1\right]$$

$$R_4 = \frac{1}{4}\left[\frac{\delta_{RV2} - 1.5\pi + \sigma}{|\delta_{RV2} - 1.5\pi| + \sigma} + 1\right] \times \left[\frac{2\pi - \delta_{RV2} - \sigma}{|2\pi - \delta_{RV2}| + \sigma} + 1\right]$$

The controller 22 can use these expressions to form the F Matrix as shown in Table 20 below.

TABLE 20

| $F_{m,n}$ | $R_1$ | $R_2$ | $R_3$ | $R_4$ |
|---|---|---|---|---|
| $H_1$ | $F_{1,1} = H_1 \times R_1$ | $F_{1,2} = H_1 \times R_2$ | $F_{1,3} = H_1 \times R_3$ | $F_{1,4} = H_1 \times R_4$ |
| $H_2$ | $F_{2,1} = H_2 \times R_1$ | $F_{2,2} = H_2 \times R_2$ | $F_{2,3} = H_2 \times R_3$ | $F_{2,4} = H_2 \times R_4$ |
| $H_3$ | $F_{3,1} = H_3 \times R_1$ | $F_{2,3} = H_2 \times R_3$ | $F_{3,3} = H_3 \times R_3$ | $F_{3,4} = H_3 \times R_4$ |
| $H_4$ | $F_{4,1} = H_4 \times R_1$ | $F_{4,2} = H_4 \times R_2$ | $F_{4,3} = H_4 \times R_3$ | $F_{4,4} = H_4 \times R_4$ |

The controller 22 can use the F Matrix to filter out all but the relevant values for $\alpha_{1L}$ and $\alpha_{1R}$ in the following matrix in Table 21 below:

TABLE 21

| $\alpha_1$ | Counter-Clockwise Turn, $\alpha_{1L_{m,n}}$ | | | | Clockwise Turn, $\alpha_{1R_{m,n}}$ | | | |
|---|---|---|---|---|---|---|---|---|
| $\alpha_{1L_{1,1}} \times F_{1,1}$ | $\alpha_{1L_{1,2}} \times F_{1,2}$ | $\alpha_{1L_{1,3}} \times F_{1,3}$ | $\alpha_{1L_{1,4}} \times F_{1,4}$ | $\alpha_{1R_{1,1}} \times F_{1,1}$ | $\alpha_{1R_{1,2}} \times F_{1,2}$ | $\alpha_{1R_{1,3}} \times F_{1,3}$ | $\alpha_{1R_{1,4}} \times F_{1,4}$ |
| $\alpha_{1L_{2,1}} \times F_{2,1}$ | $\alpha_{1L_{2,2}} \times F_{2,2}$ | $\alpha_{1L_{2,3}} \times F_{2,3}$ | $\alpha_{1L_{2,4}} \times F_{2,4}$ | $\alpha_{1R_{2,1}} \times F_{2,1}$ | $\alpha_{1R_{2,2}} \times F_{2,2}$ | $\alpha_{1R_{2,3}} \times F_{2,3}$ | $\alpha_{1R_{2,4}} \times F_{2,4}$ |
| $\alpha_{1L_{3,1}} \times F_{3,1}$ | $\alpha_{1L_{3,2}} \times F_{3,2}$ | $\alpha_{1L_{3,3}} \times F_{3,3}$ | $\alpha_{1L_{3,4}} \times F_{3,4}$ | $\alpha_{1R_{3,1}} \times F_{3,1}$ | $\alpha_{1R_{3,2}} \times F_{3,2}$ | $\alpha_{1R_{3,3}} \times F_{3,3}$ | $\alpha_{1R_{3,4}} \times F_{3,4}$ |
| $\alpha_{1L_{4,1}} \times F_{4,1}$ | $\alpha_{1L_{4,2}} \times F_{4,2}$ | $\alpha_{1L_{4,3}} \times F_{4,3}$ | $\alpha_{1L_{4,4}} \times F_{4,4}$ | $\alpha_{1R_{4,1}} \times F_{4,1}$ | $\alpha_{1R_{4,2}} \times F_{4,2}$ | $\alpha_{1R_{4,3}} \times F_{4,3}$ | $\alpha_{1R_{4,4}} \times F_{4,4}$ |

using, for example, the following equations $$\alpha_{1L} = \sum_{n=1}^{4}\sum_{m=1}^{4} \alpha_{1L_{m,n}} \times F_{m,n} \text{ and } \alpha_{1R} = \sum_{n=1}^{4}\sum_{m=1}^{4} \alpha_{1R_{m,n}} \times F_{m,n}.$$

The controller 22 can perform similar operations to obtain the relevant values for $\alpha_{2L}$ and $\alpha_{2R}$ in the following matrix in Table 22:

TABLE 22

| $\alpha_2$ | Counter-Clockwise Turn, $\alpha_{2L_{m,n}}$ | | | | Clockwise Turn, $\alpha_{2R_{m,n}}$ | | | |
|---|---|---|---|---|---|---|---|---|
| $\alpha_{2L_{1,1}} \times F_{1,1}$ | $\alpha_{2L_{1,2}} \times F_{1,2}$ | $\alpha_{2L_{1,3}} \times F_{1,3}$ | $\alpha_{2L_{1,4}} \times F_{1,4}$ | $\alpha_{2R_{1,1}} \times F_{1,1}$ | $\alpha_{2R_{1,2}} \times F_{1,2}$ | $\alpha_{2R_{1,3}} \times F_{1,3}$ | $\alpha_{2R_{1,4}} \times F_{1,4}$ |
| $\alpha_{2L_{2,1}} \times F_{2,1}$ | $\alpha_{2L_{2,2}} \times F_{2,2}$ | $\alpha_{2L_{2,3}} \times F_{2,3}$ | $\alpha_{2L_{2,4}} \times F_{2,4}$ | $\alpha_{2R_{2,1}} \times F_{2,1}$ | $\alpha_{2R_{2,2}} \times F_{2,2}$ | $\alpha_{2R_{2,3}} \times F_{2,3}$ | $\alpha_{2R_{2,4}} \times F_{2,4}$ |
| $\alpha_{2L_{3,1}} \times F_{3,1}$ | $\alpha_{2L_{3,2}} \times F_{3,2}$ | $\alpha_{2L_{3,3}} \times F_{3,3}$ | $\alpha_{2L_{3,4}} \times F_{3,4}$ | $\alpha_{2R_{3,1}} \times F_{3,1}$ | $\alpha_{2R_{3,2}} \times F_{3,2}$ | $\alpha_{2R_{3,3}} \times F_{3,3}$ | $\alpha_{2R_{3,4}} \times F_{3,4}$ |
| $\alpha_{2L_{4,1}} \times F_{4,1}$ | $\alpha_{2L_{4,2}} \times F_{4,2}$ | $\alpha_{2L_{4,3}} \times F_{4,3}$ | $\alpha_{2L_{4,4}} \times F_{4,4}$ | $\alpha_{2R_{4,1}} \times F_{4,1}$ | $\alpha_{2R_{4,2}} \times F_{4,2}$ | $\alpha_{2R_{4,3}} \times F_{4,3}$ | $\alpha_{2R_{4,4}} \times F_{4,4}$ |

using, for example, the following equations $$\alpha_{2L} = \sum_{n=1}^{4}\sum_{m=1}^{4} \alpha_{2L_{m,n}} \times F_{m,n} \text{ and } \alpha_{2R} = \sum_{n=1}^{4}\sum_{m=1}^{4} \alpha_{2R_{m,n}} \times F_{m,n}$$

The controller 22 can obtain the relevant values for $\alpha_{CL}'$ and $\alpha_{3R}'$ in the following matrix in Table 23:

TABLE 23

| $\alpha'_3$ | Counter-Clockwise Turn, $\alpha'_{3L_{m,n}}$ | | | | Clockwise Turn, $\alpha'_{3R_{m,n}}$ | | | |
|---|---|---|---|---|---|---|---|---|
| $\alpha'_{3L_{1,1}} \times F_{1,1}$ | $\alpha'_{3L_{1,2}} \times F_{1,2}$ | $\alpha'_{3L_{1,3}} \times F_{1,3}$ | $\alpha'_{3L_{1,4}} \times F_{1,4}$ | $\alpha'_{3R_{1,1}} \times F_{1,1}$ | $\alpha'_{3R_{1,2}} \times F_{2,1}$ | $\alpha'_{3R_{1,3}} \times F_{1,3}$ | $\alpha'_{3R_{1,4}} \times F_{1,4}$ |
| $\alpha'_{3L_{2,1}} \times F_{2,1}$ | $\alpha'_{3L_{2,2}} \times F_{2,2}$ | $\alpha'_{3L_{2,3}} \times F_{2,3}$ | $\alpha'_{3L_{2,4}} \times F_{2,4}$ | $\alpha'_{3R_{2,1}} \times F_{2,1}$ | $\alpha'_{3R_{2,2}} \times F_{2,2}$ | $\alpha'_{3R_{2,3}} \times F_{2,3}$ | $\alpha'_{3R_{2,4}} \times F_{2,4}$ |
| $\alpha'_{3L_{3,1}} \times F_{3,1}$ | $\alpha'_{3L_{3,2}} \times F_{3,2}$ | $\alpha'_{3L_{3,3}} \times F_{3,3}$ | $\alpha'_{3L_{3,4}} \times F_{3,4}$ | $\alpha'_{3R_{3,1}} \times F_{3,1}$ | $\alpha'_{3R_{3,2}} \times F_{3,2}$ | $\alpha'_{3R_{3,3}} \times F_{3,3}$ | $\alpha'_{3R_{3,4}} \times F_{3,4}$ |
| $\alpha'_{3L_{4,1}} \times F_{4,1}$ | $\alpha'_{3L_{4,2}} \times F_{4,2}$ | $\alpha'_{3L_{4,3}} \times F_{4,3}$ | $\alpha'_{3L_{4,4}} \times F_{4,4}$ | $\alpha'_{3R_{4,1}} \times F_{4,1}$ | $\alpha'_{3R_{4,2}} \times F_{4,2}$ | $\alpha'_{3R_{4,3}} \times F_{4,3}$ | $\alpha'_{3R_{4,4}} \times F_{4,4}$ |

using, for example, the following equations:

$$\alpha'_{3L} = \sum_{n=1}^{4}\sum_{m=1}^{4} \alpha'_{3L_{m,n}} \times F_{m,n} \text{ and } \alpha'_{3R} = \sum_{n=1}^{4}\sum_{m=1}^{4} \alpha'_{3R_{m,n}} \times F_{m,n}.$$

Thus, the matrices for $\alpha_1$, $\alpha_2$ and $\alpha_3'$ above produce two values, one for counter-clockwise turns and one for clockwise turns. The controller 22 can perform the following calculations to determine which values are relevant.

Two operators, L and R, are defined as follows:

$$L_{m,n} = \frac{1}{4}\left[\frac{\alpha'_{3L_{m,n}} \times F_{m,n} - 0 - \sigma}{\left|\alpha'_{3L_{m,n}} \times F_{m,n} - 0\right| + \sigma} + 1\right] \times \left[\frac{\pi - \alpha'_{3L_{m,n}} \times F_{m,n} - \sigma}{\left|\pi - \alpha'_{3L_{m,n}} \times F_{m,n}\right| + \sigma} + 1\right]$$

-continued $$R_{1,1} = \frac{1}{4}\left[\frac{\alpha'_{3R_{m,n}} \times F_{m,n} - 0 - \sigma}{\left|\alpha'_{3R_{m,n}} \times F_{m,n} - 0\right| + \sigma} + 1\right] \times \left[\frac{\pi - \alpha'_{3R_{m,n}} \times F_{m,n} - \sigma}{\left|\pi - \alpha'_{3R_{m,n}} \times F_{m,n}\right| + \sigma} + 1\right] \text{ with}$$

$$L = \sum_{n=1}^{4}\sum_{m=1}^{4} L_{m,n} \text{ and } R = \sum_{n=1}^{4}\sum_{m=1}^{4} R_{m,n}$$

The controller 22 can perform the following calculations to determine which values are relevant.

Whichever one of the above equations for L and R equals 1 defines the direction of the turn. Thus, if L=1, the remote vehicles 14-1 or 14-2 in a counter-clockwise turn around the traffic circle 40. However, if R=1, the remote vehicles 14-1 and 14-2 are travelling in a clockwise turn around the traffic circle 40. The controller 22 of the traffic circle identification system 12 can thus easily determine if a remote vehicle 14-1 or 14-2 is traveling around the traffic circle 40 in the wrong direction. For example, if R=1 for any traffic circle in North America, the traffic circle identification system 12 onboard the host vehicle 10 can immediately provide a warning to the driver to be aware of a remote vehicle 14-1 or 14-2 traveling the wrong way in the approaching traffic circle 40. As can be appreciated from FIG. 2, such as warning can be a displayed warning on the screen display 32A, an audio warning via the audio speaker 32B, a tactile warning, or any other suitable type of warning as understood in the art.

The controller 22 can then define angles $\alpha_1$, $\alpha_2$ and $\alpha_3'$ are then defined as follows:

$$\alpha_1 = L\times\sum_{n=1}^{4}\sum_{m=1}^{4}\alpha_{1L_{m,n}}\times F_{m,n} + R\times\sum_{n=1}^{4}\sum_{m=1}^{4}\alpha_{1R_{m,n}}\times F_{m,n}$$

$$\alpha_2 = L\times\sum_{n=1}^{4}\sum_{m=1}^{4}\alpha_{2L_{m,n}}\times F_{m,n} + R\times\sum_{n=1}^{4}\sum_{m=1}^{4}\alpha_{2R_{m,n}}\times F_{m,n}$$

$$\alpha_3' = L\times\sum_{n=1}^{4}\sum_{m=1}^{4}\alpha_{3L_{m,n}}'\times F_{m,n} + R\times\sum_{n=1}^{4}\sum_{m=1}^{4}\alpha_{3R_{m,n}}'\times F_{m,n}$$

and employ the Law of Sines to obtain expressions for R.

$$\frac{R_1}{\sin\alpha_1} = \frac{D}{|\sin\alpha_3'|}$$

$$R_1 = D\frac{\sin\alpha_1}{|\sin\alpha_3'|} \text{ or}$$

$$\frac{R_2}{\sin\alpha_2} = \frac{D}{|\sin\alpha_3'|}$$

$$R_2 = D\frac{\sin\alpha_2}{|\sin\alpha_3'|} \text{ where}$$

$$D = (1-f)r_e\sqrt{\frac{(\theta_{RV2}-\theta_{RV1})^2\cos^2\phi_{RV1} + (\phi_{RV2}-\phi_{RV1})^2}{\sin^2\phi_{RV1} + (1-f)^2\cos^2\phi_{RV1}}}$$

The controller 22 can compare $R_1$ and $R_2$ to assess the quality of the calculated radius of curvature of the traffic circle 40. However, since the two values should be nearly equal, the controller 22 can determine that a significant difference between the values $R_1$ and $R_2$ indicate low reliability in the values and thus, the values should not be trusted.

Thus, using the above calculations in Step 102 in the flowchart of FIG. 8 based on remote vehicle information received from a plurality of remote vehicles 14-1 and 14-2 at the same time, the traffic circle identification system 12 can determine in Step 104 whether or not a traffic circle 40 is present in the path along which the host vehicle 10 is travelling. If so, the traffic circle identification system 12 can provide an indication in Step 106 that the host vehicle 10 is approaching the traffic circle 40. Such as indication can be a display of the traffic circle 40 on a map display that is being displayed on the screen display 32A shown in FIG. 2. The indication can also represent the diameter of the traffic circle 40. The traffic circle identification system 12 can also provide an audio indication of the approaching circle via the audio speaker 32B, a tactile indication, or any other suitable type of warning. However, if the traffic circle identification system 12 determines in Step 104 that no traffic circle 40 is present, the traffic circle identification system 12 can provide an indication that the host vehicle 10 is not approaching a traffic circle 40. The indication can be, for example, refraining from providing a warning of an approaching traffic circle 40, as well as a display of the map data on the screen display 32A indicating that the path along which the host vehicle 10 is travelling does not include a traffic circle 40 in proximity to the location of the host vehicle 10.

Moreover, as with the calculations pertaining to a single remote vehicle 14 as discussed above, the controller 22 can determine from the above calculations the location of the traffic circle 40 relative to the location of the host vehicle 10 at a predetermined time when the controller 22 determines that the traffic circle 40 exists. Also, since the controller 22 is determining a respective movement characteristic of each of the remote vehicle 14-1 and 14-2 in the traffic circle 40 when the controller 22 determines that the traffic circle exists, the controller 22 can control the warning system onboard the host vehicle 10 to issue a warning based on the movement characteristic of the remote vehicle 14-1, the remote vehicle 14-2, or both, relative to the host vehicle 10, if appropriate. For instance, the controller 22 can control the warning system to issue a warning upon determining that the direction of movement the remote vehicle 14-1, the remote vehicle 14-2, or both, in the traffic circle 40 is opposite to a direction of movement of the host vehicle 10 in the traffic circle 40 as discussed above. The controller 22 can control the warning system to issue a warning upon determining that the respective distance of the remote vehicle 14-1, the remote vehicle 14-2, or both, in the traffic circle 40 from the host vehicle 10 is decreasing.

While only selected embodiments have been chosen to illustrate the present invention, it will be apparent to those skilled in the art from this disclosure that various changes and modifications can be made herein without departing from the scope of the invention as defined in the appended claims. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A traffic circle identification system comprising:

a receiver, disposed onboard a host vehicle and configured to receive remote vehicle information representing a travel condition of a single remote vehicle directly from the single remote vehicle; and an electronic controller that, based on the remote vehicle information from only the single remote vehicle and without use of map data, is configured to determine whether a traffic circle exists along a current travel path of the host vehicle, is configured to determine the single remote vehicle currently occupies the traffic circle, is configured to determine a movement characteristic of the single remote vehicle currently in the traffic circle, is configured to calculate a distance of the single remote vehicle in the traffic circle from the host vehicle and is configured to control a warning system to issue a warning upon determining that the distance of the single remote vehicle in the traffic circle from the host vehicle is decreasing.

2. The traffic circle identification system according to claim 1, wherein the remote vehicle information includes information representing a respective heading of the single remote vehicle at each of a plurality of locations of the single remote vehicle.

3. The traffic circle identification system according to claim 2, wherein the remote vehicle information includes information representing a respective turning radius of the single remote vehicle at each of the plurality of locations of the single remote vehicle.

4. The traffic circle identification system according to claim 1, wherein the remote vehicle information includes information representing respective locations and headings of a plurality of remote vehicles at a predetermined time.

5. The traffic circle identification system according to claim 4, wherein the remote vehicle information includes information representing a respective turning radius of each of the remote vehicles at the predetermined time.

6. The traffic circle identification system according to claim 1, wherein the electronic controller is configured to determine a diameter of the traffic circle when the electronic controller determines that the traffic circle exists.

7. The traffic circle identification system according to claim 1, wherein the electronic controller is configured to determine a location of the traffic circle relative to the location of the host vehicle at a predetermined time when the electronic controller determines that the traffic circle exists.

8. The traffic circle identification system according to claim 1, wherein the electronic controller is further configured to control the warning system onboard the host vehicle to issue a second warning based on the movement characteristic of the single remote vehicle relative to the host vehicle.

9. The traffic circle identification system according to claim 8, wherein the movement characteristic of the single remote vehicle indicates a direction of movement of the single remote vehicle in the traffic circle.

10. The traffic circle identification system according to claim 9, wherein the electronic controller is configured to control the warning system to issue the second warning upon determining that the direction of movement the single remote vehicle in the traffic circle is opposite to a direction of movement of the host vehicle in the traffic circle.

11. The traffic circle identification system according to claim 1, wherein the electronic controller is further configured to control the warning system onboard the host vehicle to issue a second warning when the electronic controller determines that the host vehicle is about to enter the traffic circle.

12. A method for identifying a traffic circle comprising:

operating a receiver, disposed onboard a host vehicle, to receive remote vehicle information representing a travel condition of a single remote vehicle directly from the single remote vehicle; and determining, based on the remote vehicle information from only the single remote vehicle and without use of map data, by an electronic controller, that a traffic circle exists along a current travel path of the host vehicle, that the single remote vehicle currently occupies the traffic circle, and a movement characteristic of the single remote vehicle currently in the traffic circle, calculating a distance of the single remote vehicle in the traffic circle from the host vehicle and controlling a warning system to issue a warning upon determining that the distance of the single remote vehicle in the traffic circle from the host vehicle is decreasing.

13. The method according to claim 12, further comprising determining, by the electronic controller, a location of the traffic circle relative to the location of the host vehicle at a predetermined time when the electronic controller determines that the traffic circle exists.

14. The method according to claim 12, wherein the controlling controls, by the electronic controller, the warning system to issue a second warning upon determining that the direction of movement the single remote vehicle in the traffic circle is opposite to a direction of movement of the host vehicle in the traffic circle.

15. The method according to claim 12, wherein the operating operates the receiver to receive the remote vehicle information via direct communication with the single remote vehicle.

16. A traffic circle identification system comprising:

a receiver, disposed onboard a host vehicle and configured to receive remote vehicle information from a first remote vehicle representing a travel condition of the first remote vehicle directly from the first remote vehicle and simultaneously receive remote vehicle information from a second remote vehicle representing a travel condition of the second remote vehicle directly from the first remote vehicle; and an electronic controller that, based on the received remote vehicle information from the first and second remote vehicles and without use of map data, is configured to determine whether a traffic circle exists, the remote vehicle information from the first remote vehicle including a first position and a first heading of the first remote vehicle and the remote vehicle information from the second remote vehicle including a second position and a second heading of the second remote vehicle, the electronic controller further configured to determine a radius of the traffic circle by calculating an angle between the first and second remote vehicles based on the first position and the first heading of the first remote vehicle and the second position and the second heading of the second remote vehicle.

* * * * *